US009809032B2

(12) United States Patent
Ono

(10) Patent No.: US 9,809,032 B2
(45) Date of Patent: Nov. 7, 2017

(54) LIQUID CARTRIDGE

(71) Applicant: BROTHER KOGYO KABUSHIKI KAISHA, Nagoya-shi, Aichi-ken (JP)

(72) Inventor: Akihito Ono, Nagoya (JP)

(73) Assignee: BROTHER KOGYO KABUSHIKI KAISHA, Nagoya-shi, Aichi-Ken (JP)

( * ) Notice: Subject to any disclaimer, the term of this patent is extended or adjusted under 35 U.S.C. 154(b) by 0 days.

(21) Appl. No.: 15/009,914

(22) Filed: Jan. 29, 2016

(65) Prior Publication Data

US 2016/0279954 A1 Sep. 29, 2016

(30) Foreign Application Priority Data

Mar. 27, 2015 (JP) ..... 2015-066121
Mar. 27, 2015 (JP) ..... 2015-066122
Mar. 27, 2015 (JP) ..... 2015-066123

(51) Int. Cl.
*B41J 2/165* (2006.01)
*B41J 2/175* (2006.01)

(52) U.S. Cl.
CPC ..... *B41J 2/17503* (2013.01); *B41J 2/175* (2013.01); *B41J 2/17513* (2013.01); *B41J 2/17523* (2013.01); *B41J 2/17553* (2013.01); *B41J 2/17566* (2013.01); *B41J 2002/17569* (2013.01); *B41J 2002/17576* (2013.01)

(58) Field of Classification Search
None
See application file for complete search history.

(56) References Cited

U.S. PATENT DOCUMENTS 6,378,971 B1 4/2002 Tamura et al.
7,188,939 B1 * 3/2007 Sasaki ..... B41J 2/17513 347/7

(Continued)

FOREIGN PATENT DOCUMENTS

EP 2 165 837 A1 3/2010
JP 9-277560 A 10/1997

(Continued)

OTHER PUBLICATIONS

Related U.S. Appl. No. 15/009,890, filed Jan. 29, 2016.

(Continued)

*Primary Examiner* — Alejandro Valencia
(74) *Attorney, Agent, or Firm* — Merchant & Gould P.C.

(57) ABSTRACT

A liquid cartridge includes a chamber configured to store liquid therein, with a liquid outlet configured to supply the liquid from an interior of the chamber to an exterior of the chamber. A detector is positioned in the chamber so as to be rotatable between a released position and a restricted position. The detector has a detection portion and a restriction portion with a first contact surface defining a first length. A restriction member includes a second contact surface that defines a second length greater than the first length. The restriction member is movable straightly between a first position in which the first and second contact surfaces contact one another, a second position in which the first and second contact surfaces do not contact one another, and a third position between the first and second positions in which the first and second contact surfaces contact one another.

16 Claims, 34 Drawing Sheets

(56) References Cited

U.S. PATENT DOCUMENTS

| | | | |
|---|---|---|---|
| 2010/0103231 | A1 | 4/2010 | Iwamura et al. |
| 2010/0110154 | A1 | 5/2010 | Iwamura et al. |
| 2016/0039209 | A1 | 2/2016 | Sugahara |
| 2016/0279961 | A1 | 9/2016 | Nukui et al. |

FOREIGN PATENT DOCUMENTS

| | | | |
|---|---|---|---|
| JP | 2001-232806 | A | 8/2001 |
| JP | 2005-145126 | A | 6/2005 |
| JP | 2008-93862 | A | 4/2008 |
| JP | 2010-69757 | A | 4/2010 |
| JP | 2010-105238 | A | 5/2010 |
| JP | 2010-105239 | A | 5/2010 |
| JP | 2010-105268 | A | 5/2010 |
| JP | 2011-140128 | A | 7/2011 |

OTHER PUBLICATIONS

U.S. Office Action issued in related U.S. Appl. No. 15/009,890, dated Jul. 21, 2016.
U.S. Office Action issued in related U.S. Appl. No. 15/009,890, dated Oct. 12, 2016.
U.S. Office Action (Notice of Allowance) issued related U.S. Appl. No. 15/009,890, dated Feb. 17, 2017.

* cited by examiner

LIQUID CARTRIDGE

CROSS-REFERENCE TO RELATED APPLICATION

This application claims priority from Japanese Patent Application Nos. 2015-066121, 2015-066122, and 2015-066123, all of which were filed on Mar. 7, 2015, each of which is incorporated herein by reference in its entirety.

TECHNICAL FIELD

Aspects described herein relate to a liquid cartridge in which lowering of an amount of liquid stored in a liquid storage chamber is detectable and a liquid consuming apparatus including the liquid cartridge.

BACKGROUND

A known inkjet recording apparatus records an image on a recording medium by ejecting ink stored in an ink storage chamber of an ink cartridge. Among various types of ink cartridges, an ink cartridge includes a member, e.g., a float, which is movable within its ink storage chamber in accordance with an amount of ink remaining in the ink storage chamber.

In such an inkjet recording apparatus, a change in viscosity of ink stored in the ink storage chamber of the ink cartridge may cause clogging in the nozzles and/or deterioration of image recording quality. In order to avoid an occurrence of such problems, for example, the inkjet recording apparatus calculates the viscosity of ink stored in the ink storage chamber. The float is retained by a restriction member with being submerged in ink. The calculation is performed by measuring a time elapsed until a detector reaches a released position due to a buoyant force of the float from a release of the float. In order to move the detector by access from the outside of the ink cartridge, a movable member needs to be provided for transmitting an external force exerted from the outside of the ink cartridge to the detector by movement of the movable member. The movable member is generally disposed in an internal space of an ink outlet, which extends between the ink storage chamber and the outside of the ink cartridge in order to allow ink to flow to the outside of the ink cartridge from the ink storage chamber. In this arrangement, there is a gap between the movable member and a wall of defining the internal space.

SUMMARY

In accordance with aspects of the present disclosure, an example liquid cartridge includes a chamber configured to store liquid therein, with a liquid outlet configured to supply the liquid from an interior of the chamber to an exterior of the chamber. A detector is positioned in the chamber, and the detector is rotatable between a released position and a restricted position. The detector has a detection portion and a restriction portion with a first contact surface defining a first length. A restriction member includes a second contact surface that defines a second length greater than the first length. The restriction member is movable straightly between a first position in which the first and second contact surfaces contact one another, a second position in which the first and second contact surfaces do not contact one another, and a third position between the first and second positions in which the first and second contact surfaces contact one another.

DESCRIPTION OF THE DRAWINGS

Aspects of the disclosure are illustrated by way of example and not by limitation in the accompanying figures in which like reference characters indicate similar elements.

DETAILED DESCRIPTION

Figure 1:
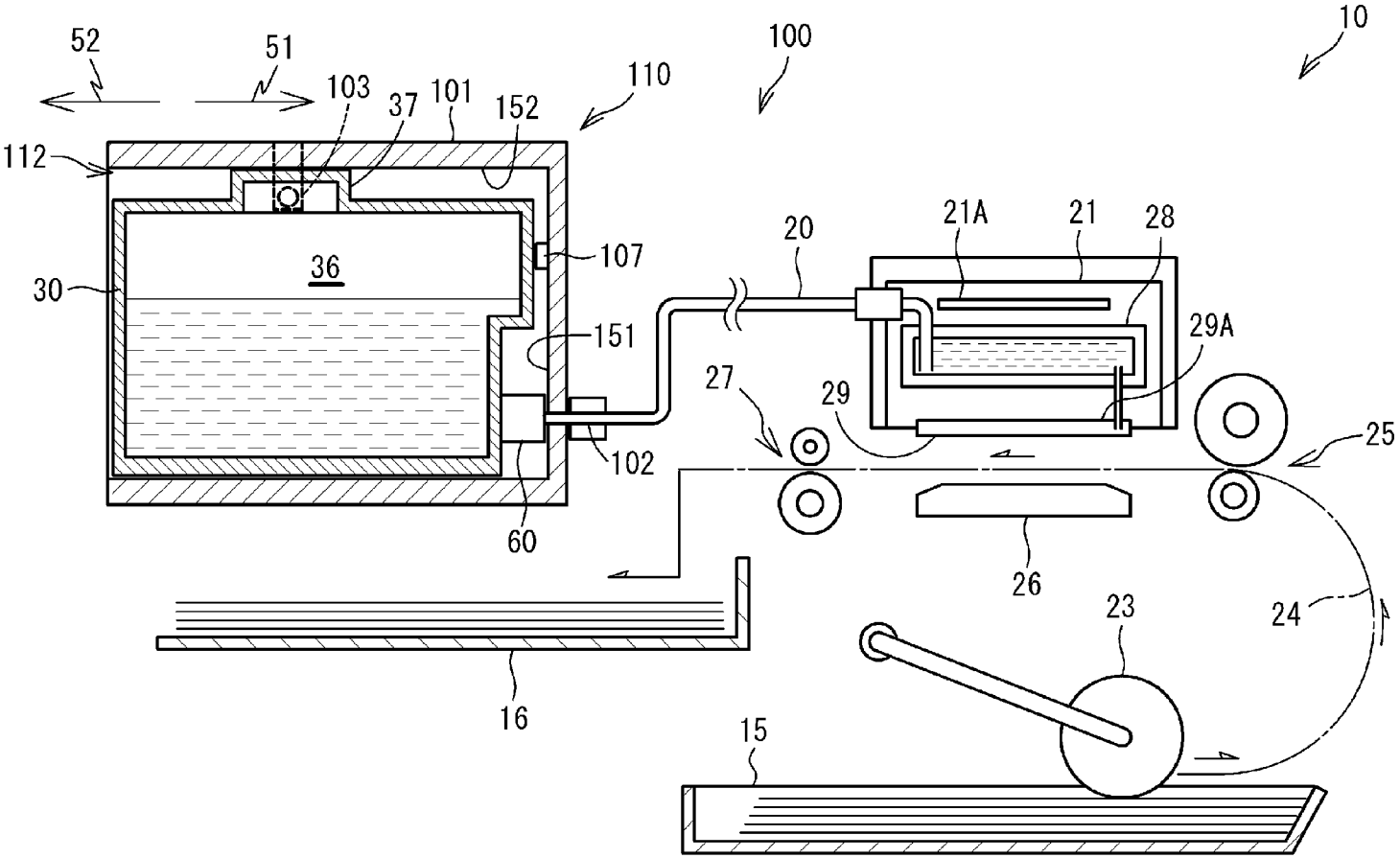
FIG. 1 is a schematic cross-sectional view depicting an internal configuration of a printer including a cartridge holder in an illustrative embodiment according to one or more aspects of the disclosure.

Hereinafter, various illustrative embodiments will be described in detail with reference to the accompanying drawings, wherein like reference numerals represent like parts and assemblies throughout the several views. Reference to various embodiments does not limit the scope of the claims attached hereto. Additionally, any example set forth in the specification are not intended to be limiting and merely set forth some of the many possible embodiments for the appended claims. Throughout the specification, a threshold range might not necessarily have upper and lower limits that are both specified but may need to have at least one specified limit (e.g., a specified upper limit or a specified lower limit). For example, when the threshold range has a specified upper limit, the threshold range may include all values that are smaller than or equal to the upper limit. Similar to this, when the threshold range has a specified lower limit, the threshold range may include all values that are greater than or equal to the lower limit. In the description below, a direction that an ink cartridge 30 is inserted into a cartridge holder 110 may be defined as an insertion direction 51. A direction that is opposite to the insertion direction 51 and that an ink cartridge 30 is removed from the cartridge holder 110 may be defined as a removal direction 52. In the illustrative embodiments, the insertion direction 51 and the removal direction 52 both may be the horizontal direction but might not be limited thereto. In a state where an ink cartridge 30 is completely placed in the cartridge holder 110, e.g., in a state where the ink cartridge 30 is in a use position, the gravity direction may be defined as a downward direction 53 and a direction opposite to the gravity direction may be defined as an upward direction 54. Directions orthogonal to the insertion direction 51 and the downward direction 53 may be defined as a rightward direction 55 and a leftward direction 56 when viewed in the removal direction 52. Unless otherwise defined, it is assumed that an ink cartridge 30 is in the use position.

The degree of the change in ink viscosity of ink contained in an ink cartridge may differ greatly depending on, for example, an ink type and/or the temperature of an environment where an ink tank is stocked. Known inkjet recording apparatuses might not be capable of calculating the viscosity of ink stored in an ink tank that has been left and not been attached to the inkjet recording apparatus. Accordingly, some embodiments of the disclosure provide for a liquid cartridge that may enable direct estimation of viscosity of liquid stored in a storage chamber thereof.

[Overview of Printer 10]

As depicted in FIG. 1, a printer 10 is configured to record an image onto a recording sheet by selectively ejecting ink droplets onto the recording sheet using an inkjet recording system. The printer 10 (as an example of a liquid consuming apparatus) includes a recording head 21 (as an example of a liquid consuming unit), an ink supply unit 100, and an ink tube 20. The ink tube 20 connects between the recording head 21 and the ink supply unit 100. The ink supply unit 100 includes a cartridge holder 110 (as an example of a holder). The cartridge holder 110 is configured to accommodate one or more ink cartridges 30 (as an example of a liquid cartridge). The cartridge holder 110 has an opening 112 at one end. An ink cartridge 30 is inserted into the cartridge holder 110 in the insertion direction 51 through the opening 112 or is removed from the cartridge holder 110 in the removal direction 52 through the opening 112.

An ink cartridge 30 stores ink (as an example of liquid) to be used in the printer 10. In a state where the ink cartridge 30 is completely placed in the cartridge holder 110, the ink cartridge 30 and the recording head 21 are connected with each other via the ink tube 20. The recording head 21 includes a sub tank 28. The sub tank 28 is configured to temporarily store therein ink supplied from the ink cartridge 30 through the ink tube 20. The recording head 21 ejects ink, which is supplied from the sub tank 28, from nozzles 29 selectively. For example, the recording head 21 further includes a head control board 21A. The head control board 21A applies drive voltage selectively to piezoelectric elements 29A provided for the respective nozzles 29, whereby ink is ejected from appropriate nozzles 29 selectively.

In the printer 10, a feed roller 23 feeds one or more recording sheets one by one from a feed tray 15 into a conveying path 24. A conveyor roller pair 25 further conveys the recording sheet onto a platen 26. The recording head 21 selectively ejects ink onto the recording sheet that is passing over the platen 26, thereby recording an image onto the recording sheet. A discharge roller pair 27 then discharges the recording sheet, which has passed over the platen 26, onto a discharge tray 16 disposed at a downstream end of the conveying path 24.

[Ink Supply Unit 100]

As depicted in FIG. 1, the ink supply unit 100 is included in the printer 10. The ink supply unit 100 is configured to supply ink to the recording head 21 of the printer 10. The ink supply unit 100 includes the cartridge holder 110 for accommodating one or more ink cartridges 30. The cartridge holder 110 includes a casing 101, an ink needle 102, a sensor 103 (as an example of a sensor), and a cartridge sensor 107.

In FIG. 1, an ink cartridge 30 is completely placed in the cartridge holder 110. That is, the ink cartridge 30 is in the use position. The cartridge holder 110 is capable of accommodating a plurality of, for example, four, ink cartridges 30 of respective colors of ink, e.g., cyan, magenta, yellow, and black. Therefore, in the illustrative embodiment, the cartridge holder 110 includes four each of the ink needle 102, the sensor 103, and the cartridge sensor 107, for the ink cartridges 30 of the respective four colors. In the description below, plural same components have the same or similar configuration and function in the same or similar manner to each other. Therefore, one of the plural same components will be described in detail, and a description for the others will be omitted. When a single ink cartridge 30 is inserted into, removed from, or placed in the cartridge holder 110, one or more other ink cartridges 30 may or might not be placed in the cartridge holder 110.

[Ink Needles 102]

As depicted in FIG. 1, the casing 101 has the opening 112 at one end. The casing 101 has an inner back surface 151 at an opposite end to the opening 112 thereof. An ink needle 102 protrudes in the removal direction 52 from the inner back surface 151 of the casing 101. The ink needle 102 is disposed at a particular position at the inner back surface 151 of the casing 101 such that the ink needle 102 is capable of pointing to an ink outlet 60 (as an example of a liquid outlet) of a corresponding ink cartridge 30 placed in the cartridge holder 110. The ink needle 102 may be a resin hollow tube having a liquid channel inside thereof. The ink needle 102 has a hole at or near its distal end. An ink tube 20 is connected with a proximal end of the ink needle 102. Ink stored in a first ink chamber 36 (as an example of a liquid storage chamber) of an ink cartridge 30 is allowed to flow into the ink tube 20 through the ink needle 102 disposed in the ink outlet 60 by insertion. That is, ink stored in the first ink chamber 36 is supplied to the recording head 21 from the ink cartridge 30 placed in the cartridge holder 110, through the ink outlet 60. All of the ink needles 102 provided for the ink cartridges 30 of the respective colors have the same or similar configuration and function in the same or similar manner to each other.

The printer 10 further includes a cover (not depicted) that is configured to selectively cover and expose the opening 112 of the cartridge holder 110. The cover is supported by one of the casing 101 and a housing (not depicted) of the printer 10 such that the cover is capable of being opened and closed relative to the cartridge holder 110. When the cover is opened, the opening 112 is exposed to the outside of the printer 10. In this state, a user is allowed to insert or remove one or more ink cartridges 30 into or from the cartridge holder 110 through the opening 112. When the cover is closed, the opening 112 is covered by the cover and thus is not exposed to the outside of the printer 10. In this state, the user is not allowed to insert or remove any ink cartridge 30 into or from the cartridge holder 110.

Throughout the description, an ink cartridge 30 placed in the cartridge holder 110 refers to as an ink cartridge 30, at least a portion of which is located in the cartridge holder 110 (more specifically, in the casing 101). Therefore, an ink cartridge 30 placed in the cartridge holder 110 includes an ink cartridge 30 that is being inserted into the cartridge holder 110.

A state where an ink cartridge 30 is completely placed in the cartridge holder 110 refers to a state where an ink cartridge 30 is at least able to supply ink to the recording head 21 therefrom. For example, the completely placed state includes a state where an ink cartridge 30 is in a particular state that enables the printer 10 to perform image recording, e.g., a state where an ink cartridge 30 is retained so as not to move relative to the cartridge holder 110 or a state where an ink cartridge 30 is located inside the cartridge holder 110 with the cover of the cartridge holder 110 closed. When an ink cartridge 30 is completely placed in the cartridge holder 110, the ink cartridge 30 is in the use position.

[Sensors 103]

As depicted in FIG. 1, the casing 101 has an inner top surface 152 that extends from an upper end of the inner back surface 151 toward the opening 112. A sensor 103 protrudes downward from the inner top surface 152 of the casing 101. The sensor 103 includes a light emitting portion and a light receiving portion. The light emitting portion is spaced from the light receiving portion in one of the rightward direction 55 and the leftward direction 56. In a state where an ink cartridge 30 is completely placed in the cartridge holder 110, a raised portion 37 of the ink cartridge 30 is located between the light emitting portion and the light receiving portion. In other words, the light emitting portion and the light receiving portion are disposed on opposite sides of the raised portion 37 of the ink cartridge 30 that is completely placed in the cartridge holder 110. In the illustrative embodiment, an optical path that light emitted from the light emitting portion travels may coincide with a right-left direction 5556.

The sensor 103 is configured to output different detection signals according to whether light outputted from the light emitting portion has been received or not by the light receiving portion. For example, when the light receiving portion has not received light emitted from the light emitting portion (e.g., when intensity of received light is lower than a predetermined intensity), the sensor 103 outputs a low-level signal (e.g., a signal having a level lower than a threshold level). When the light receiving portion has received light outputted from the light emitting portion (e.g., when the intensity of received light is higher than or equal to the predetermined intensity), the sensor 103 outputs a high-level signal (e.g., a signal having a level higher than or equal to the threshold level). In the illustrative embodiment, the light emitting portion emits light (e.g., visible light or infrared light) that is capable of passing through walls of the raised portion 37 (e.g., a frame 31) of the ink cartridge 30 but is not capable of passing through ink stored in the ink cartridge 30. All of the sensors 103 provided for the ink cartridges 30 of the respective colors have the same or similar configuration and function in the same or similar manner to each other.

[Cartridge Sensors 107]

As depicted in FIG. 1, a cartridge sensor 107 is disposed above a corresponding ink needle 102 and at the inner back surface 151 of the casing 101. The cartridge sensor 107 is disposed at a cartridge placement detecting position in a route for inserting an ink cartridge 30 within the cartridge holder 110. The cartridge sensor 107 is configured to output different detection signals to a controller 130 (refer to FIG. 12) according to whether an ink cartridge 30 is present or absent at the cartridge placement detecting position. In the illustrative embodiment, the cartridge sensor 107 is disposed at a particular position such that an ink cartridge 30 is located at the cartridge placement detecting position when the ink cartridge 30 is completely placed in the cartridge holder 110.

For example, when the cartridge sensor 107 is not pressed by a front end 58 of a cartridge cover 33 of an ink cartridge 30 placed in the cartridge holder 110, the cartridge sensor 107 outputs a low-level signal. When the cartridge sensor 107 has been pressed by the front end 58 of the cartridge cover 33, the cartridge sensor 107 outputs a high-level signal. In the illustrative embodiment, the cartridge sensor 107 may be a mechanical sensor that is configured to output different detection signals according to whether the cartridge sensor 107 has been pressed by the front end 58 of the cartridge cover 33. Nevertheless, in other embodiments, an optical sensor may be used as a cartridge sensor 107. All of the cartridge sensors 107 provided for the ink cartridges 30 of the respective colors have the same or similar configuration and function in the same or similar manner to each other.

[Ink Cartridges 30]

Figure 2:
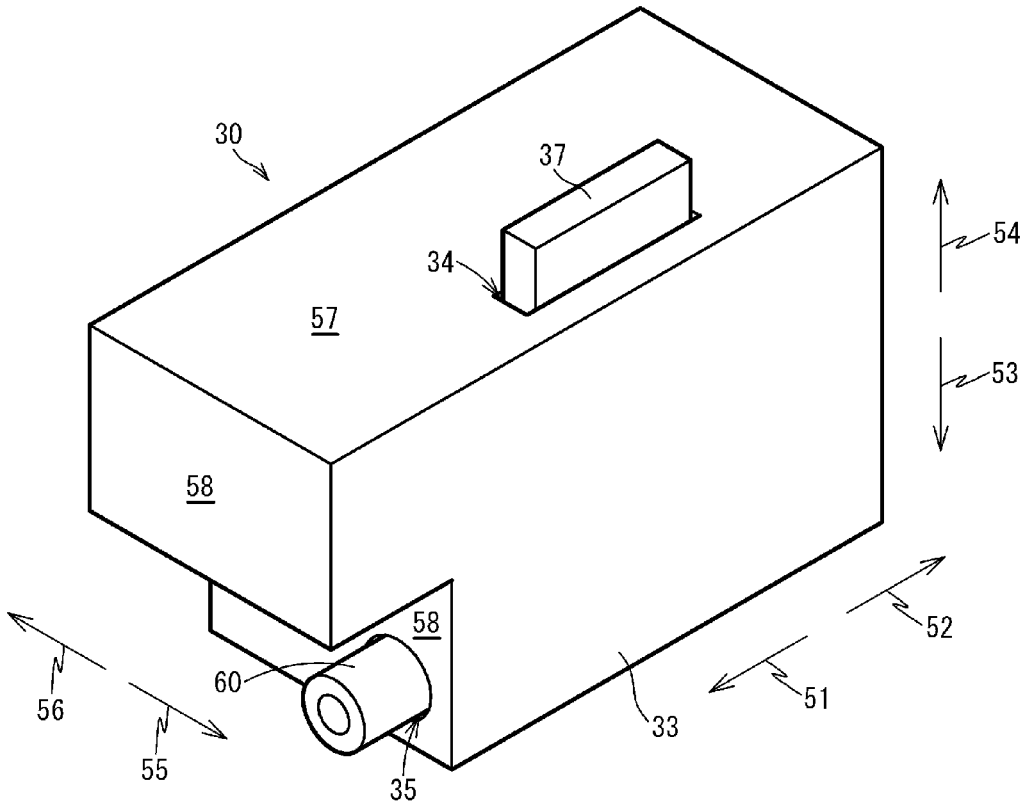
FIG. 2 is a schematic external perspective view depicting an ink cartridge in the illustrative embodiment according to one or more aspects of the disclosure.

All ink cartridges 30 to be placed in the cartridge holder 110 have the same or similar configuration and function in the same or similar manner to each other. Therefore, one of the ink cartridge 30 will be described in detail. As depicted in FIGS. 2 and 3, an ink cartridge 30 includes an ink tank 32 (as an example of a liquid tank) and a cartridge cover 33 that covers the ink tank 32. The cartridge cover 33 consists of two members that are engageable with each other and sandwich the ink tank 32 therebetween to cover the ink tank 32. As depicted in FIG. 2, the cartridge cover 33 has two openings 34 and 35. The opening 34 is defined in a top end 57 of the cartridge cover 33. The ink tank 32 includes a raised portion 37. The raised portion 37 of the ink tank 32 protrudes to the outside of the cartridge cover 33 through the opening 34. The opening 35 is defined in a front end 58 of the cartridge cover 33. The ink tank 32 further includes an ink outlet 60. The ink outlet 60 of the ink tank 32 protrudes to the outside of the cartridge cover 33 through the opening 35.

In the illustrative embodiment, the cartridge cover 33 allows the raised portion 37 and the ink outlet 60 of the ink tank 32 to protrude to the outside of the cartridge cover 33 through the opening 34 and the opening 35, respectively. Nevertheless, in other embodiments, for example, the cartridge cover 33 may also expose another portion of the ink tank 32 to the outside of the cartridge cover 33 as well as the raised portion 37 and the ink outlet 60.

As depicted in FIG. 3, the ink tank 32 includes an first ink chamber 36, the ink outlet 60, and a frame 31. The ink tank 32 may be made of transparent or translucent resin. The ink tank 32 is configured to supply ink to the outside thereof from the first ink chamber 36 through the ink outlet 60. The ink cartridge 30 is inserted into the cartridge holder 110 along the insertion direction 51 or removed from the cartridge holder 110 along the removal direction 52 while retained in a standing posture as depicted in FIG. 2, e.g., while oriented such that a surface facing downward is regarded as the bottom of the ink cartridge 30 and a surface facing upward is regarded as the top of the ink cartridge 30.

Figure 3A:
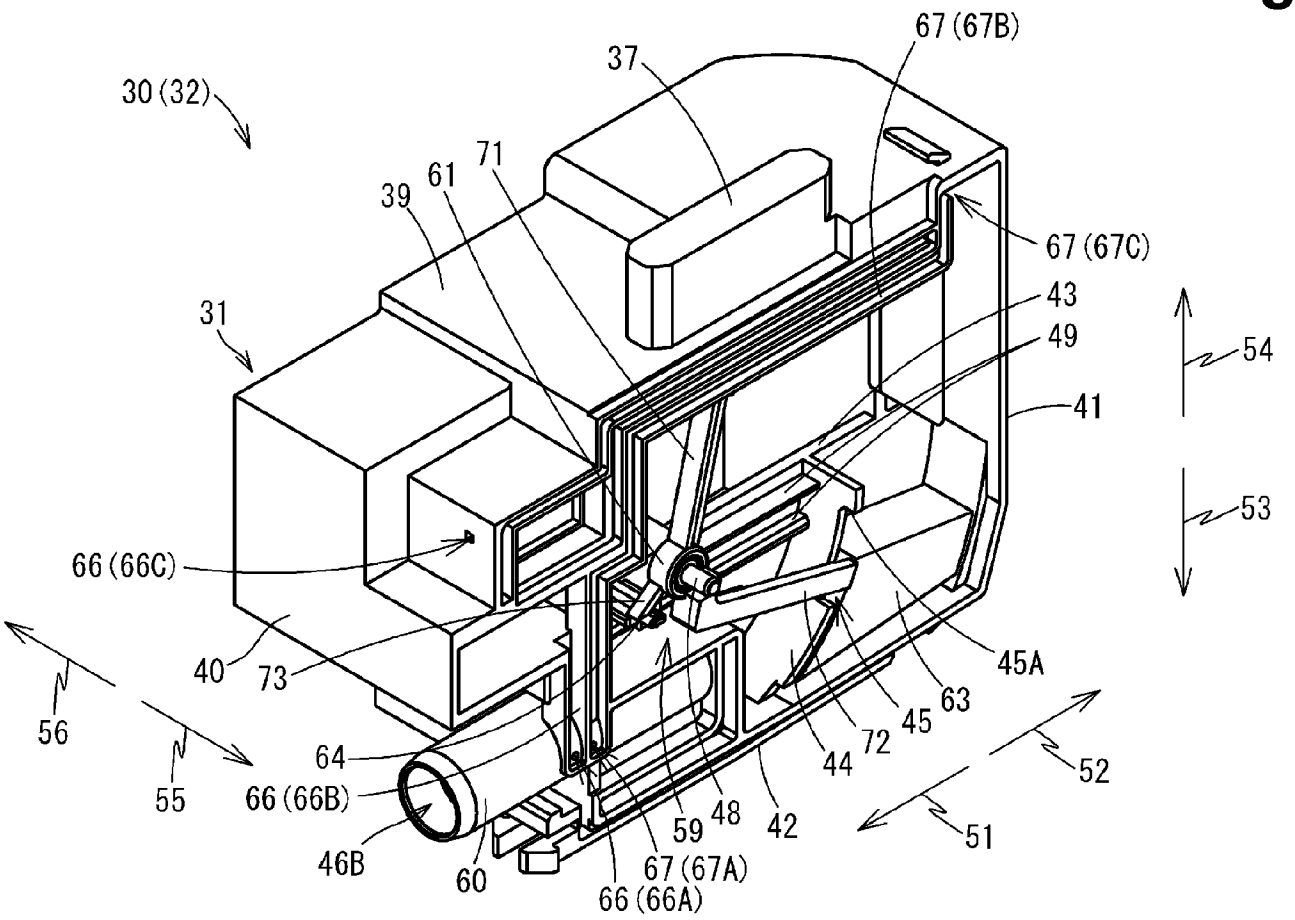
FIG. 3A is a perspective view of an ink tank in the illustrative embodiment according to one or more aspects of the disclosure.
Figure 3B:
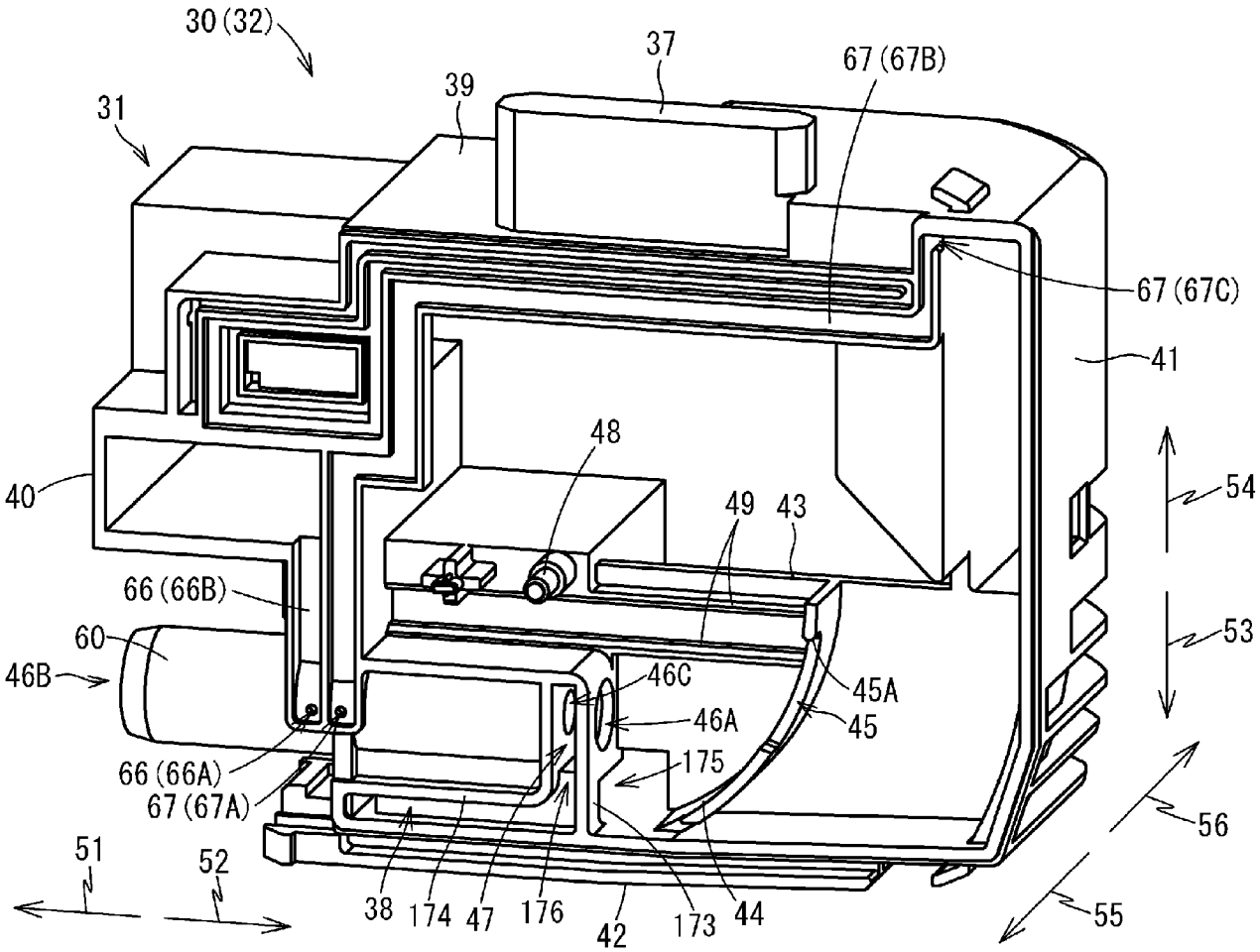
FIG. 3B is a perspective view of the ink tank in the illustrative embodiment according to one or more aspects of the disclosure, wherein a detector is removed.

As depicted in FIGS. 3A and 3B, the frame 31 may have a substantially rectangular parallelepiped external shape. The frame 31 may be relatively narrow in the right-left direction 5556, that is, the frame 31 has a greater dimension both in an up-down direction 5453 and in an insertion-removal direction 51 than a dimension in the right-left direction 5556. The frame 31 includes a front wall 40 (as an example of a first wall), a rear wall 41 (as an example of a second wall), an upper wall 39, a lower wall 42, a first inner wall 43, a second inner wall 44, a third inner wall 173, and a fourth inner wall 174. The front wall 40 and the rear wall 41 at least partially overlap each other when viewed in the insertion direction 51 or in the removal direction 52. The upper wall 39 and the lower wall 42 at least partially overlap each other when viewed in the downward direction 53 or in the upward direction 54. The first inner wall 43 stands at a substantially middle portion of the lower wall 42 in the right-left direction 5556, extending toward the upper wall 39. The second inner wall 44 protrudes from the first inner wall 43 in the rightward direction 55. The third inner wall 173 is connected with the lower wall 42 at its lower end and the ink outlet 60 at its upper end. The fourth inner wall 174 is connected with the front wall 40 at one end and the ink outlet 60 at the other end. The wall facing forward (e.g., the direction toward which the ink cartridge 30 is inserted) at the time of inserting the ink cartridge 30 into the cartridge holder 110 may function as the front wall 40 and the wall facing backward (e.g., the direction toward which the ink cartridge 30 is removed) at the time of inserting the ink cartridge 30 into the cartridge holder 110 may function as the rear wall 41.

The upper wall 39 connects between an upper end of the front wall 40 and an upper end of the rear wall 41. The lower wall 42 connects between a lower end of the front wall 40 and a lower end of the rear wall 41. The raised portion 37 protrudes in the upward direction 54 from the upper wall 39. At least the upper wall 39 including the raised portion 37 allows light emitted from the light emitting portion of the sensor 103 to pass therethrough.

The frame 31 has open ends in the right-left direction 5556. The right and left open ends of the frame 31 are sealed by respective films (not depicted). The film for sealing the right open end of the frame 31 has a shape that corresponds to an outline of the frame 31 when viewed in the rightward direction 55. The film for sealing the left open end of the frame 31 has a shape that corresponds to an outline of the frame 31 when viewed in the leftward direction 56. The films constitute right and left walls, respectively, of the first ink chamber 36. The films are adhered to right and left ends, respectively, of the upper wall 39, the front wall 40, the rear wall 41, and the lower wall 42 by heat to close the right and left open ends of the first ink chamber 36 tightly. Therefore, the first ink chamber 36 is defined by the upper wall 39, the front wall 40, the rear wall 41, the lower wall 42, and the films and thus is capable of storing ink therein.

The ink tank 32 further includes a projection 48 inside the frame 31. The projection 48 extends from the first inner wall 43 in the rightward direction 55. A detector 59 is disposed inside the first ink chamber 36. The projection 48 supports the detector 59.

[First Ink Chamber 36]

As depicted in FIGS. 3A and 3B, the first ink chamber 36 is defined between the front wall 40 and the rear wall 41. The first ink chamber 36 stores ink therein. Until the ink cartridge 30 is placed in the cartridge holder 110, the first ink chamber 36 of the ink cartridge 30 is maintained at a negative pressure. The first ink chamber 36 becomes exposed to the outside air through a first air communication passage 66 and a second air communication passage 67 by placement of the ink cartridge 30 in the cartridge holder 110. Ink stored in the first ink chamber 36 is allowed to flow to the outside of the ink cartridge 30 through the ink outlet 60 also by placement of the ink cartridge 30 in the cartridge holder 110. The raised portion 37 has an interior space inside thereof and the interior space constitutes a portion of the first ink chamber 36.

[Second Ink Chamber 38]

As depicted in FIG. 3B, the ink tank 32 further includes an second ink chamber 38. The second ink chamber 38 extends under a portion of the ink outlet 60 in the removal direction 52 from a position adjacent to the ink outlet 60. The second ink chamber 38 may be a space for storing ink. The second ink chamber 38 and the first ink chamber 36 may be spaces for storing ink.

The second ink chamber 38 is disposed between the third inner wall 173 and the fourth inner wall 174. The second ink chamber 38 is defined by the third inner wall 173, the fourth inner wall 174, the lower wall 42, the first inner wall 43, and the film which is thermally adhered to the frame 31. The first inner wall 43 defines a right end of the second ink chamber 38 and the film defines a right end of the second ink chamber 38.

The third inner wall 173 extends both in the up-down direction 5453 and in the right-left direction 5556. The third inner wall 173 includes an upper end that is contiguous to a wall constituting one end (e.g., a concealed end or an end that faces the direction toward which the ink cartridge 30 is removed) of the ink outlet 60 in the insertion-removal direction 5152. The third inner wall 173 includes a lower end that is contiguous to the lower wall 42. The third inner wall 173 has a through hole 175. The through hole 175 provides communication between the first ink chamber 36 and the second ink chamber 38.

The fourth inner wall 174 is disposed closer to the front wall 40 than the third inner wall 173. The fourth inner wall 174 is spaced from the third inner wall 173 in the insertion direction 51. The fourth inner wall 174 includes one end that is contiguous to the ink outlet 60 at a position closer to the front wall 40 than the concealed end of the ink outlet 60. The fourth inner wall 174 extends downward from a joint at which the fourth inner wall 174 joins to the ink outlet 60, then is curved at a lower end, and further extends toward the front wall 40. The other end of the fourth inner wall 174 is contiguous to the front wall 40.

The second ink chamber 38 has a through hole 176 (as an example of a first communication hole) at its upper end. The through hole 176 opens upward and is defined by the third inner wall 173, the fourth inner wall 174, the first inner wall 43, and the film. The through hole 176 provides communication between the second ink chamber 38 and a valve chamber 47 (as an example of an inner space).

[Ink Outlet 60]

Figure 4A:
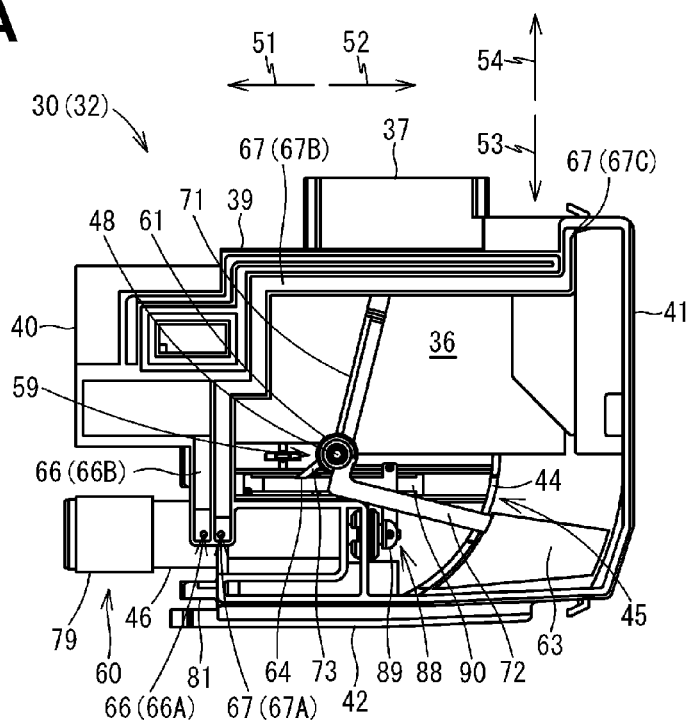
FIG. 4A is a right side view depicting the ink tank in the illustrative embodiment according to one or more aspects of the disclosure, wherein a restriction member is located at a restrict position and the detector is located at a restricted position
Figure 4B:
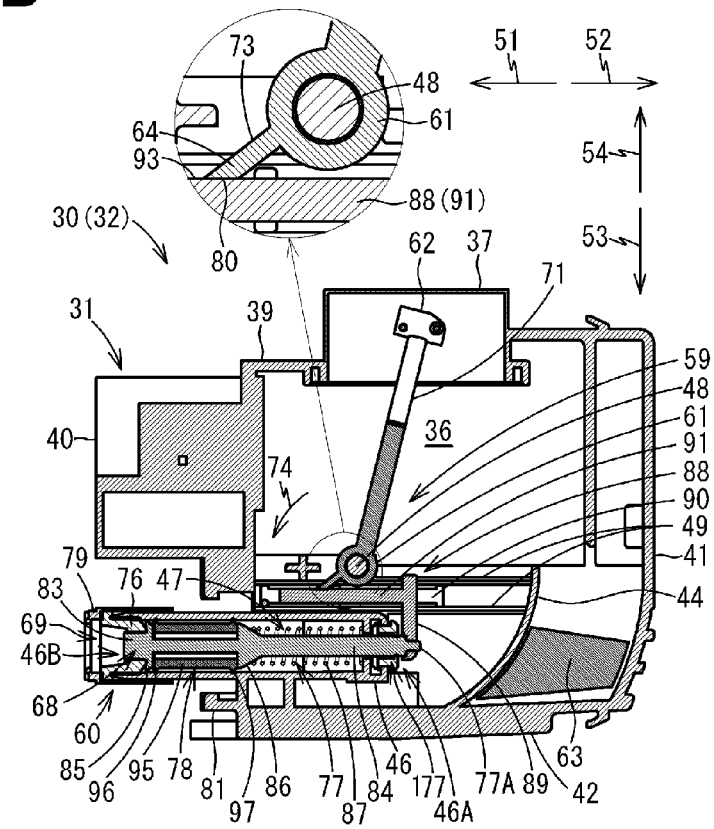
FIG. 4B is a vertical cross-sectional view depicting the ink tank in the illustrative embodiment according to one or more aspects of the disclosure, wherein the restriction member is located at the restrict position and the detector is located at the restricted position.
Figure 4C:
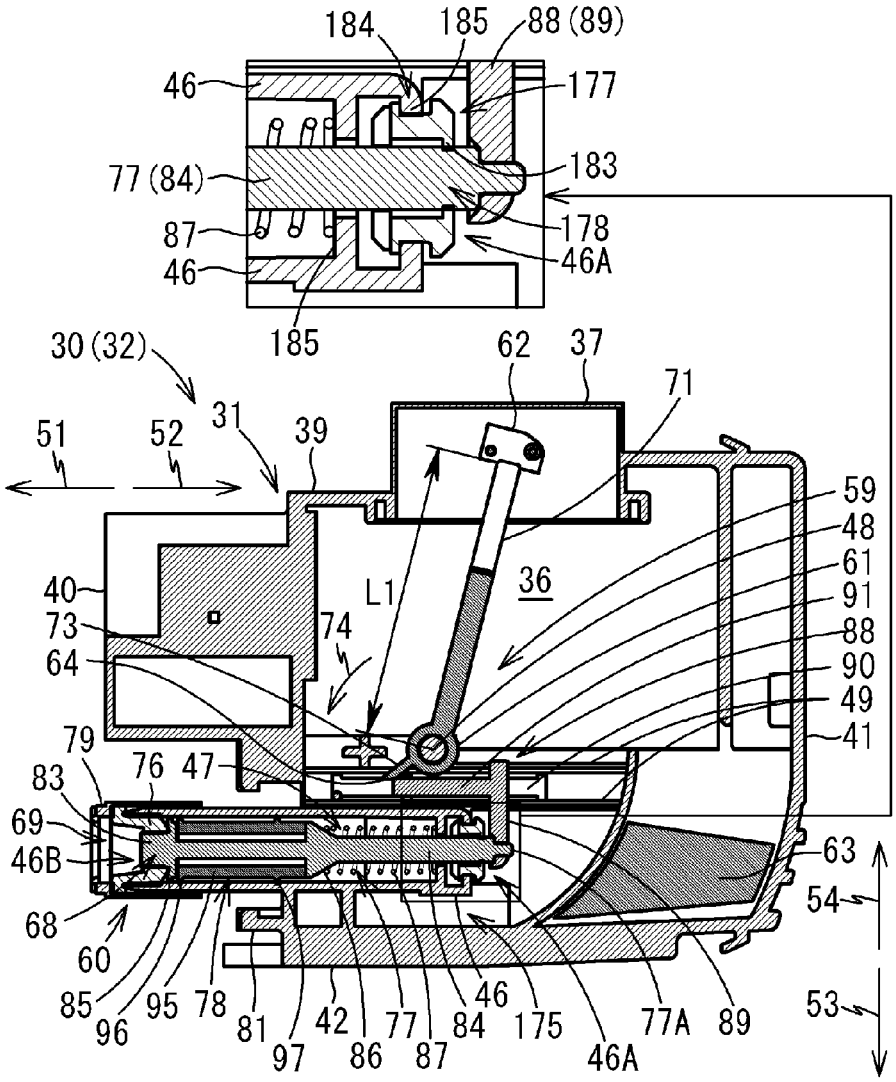
FIG. 4C is a vertical cross-sectional view depicting the ink tank in the illustrative embodiment according to one or more aspects of the disclosure, wherein the restriction member is located at the restrict position and the detector is located at the restricted position.

As depicted in FIGS. 4A, 4B, and 4C, the ink outlet 60 is disposed at a lower end portion of the front wall 40. The ink outlet 60 includes a cylindrical wall 46, a first sealer 177 (as an example of sealer), a second sealer 76, a cap 79. The cylindrical wall 46 may have a tubular shape having a portion of the valve chamber 47 therein. The second sealer 76 and the cap 79 are attached on the cylindrical wall 46.

The cylindrical wall 46 extends between the inside of the first ink chamber 36 and the outside of the first ink chamber 36. The cylindrical wall 46 has an opening 46A and an opening 46B at opposite ends in an insertion-removal direction 5152. More specifically, the cylindrical wall 46 has the opening 46A at one end that faces the direction toward which the ink cartridge 30 is removed (e.g., at one end that is located inside the first ink chamber 36 (e.g., a concealed end)). The cylindrical wall 46 has the opening 46B at the other end that faces the direction the ink cartridge 30 is inserted (e.g., at the other end that is located outside the first ink chamber 36 (e.g., an exposed end)). With this configuration, the first ink chamber 36 is in communication with the outside of the ink cartridge 30 through the valve chamber 47. Thus, the ink outlet 60 allows ink stored in the first ink chamber 36 to flow to the outside of the ink cartridge 30. The exposed end, e.g., a distal end, of the cylindrical wall 46 is attached with the second sealer 76 and the cap 79.

The fourth inner wall 147 has a through hole 46C. The through hole 46C is closer to the front wall 40 than the opening 46A. The valve chamber 47 is divided into two sections by the fourth inner wall 174. The through hole 46C provides communication between the sections of the valve chamber 47.

The cylindrical wall 46 has the opening 46A at the concealed end. A lower edge of the opening 46A is located at a higher position than the through hole 176 in the up-down direction 5453. The opening 46A provides communication between the first ink chamber 36 and the valve chamber 47. The first sealer 177 is fitted in the opening 46A. The opening 46A is sealed by the first sealer 177.

As depicted in FIGS. 3, 4A, 4B, and 4C, the valve chamber 47 is connected with the first air communication passage 66 and the second air communication passage 67. The first air communication passage 66 allows air to flow therethrough between the valve chamber 47 and the outside of the ink cartridge 30. That is, the first air communication passage 66 allows the valve chamber 47 to be exposed to the outside air. The first air communication passage 66 has a hole 66A, a groove 66B, and a hole 66C. The hole 66A provides communication between the inside and the outside of the cylindrical wall 46. The groove 66B has one end that is in communication with the hole 66A. The hole 66C provides communication between the other end of the groove 66B and the outside of the ink cartridge 30.

The second air communication passage 67 allows air to flow therethrough between the valve chamber 47 and the first ink chamber 36. The second air communication passage 67 has a hole 67A, a groove 67B, and a hole 67C. The hole 67A provides communication between the inside and the outside of the cylindrical wall 46. The groove 67B has one end that is communication with the hole 67A. The hole 67C provides communication between the other end of the groove 67B and the first ink chamber 36. The hole 67A is spaced from the hole 66A in the removal direction 52. The hole 67C is defined at a particular position that is higher than a level of ink stored in an ink chamber 36 of a not-yet-used ink cartridge 30. For example, the hole 67C is defined at a position that is higher than a level of the maximum amount of ink that the first ink chamber 36 is capable of storing. The first air communication passage 66 and the second air communication passage 67 are liquid tightly sealed by the film constituting the right wall of the ink cartridge 30.

As depicted in FIGS. 4A, 4B, and 4C, the second sealer 76 has a substantially circular cylindrical shape. The second sealer 76 has an outside diameter that is substantially the same as an outside diameter of the cylindrical wall 46. The second sealer 76 is liquid tightly attached on the exposed end of the cylindrical wall 46. The second sealer 76 has a through hole 68 at a substantially middle portion thereof. The through hole 68 penetrates the second sealer 76 in the insertion direction 51. The through hole 68 provides communication between the inside and the outside of the valve chamber 47. The through hole 68 has a diameter that is slightly smaller than an outside diameter of the ink needle 102. The second sealer 76 may be made of elastic material, for example, rubber.

The cap 79 is fitted over the exposed end of the cylindrical wall 46. The cap 79 and the cylindrical wall 46 sandwiches the second sealer 76 therebetween. The cap 79 has a through hole 69 at a substantially middle portion thereof. The through hole 69 penetrates the cap 79 in a thickness direction of the cap 79. The through hole 69 has a diameter that is greater than a diameter of the through hole 68. The cap 79 includes an engagement portion (not depicted) protruding in the removal direction 52. The engagement portion of the cap 79 is in engagement with an engagement portion 81 of the front wall 40. The cap 79 retains the second sealer 76 at the exposed end of the cylindrical wall 46.

[First Sealer 177]

As depicted in FIGS. 4A and 4B, the first sealer 177 is fitted in the opening 46A. The first sealer 177 may be made of elastically deformable material, for example, rubber or elastomer.

Figure 24A:
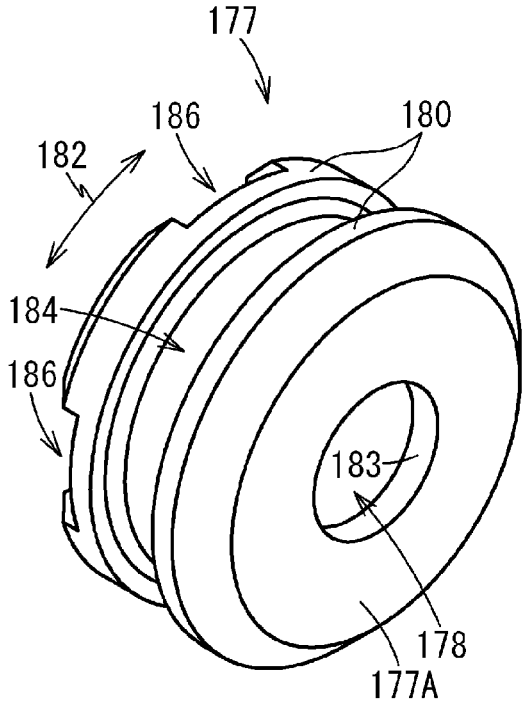
FIG. 24A is a perspective view depicting a first sealer in the illustrative embodiment according to one or more aspects of the disclosure.
Figure 24B:
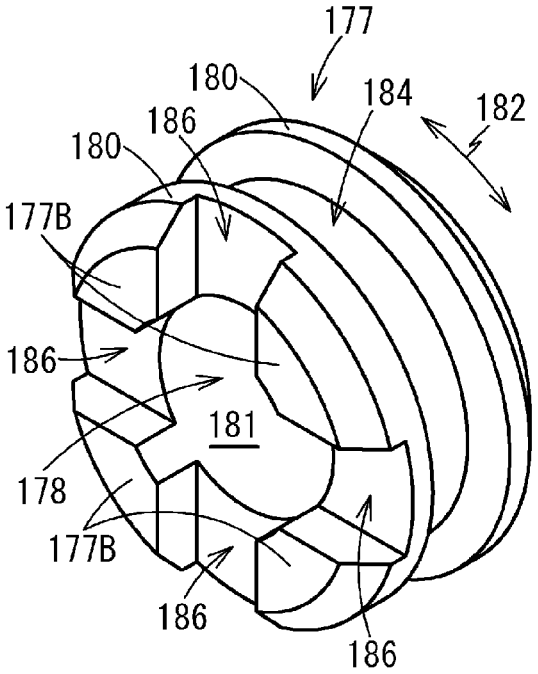
FIG. 24B is a perspective view depicting the first sealer in the illustrative embodiment according to one or more aspects of the disclosure.
Figure 24C:
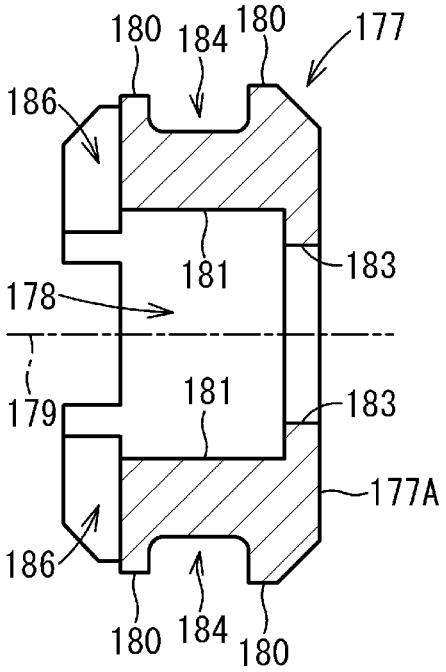
FIG. 24C is a vertical cross-sectional view depicting the first sealer in the illustrative embodiment according to one or more aspects of the disclosure.

As depicted in FIGS. 24A, 24B, and 24C, the first sealer 177 has a substantially circular cylindrical shape. The first sealer 177 has a through hole 178 that extends along a direction that an axis 179 of the first sealer 177. The rod 84 of the valve 77 is disposed in the through hole 178 while passing therethrough. The through hole 178 is defined by an inner circumferential surface 181. The first sealer 177 further includes a projection 183 that protrudes from the inner circumferential surface 181 toward the axis 179 and extends along a circumferential direction 182 of the first sealer 177. The projection 183 is located at one end of the first sealer 177 (e.g., an end that faces the direction toward which the ink cartridge 30 is removed) in a state where the first sealer 177 is fitted in the opening 46A.

The through hole 178 has a small inside diameter portion that is defined by the projection 183. The small inside diameter portion has a diameter that is slightly smaller than an outside diameter of the rod 84. With this configuration, the rod 84 passing through the through hole 178 is in pressure contact with the projection 183. Therefore, the through hole 178 is liquid tightly sealed by the rod 84 at the small inside diameter portion of the of the first sealer 177. The through hole 178 also has a large inside diameter portion that is defined by a portion of the inner circumferential surface 181 where the projection 183 is not provided. The large inside diameter portion has a diameter that is greater than the outside diameter of the rod 84.

The first sealer 177 has a groove 184 in its outer circumferential surface 180. The groove 184 extends along the circumferential direction 182. The cylindrical wall 46 includes a projection 185 at the concealed end thereof. The projection 185 (refer to FIG. 4C) of the cylindrical wall 46 is engaged with the groove 184 of the first sealer 177. The projection 185 extends along an inner circumferential surface of the cylindrical wall 46. A projecting end (e.g., a distal end) of the projection 185 defines the opening 46A of the cylindrical wall 46. The first sealer 177 is fitted in the opening 46A by engagement of the projection 185 with the groove 184. The opening 46A has a diameter that is slightly smaller than an outside diameter of a portion of the first sealer 177 where the groove 184 is provided. With this configuration, in a state where the first sealer 177 is fitted in the opening 46A, a gap between the first sealer 177 and the opening 46A is liquid tightly closed.

As described above, the through hole 178 is liquid tightly closed and the gap between the first sealer 177 and the opening 46A is also liquid tightly closed, whereby a gap between the ink tank 32 and the valve 77 is liquid tightly closed. In other words, the first sealer 177 seals the gap between the ink tank 32 and the valve 77.

As depicted in FIG. 4C, in a state where the first sealer 177 is fitted in the opening 46A, the groove 184 is located further from the rear wall 41 than the projection 183 in the insertion direction 51. With this configuration, the projection 183 of the first sealer 177 and the valve 77 are in contact with each other at a different position in the insertion-removal direction 5152 from a position where the projection 185 of the ink tank 32 and the first sealer 177 are in contact with each other.

As depicted in FIGS. 24A, 24B, and 24C, the first sealer 177 includes a first surface 177A and a second surface 177B. In the state where the first sealer 177 is fitted in the opening 46A, the first surface 177A of the first sealer 177 faces the first ink chamber 36 and the second surface 177B of the first sealer 177 faces the valve chamber 47. The cylindrical wall 46 constituting the valve chamber 47 has the through hole 46C (refer to FIG. 3B). In other words, the through hole 46C and the first ink chamber 36 are disposed on opposite sides of the first sealer 177 in the insertion-removal direction 5152.

As depicted in FIGS. 24A, 24B, and 24C, the second surface 177B (e.g., a surface that faces a direction opposite to the first ink chamber 36 in the insertion-removal direction 5152) has a plurality of grooves 186. Each of the grooves 186 extends in a diameter direction of the first sealer 177. Each of the grooves 186 has one end that is contiguous to the through hole 178 and the other end that is contiguous to a periphery of the second surface 177B. In the illustrative embodiment, for example, four grooves 186 are provided. Nevertheless, the number of grooves 186 is not limited to the specific example.

[Valve 77, Sealing Member 78, and Coil Spring 87]

As depicted in FIGS. 4A, 4B, 4C, and 8B, the cylindrical wall 46 of the ink outlet 60 accommodates therein a valve 77 (as an example of a movable member), a sealing member 78, and a coil spring 87 (as an example of an urging member). The valve 77, the sealing member 78, and the coil spring 87 are configured to switch a state of the ink outlet 60 selectively between a state where the ink outlet 60 allows ink to flow therethrough to the outside of the ink cartridge 30 from the first ink chamber 36 and a state where the ink outlet 60 prevents ink from flowing therethrough to the outside of the ink cartridge 30 from the first ink chamber 36. The valve 77, the sealing member 78, and the coil spring 87 are further configured to switch the state of the ink outlet 60 selectively between a state where the ink outlet 60 allows air communication therethrough between the first ink chamber 36 and the outside of the ink cartridge 30 and a state where the ink outlet 60 prevents air communication therethrough between the first ink chamber 36 and the outside of the ink cartridge 30.

The valve 77 may constitute a portion of a movable member that includes the valve 77 and a restriction member 88. The valve 77 includes a circular plug 83, a rod 84, a plurality of first protrusions 85, and a plurality of second protrusions 86. The rod 84 extends from the plug 83 in the removal direction 52. The first protrusions 85 and the second protrusions 86 protrude from the rod 84 in respective directions with respect to a diameter direction of the rod 84. The valve 77 is disposed within the valve chamber 47 while the plug 83 is oriented toward the exposed end of the cylindrical wall 46. The rod 84 penetrates the through hole 46C of the cylindrical wall 46. The rod 84 has an outside diameter that is smaller than a diameter of the through hole 46C. The rod 84 also penetrates the through hole 178 of the first sealer 177 that is fitted in the opening 46A of the cylindrical wall 46. The outside diameter of the rod 84 is smaller than a diameter of the opening 46A of the cylindrical wall 46. As described above, the outside diameter of the rod 84 is slightly greater than the diameter of the through hole 178. A distal end of the rod 84 that is opposite to the end connected with the plug 83 protrudes to the first ink chamber 36 beyond the valve chamber 47. That is, the valve 77 extends between the ink outlet 60 and the first ink chamber 36. Nevertheless, in other embodiments, for example, the rod 84 might not necessarily protrude to the first ink chamber 36 beyond the valve chamber 47. In this case, the valve 77 may be disposed within the ink outlet 60.

The valve 77 has an outside diameter that is smaller than the inside diameter of the cylindrical wall 46. Thus, the valve 77 is capable of moving selectively in the insertion direction 51 and in the removal direction 52. For example, the valve 77 is capable of moving between a closed position (e.g., a position of the valve 77 depicted in FIG. 4B) and an open position (e.g., a position of the valve 77 depicted in FIG. 6B). The closed position is closer to the rear wall 41 than the first open position. In the illustrative embodiment, the valve 77 is configured to move in the horizontal direction (e.g., in the insertion-removal direction 5152). Nevertheless, the moving direction of the valve 77 is not limited to the horizontal direction. In the illustrative embodiment, the closed position and the open position of the valve 77 may also be referred to as a forward position (as an example of a fourth position) and a rearward position (as an example of a third position), respectively.

The plug 83 has an outside diameter that is slightly larger than the diameter of the through hole 68 of the second sealer 76. With this configuration, as depicted in FIG. 4B, when the valve 77 is located at the closed position, the plug 83 is tightly fitted in the through hole 68 of the second sealer 76, thereby liquid tightly sealing the through hole 68. Thus, the opening 46B of the cylindrical wall 46 is closed. As depicted in FIG. 6B, when the valve 77 is located at the open position, the plug 83 is located separate from the second sealer 76. Therefore, the opening 46B of the cylindrical wall 46 is opened.

When a force that is greater than a force of the rod 84 pressing the first sealer 177 is applied to the valve 77 in one of the insertion direction 51 and the removal direction 52, the valve 77 is movable along the same direction with respect to the insertion-removal direction 5152 relative to the first sealer 177. The valve 77 is configured to be located at the rearward position, at the forward position, and at any position between the rearward position and the forward position. For example, the valve 77 is movable between the rearward position and the forward position while penetrating the through hole 178 of the first sealer 177.

The first sealer 177 keeps the gap between the ink tank 32 and the valve 77 liquid tightly sealed while the valve 77 is located at each of the rearward position and the forward position and while the valve 77 moves between the rearward position and the forward position. For example, the first sealer 177 seals the gap between the ink tank 32 and the valve 77 at the through hole 178 while the valve 77 is located at each of the rearward position and the forward position, and at any position between the rearward position and the forward position.

The rod 84 has an outside diameter that is smaller than the outside diameter of the plug 83.

The plurality of first protrusions 85 includes four first protrusions 85 that are spaced apart from each other in a circumferential direction of the rod 84. The plurality of second protrusions 86 includes four second protrusions 86 that are spaced apart from each other in the circumferential direction of the rod 84. The plurality of first protrusions 85 is spaced from the plurality of second protrusions 86 in the insertion direction 51 and is disposed adjacent to the plug 83 in the removal direction 52.

The sealing member 78 may be made of an elastic material, for example, rubber. As depicted in FIGS. 4A, 4B, 4C, and 8B, the sealing member 78 includes a circular cylindrical portion 95, a first sealing portion 96, and a second sealing portion 97. The first sealing portion 96 and the second sealing portion 97 may be flanged portions that protrude from respective portions of an outer surface of the cylindrical portion 95 in a diameter direction of the cylindrical portion 95.

The cylindrical portion 95 is disposed between the plurality of first protrusions 85 and the plurality of second protrusions 86 while having the rod 84 of the valve 77 inserted therethrough. The cylindrical portion 95 has an inside diameter that is larger than the outside diameter of the rod 84. Therefore, in a state where the rod 84 penetrates the cylindrical portion 95, clearance is left between the cylindrical portion 95 and the rod 84. An empty space inside the cylindrical portion 95 is exposed through a gap between each adjacent two of the first protrusions 85 and a gap between each adjacent two of the second protrusions 86. With this configuration, the empty space inside the cylindrical portion 95 provides communication therethrough between a space of the valve chamber 47 leading to the opening 46A and another space of the valve chamber 47 leading to the opening 46B.

The cylindrical portion 95 includes one end that is in contact with the plurality of first protrusions 85 and the other end that is in contact with the plurality of second protrusions 86. With this configuration, the sealing member 78 is capable of moving together with the valve 77 within the valve chamber 47 selectively in the insertion direction 51 and in the removal direction 52.

The first sealing portion 96 is spaced from the second sealing portion 97 in the insertion direction 51.

The first sealing portion 96 and the second sealing portion 97 hermetically and closely contact the inner surface of the cylindrical wall 46. In a state where the sealing member 78 is not disposed in the valve chamber 47, an outside diameter of each of the first sealing portion 96 and the second sealing portion 97 is slightly larger than the inside diameter of the cylindrical wall 46. Therefore, in a state where the sealing member 78 is disposed in the valve chamber 47, the first sealing portion 96 and the second sealing portion 97 are in hermetical contact with the inner surface of the cylindrical wall 46 while being elastically deformed in a direction such that the first sealing portion 96 and the second sealing portion 97 decrease their outside diameter. As the valve 77 moves in the insertion-removal direction 5152, the first sealing portion 96 and the second sealing portion 97 slide relative to the inner surface of the cylindrical wall 46.

The coil spring 87 is disposed between the opening 46A and the plurality of second protrusions 86. The coil spring 87 urges the valve 77 in the insertion direction 51. For example, the coil spring 87 urges the valve 77 toward the closed position from the open position. Thus, in the valve chamber 47, the valve 77 is retained while being in contact with the second sealer 76 (refer to FIG. 4B). In other embodiments, for example, another urging member, e.g., a leaf spring, may be used instead of the coil spring 87. Nevertheless, an urging member such as the coil spring 87 might not necessarily be provided.

[Detector 59]

As depicted in FIGS. 3, 4A, 4B, and 4C, the detector 59 (as an example of a rotation member) is disposed inside the first ink chamber 36. The detector 59 is disposed between the front wall 40 and the rear wall 41 in the insertion-removal direction 5152. That is, the rear wall 41 is disposed across the detector 59 from the front wall 40 in the insertion-removal direction 5152. The detector 59 is rotatably supported by the frame 31. The detector 59 includes an axial portion 61 that has an axis on which the detector 59 rotates. The axial portion 61 has a circular cylindrical shape. In other embodiments, for example, the axial portion 61 may have a different shape. The axial portion 61 of the detector 59 is engaged with the projection 48 of the frame 31 by insertion. Therefore, the detector 59 is supported by the frame 31 so as to be rotatable on an axis. The axis may be a virtual line extending in the right-left direction 5556. The axis passes through the center of the projection 46 when viewed from one of the right and left. The axis is located higher than the ink outlet 60.

As depicted in FIGS. 3, 4A, 4B, 4C, and 8A, the ink cartridge 30 includes the detector 59 and a float 63. In the illustrative embodiment, the float 63 constitutes a portion of the detector 59. The detector 59 includes the axial portion 61, a first arm 71, a second arm 72, a third arm 73, a detection portion 62, the float 63, and a restriction portion 64.

The axial portion 61 is spaced from the second inner wall 44 in the insertion direction 51. The first arm 71 extends from the axial portion 61 in one direction with respect to the diameter direction of the axial portion 61. The second arm 72 extends from the axial portion 61 in another direction with respect to the diameter direction of the axial portion 61 so as to extend in a different direction from the direction that the first arm 71 extends. The second arm 72 extends in the removal direction 52 from the axial portion 61 beyond the second inner wall 44 through a recess 45 of the second inner wall 22. The recess 45 is recessed in the leftward direction 56 relative to a right end of the second inner wall 44. The third arm 73 extends from the axial portion 61 in other direction with respect to the diameter direction of the axial portion 61 so as to extend in a different direction from the directions that the first arm 71 and the second arm 72 extend respectively. The third arm 73 is shorter in length than the second arm 72.

The detection portion 62 is disposed at a distal end of the first arm 71 and is supported by the first arm 71. The detection portion 62 has a plate-like shape. The detection portion 62 may be made of material that blocks light outputted from the light emitting portion. The detection portion 62 is supported by the first arm 71 while being spaced from the axis of the detector 59 by a distance L1

(refer to FIG. 4C). In other embodiments, for example, the detection portion 62 may be disposed at another portion of the first arm 71. In one example, the detection portion 62 may be disposed at a middle portion of the first arm 71 between the distal end and a proximal end of the first arm 71.

More specifically, when light outputted from the light emitting portion reaches one of a right surface and a left surface of the detection portion 62, the intensity of light that comes from the other of the right surface and the left surface of the detection portion 62 and reaches the light receiving portion may be less than a predetermined intensity, e.g., zero. For example, the detection portion 62 may completely block light from traveling in the rightward direction 55 or in the leftward direction 56 therefrom, may absorb light partially, may deflect light to change the optical path of light, or may reflect the light completely. In one example, the detection portion 62 may be made of resin containing pigment. In another example, the detection portion 62 may be transparent or translucent and have a prism-like shape for changing the optical path of light. In other example, the detection portion 62 may have a reflecting film, e.g., an aluminum film, on its surface.

The float 63 is disposed at a distal end of the second arm 72 and is supported by the second arm 72. The float 63 is disposed between the axis of the detector 59 and the rear wall 41 in the insertion-rearward direction 5152. That is, the float 63 is spaced from the axis of the detector 59 and is closer to the rear wall 41 than the axis of the detector 59. The float 63 may be made of material having a lower specific gravity than ink stored in the first ink chamber 36. In other embodiments, for example, the float 63 may be disposed at another portion of the second arm 72. In one example, the float 63 may be disposed at a middle portion of the second arm 72 between the distal end and a proximal end of the second arm 72.

The restriction portion 64 is disposed at a distal end of the third arm 73. The restriction portion 64 constitutes a portion of the third arm 73 and includes the distal end of the third arm 73. For example, the restriction portion 64 extends from the axial portion 61 of the detector 59. The restriction portion 64 has a flat surface 80 (as an example of first surface) at the distal end of the third arm 73. The flat surface 80 extends both in the insertion-removal direction 5152 and in the right-left direction 5556 when the detector 59 is located at the restricted position. The restriction portion 64 is configured to contact and separate from a restriction member 88. In other embodiments, for example, the restriction portion 64 and the third arm 73 may be separate components. In this case, the restriction portion 64 may be supported by the third arm 73.

The detector 59 is disposed inside the first ink chamber 36 while the first arm 71 extends substantially in the upward direction 54, the second arm 72 extends substantially in the removal direction 52, and the third arm 73 extends substantially in the insertion direction 51.

The detector 59 is movable (e.g., rotatable) between a released position (e.g., a position of the detector 59 depicted in FIGS. 7A and 7B) and a restricted position (e.g., a position of the detector 59 depicted in FIGS. 4A, 4B, and 4C).

The restricted position is a different position from the released position. In a state where the ink cartridge 30 is completely placed in the cartridge holder 110 (e.g., in a state where the ink cartridge 30 is in the use position), when the detector 59 is located at the released position, the detection portion 62 is located between the light emitting portion and the light receiving portion of the sensor 103 (refer to FIG. 1). Therefore, light outputted from the light emitting portion is blocked by the detection portion 62, thereby not reaching the light receiving portion. Thus, when the detector 59 is located at the released position, the detection portion 62 is detected by the sensor 103 from the outside of the ink cartridge 30.

In the state where the ink cartridge 30 is in the use position, when the detector 59 is located at the released position, the restriction portion 64 is located lower than the axis of the detector 59.

In the state where the ink cartridge 30 is completely placed in the cartridge holder 110 (e.g., in the state where the ink cartridge 30 is in the use position), when the detector 59 is located at a position other than the released position, the detection portion 62 is not located between the light emitting portion and the light receiving portion of the sensor 103. Therefore, light outputted from the light emitting portion reaches the light receiving portion. Accordingly, the sensor 103 might not be able to detect the detection portion 62 from the outside of the ink cartridge 30 when the detector 59 is located at the restricted position.

In the state where the ink cartridge 30 is in the use position, when the detector 59 is located at the released position, the restriction portion 64 is located lower than when the detector 59 is located at any position other than the released position.

As depicted in FIGS. 4A, 4B, and 4C, in the state where the ink cartridge 30 is located at the use position, when the detector 59 is located at the restricted position, the float 63 is not in contact with the rear wall 41, the lower wall 42, nor the second inner wall 44. As depicted in FIGS. 3A and 3B, in the state where the ink cartridge 30 is in the use position, when the detector 59 is located at any position other than the restricted position, the float 63 is not in contact with the first inner wall 43. Accordingly, in the state where the ink cartridge 30 is in the use position, when the detector 59 is located at the restricted position, the float 63 is in not in contact with any portion of the ink tank 32.

[Restriction Member 88]

As depicted in FIGS. 4A, 4B, and 4C, the restriction member 88 is disposed inside the first ink chamber 36. The restriction member 88 may be a portion of the movable member that includes the valve 77 and the restriction member 88. The restriction member 88 is supported by the frame 31 so as to be straightly movable selectively in the insertion direction 51 and in the removal direction 52. As depicted in FIGS. 3A, 3B, 4A, 4B, and 4C, the frame 31 of the ink tank 32 includes guide members 49 at the first inner wall 43. The guide members 49 are spaced from the projection 48 of the first inner wall 43 in the removal direction 52. The guide members 49 are disposed in an area above a portion of the valve 77 disposed inside the first ink chamber 36 and below the projection 48. The guide members 49 are spaced apart from each other in the up-down direction 5453. The guide members 49 extend in the insertion-removal direction 5152. The restriction member 88 is disposed between the guide members 49 in the up-down direction 5453. Thus, the restriction member 88 is supported by the frame 31 so as to be straightly movable selectively in the insertion direction 51 and in the removal direction 52.

The restriction member 88 disposed between the guide members 49 is located above the valve 77 and below the projection 48. The projection 48 supports the detector 59. With this configuration, the restriction member 88 is located closer to the detector 59 than the valve 77.

As depicted in FIGS. 4A, 4B, 4C, and 8, the restriction member 88 includes a first portion 89 and a second portion 90 (as an example of an extending portion). The second portion 90 includes a projecting portion 91 (as an example of contact portion) at a middle portion thereof in the insertion-removal direction 5152. The projecting portion 91 protrudes in the rightward direction 55 therefrom. The projecting portion 91 of the second portion 90 protrudes in the rightward direction 55 relative to the guide members 49. The portion of the second portion 90 other than the projecting portion 91 is disposed between the guide members 49 in the up-down direction 5453 and does not protrude in the rightward direction 55 relative to the guide members 49.

The first portion 89 extends in the downward direction 53 from the projecting portion 91 of the second portion 90. The first portion 89 has a through hole 92 defined in its distal end portion. The through hole 92 penetrates the first portion 89 in the insertion-removal direction 5152. The valve 77 includes an engagement projection 77A at the other end that is opposite to the end including the plug 83. The engagement projection 77A of the valve 77 is disposed in the through hole 92 by insertion. The through hole 92 has a diameter that is slightly smaller than a diameter of the engagement projection 77A. Therefore, the engagement projection 77A and the through hole 92 are in engagement with each other, whereby the first portion 89 of the restriction member 88 is engagement with the valve 77. With this configuration, upon receipt of an urging force from the valve 77, the restriction member 88 moves selectively in the insertion direction 51 and in the removal direction 52 together with the valve 77.

The second portion 90 extends from a proximal end portion of the first portion 89 in the insertion direction 51. For example, the second portion 90 extends from the proximal end portion of the first portion 89 toward the axis of the detector 59.

The restriction member 88 is movable between a restrict position (e.g., a position of the restriction member 88 depicted in FIGS. 4A, 4B, and 4C) (as an example of a first position) and a release position (e.g., a position of the restriction member 88 depicted in FIGS. 6A and 6B) (as an example of a second position). The release position is closer to the rear wall 41 than the restrict position. When the valve 77 is located at the closed position, the restriction member 88 is located at the restrict position. When the valve 77 is located at the open position, the restriction member 88 is located at the release position. As the valve 77 moves from the closed position to the open position, the restriction member 88 moves from the restrict position to the release position. As the valve 77 moves from the open position to the closed position, the restriction member 88 moves from the release position to the restrict position.

When the restriction member 88 is located at the restrict position, an upwardly-facing surface 93 (as an example of a second flat surface) of the projecting portion 91 of the second portion 90 of the restriction member 88 is in contact with the restriction portion 64 from below of the restriction portion 64 and exerts an upward force to the restriction portion 64. Thus, the detector 59 is restricted from rotating in a direction of an arrow 74 (refer to FIG. 4B) due to application of the upward urging force by the restriction member 88. That is, the detector 59 is restricted from rotating toward the released position from the restricted position. In the illustrative embodiment, for example, the movement (e.g., rotation) of the detector 59 from the restricted position is restricted while the detector 59 is permitted to move only within backlash or play. The restriction member 88 might not necessarily restrict the movement (e.g., rotation) of the detector 59 in a direction opposite to the direction that the detector 59 moves toward the released position from the restricted position (e.g., in a clockwise direction of FIG. 4B).

The surface 93 of the projecting portion 91 extends both in the insertion-removal direction 5152 and in the right-left direction 5556. That is, the surface 93 extends in the direction parallel to the insertion-removal direction 5152 along which the restriction member 88 moves.

As depicted in FIGS. 4A and 4B, when the restriction member 88 is located at the restrict position, the surface 93 of the projecting portion 91 extends beyond the distal end of the restriction portion 64 in the insertion direction 51. Therefore, as depicted in FIG. 4C, even when the restriction member 88 is located at a position closer to the release position than the restrict position, the surface 93 of the projecting portion 91 is still in contact with the restriction portion 64. For example, when the restriction member 88 is located at an intermediate position (e.g., a position of the restriction member 88 depicted in FIGS. 5A and 5B) (as an example of a third position) which is between the restrict position and the release position, the surface 93 of the projecting portion 91 is in contact with the restriction portion 64. In a state where the restriction member 88 is located at any position between the restrict position and the intermediate position, the surface 93 of the projecting portion 91 keeps in contact with the restriction portion 64.

Figure 6A:
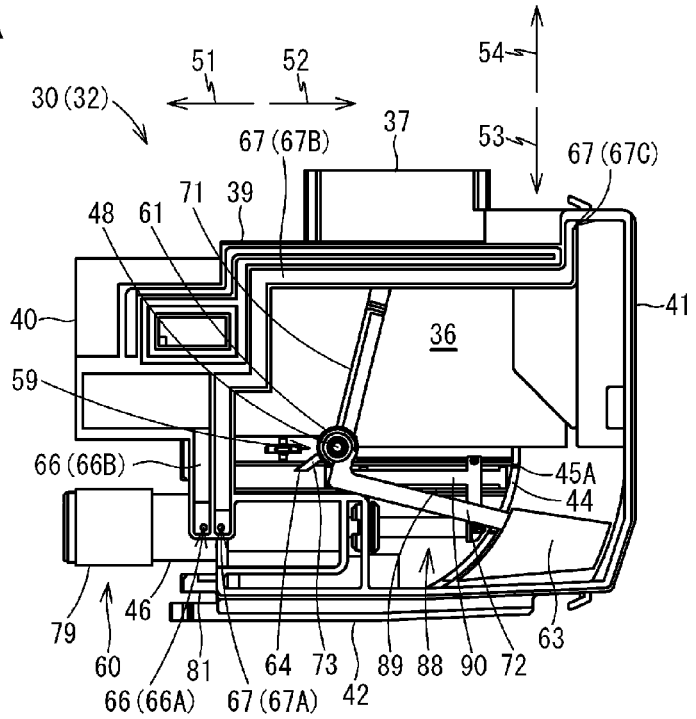
FIG. 6A is a right side view depicting the ink tank in the illustrative embodiment according to one or more aspects of the disclosure, wherein the restriction member is located at a release position and the detector is located at the restricted position.
Figure 6B:
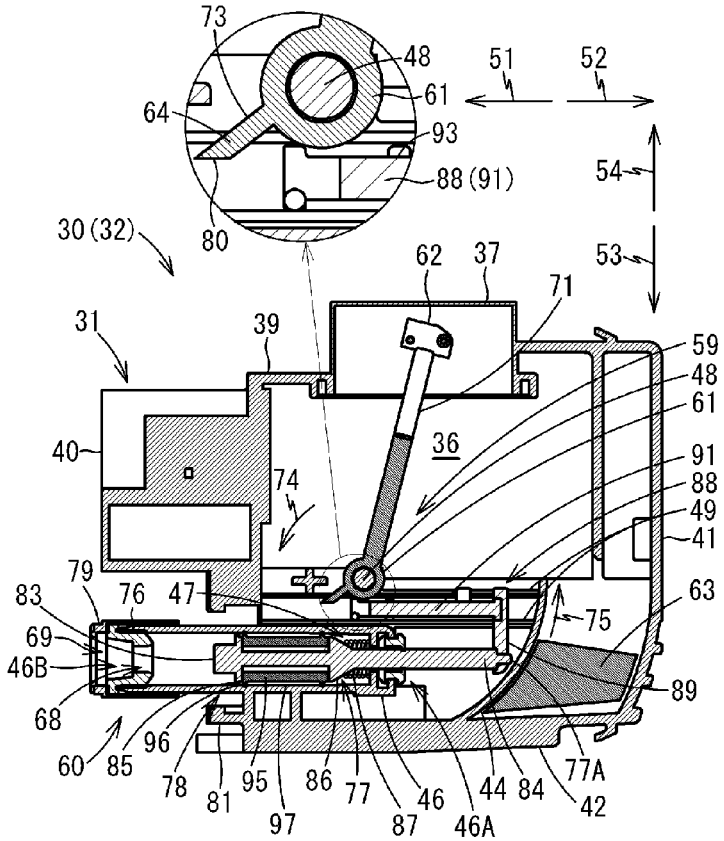
FIG. 6B is a vertical cross-sectional view depicting the ink tank in the illustrative embodiment according to one or more aspects of the disclosure, wherein the restriction member is located at the release position and the detector is located at the restricted position.

As depicted in FIGS. 6A and 6B, when the restriction member 88 is located at a position closer to the release position than the intermediate position, the surface 93 of the projecting portion 91 is separate from the restriction portion 64 of the detector 59 in the removal direction 52. Therefore, the detector 59 is permitted to rotate in the direction of the arrow 74. That is, the detector 59 is permitted to rotate from the restricted position to the released position. In other words, the surface 93 of the projecting portion 91 is separate from the restriction portion 64 when the restriction member 88 is located at any position between the intermediate position and the release position.

[Controller 130]

Figure 12:
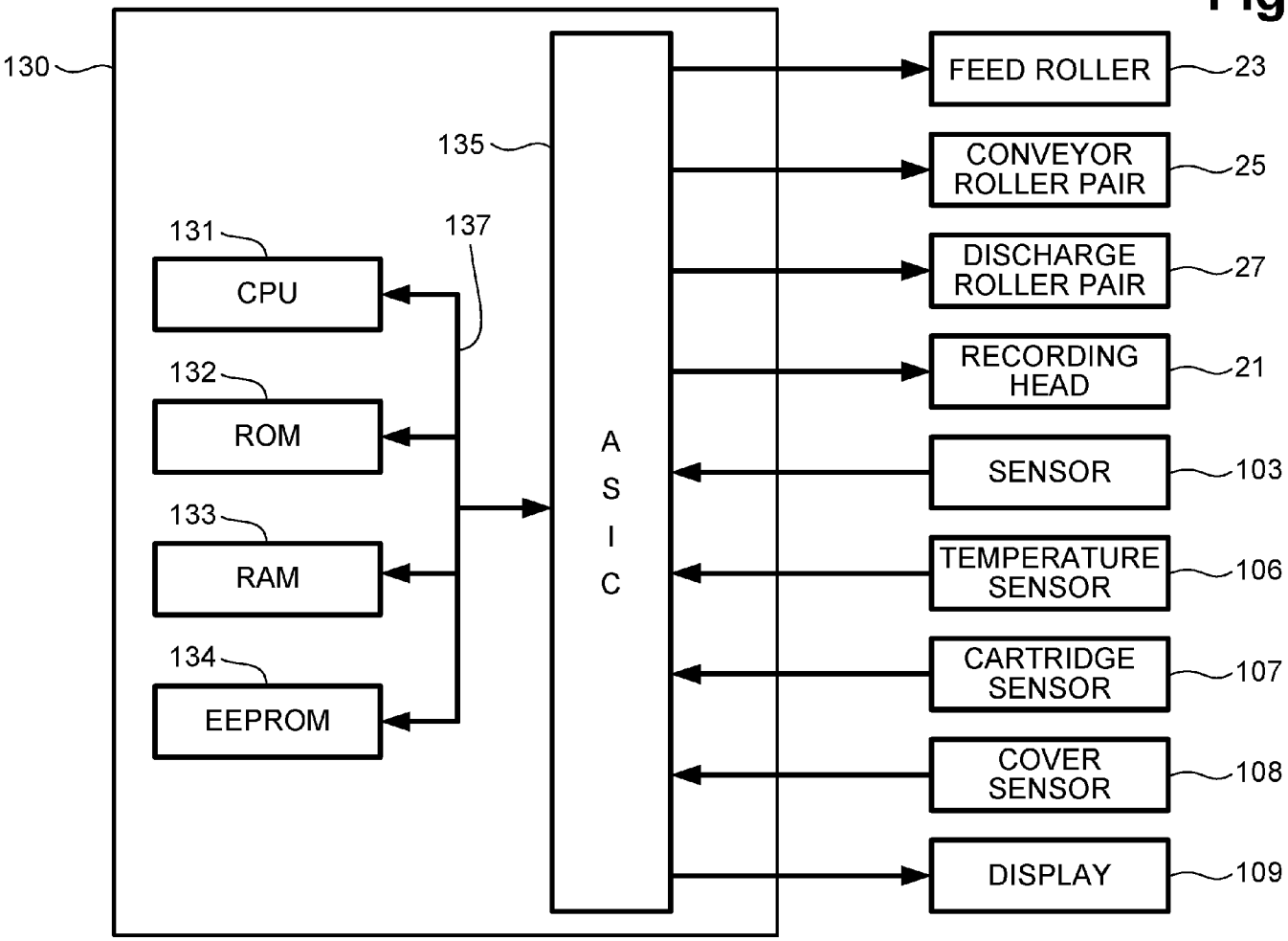
FIG. 12 is a functional block diagram of the printer in the illustrative embodiment according to one or more aspects of the disclosure.

The printer 10 includes a controller 130. As depicted in FIG. 12, the controller 130 includes a central processing unit ("CPU") 131, a read-only memory ("ROM") 132, a random-access memory ("RAM") 133, an electrically erasable programmable ROM ("EEPROM") 134, and an application-specific integrated circuit ("ASIC") 135, which are connected with each other via an internal bus 137. The ROM 132 stores various programs to be used by the CPU 131 for controlling various operations or processing. The RAM 133 is used as a storage area for temporarily storing data and/or signals to be used by the CPU 131 during execution of the programs by the CPU 131 or a workspace for processing data. The EEPROM 134 stores settings and flags that need to be maintained after the power of the printer 10 is turned off. The CPU 131, the ROM 132, the RAM 133, the EEPROM 134, and the ASIC 135 may be all included in a single chip or may be included in a plurality of chips separately.

The controller 130 drives a motor (not depicted) to rotate the feed roller 23, the conveyor roller pair 25, and the discharge roller pair 27. The controller 130 controls the recording head 21 to cause the nozzles 29 to eject ink therefrom. For example, the controller 130 outputs a control signal to the head control board 21A. The control signal indicates a level of a drive voltage to be applied to the piezoelectric elements 29A. The head control board 21A applies a drive voltage specified by the control signal obtained from the controller 130 to the piezoelectric elements 29A provided for the respective nozzles 29, thereby causing the nozzles 29 to eject ink therefrom. The controller 130 controls a display 109 to display information of the printer 10 and one or more ink cartridges 30, and various messages thereon.

The controller 130 receives various signals: a detection signal outputted from the sensor 103, a detection signal outputted from the cartridge sensor 107, a signal outputted from a temperature sensor 106, and a signal outputted from a cover sensor 108. The temperature sensor 106 is configured to output a signal in accordance with the temperature. A measuring point where the temperature sensor 106 measures the temperature is not limited to a particular point. For example, the temperature sensor 106 may measure the temperature at any point inside the cartridge holder 110 or at any point of the exterior of the printer 10. The cover sensor 108 is configured to output different signals according to whether the cover closes or exposes the opening 112 of the cartridge holder 110.

[Placement/Removal of Ink Cartridge 30 to/from Cartridge Holder 110]

Hereinafter, a description will be provided on how the valve 77, the restriction member 88, and the detector 59 behave in a process of placing the ink cartridge 30 to the cartridge holder 110. In the description below, it is assumed that an amount of ink remaining in the first ink chamber 36 is more than the amount of ink remaining in the first ink chamber 36 in a near-empty state.

In a state where the ink cartridge 30 is not placed in the cartridge holder 110, the valve 77 is located at the closed position (or the forward position) due to the urging force of the coil spring 87 as depicted in FIGS. 4A, 4B, and 4C.

When the valve 77 is located at the closed position, the valve 77 is in contact with the second sealer 76 by the urging force of the coil spring 87. In this state, the plug 83 is in tight contact with the edge of the through hole 68 of the second sealer 76. Thus, the through hole 68 is closed, whereby ink is not allowed to flow to the outside of the ink cartridge 30 from the first ink chamber 36.

When the valve 77 is located at the closed position, the hole 66A is located between the first sealing portion 96 and the second sealing portion 97. Therefore, the second sealing portion 97 blocks the communication between the first air communication passage 66 and the second air communication passage 67. Thus, the first ink chamber 36 is maintained at a negative pressure.

When the valve 77 is located at the closed position, the restriction member 88 is located at the restrict position. When the restriction member 88 is located at the restrict position, the detector 59 is located at the restricted position. Due to a buoyant force of the float 63, a force that tends to rotate the detector 59 in the direction of the arrow 74 acts on the detector 59. Thus, a force that tends to move the restriction portion 64 in the downward direction 53 acts on the restriction portion 64. For example, the float 63 urges the detector 59 toward the released position. In this state, the projecting portion 91 of the restriction member 88 is in contact with the restriction portion 64 of the detector 59 from below the restriction portion 64. Thus, when the restriction member 88 is located at the restrict position, the restriction member 88 applies, to the restriction portion 64, an external force that acts in a direction opposite to the direction of the arrow 74, which may be the rotating direction of the detector 59 toward the released position. In other words, when the restriction member 88 is located at the release position, the restriction portion 64 is located within a movable range of the restriction member 88. When the restriction member 88 is located at the restrict position, the restriction member 88 is positioned on a moving route of the restriction portion 64. Therefore, the restriction portion 64 is not permitted to move into the inside of the movable range of the restriction member 88. Accordingly, the detector 59 is restricted from rotating from the restricted position.

Figure 22:
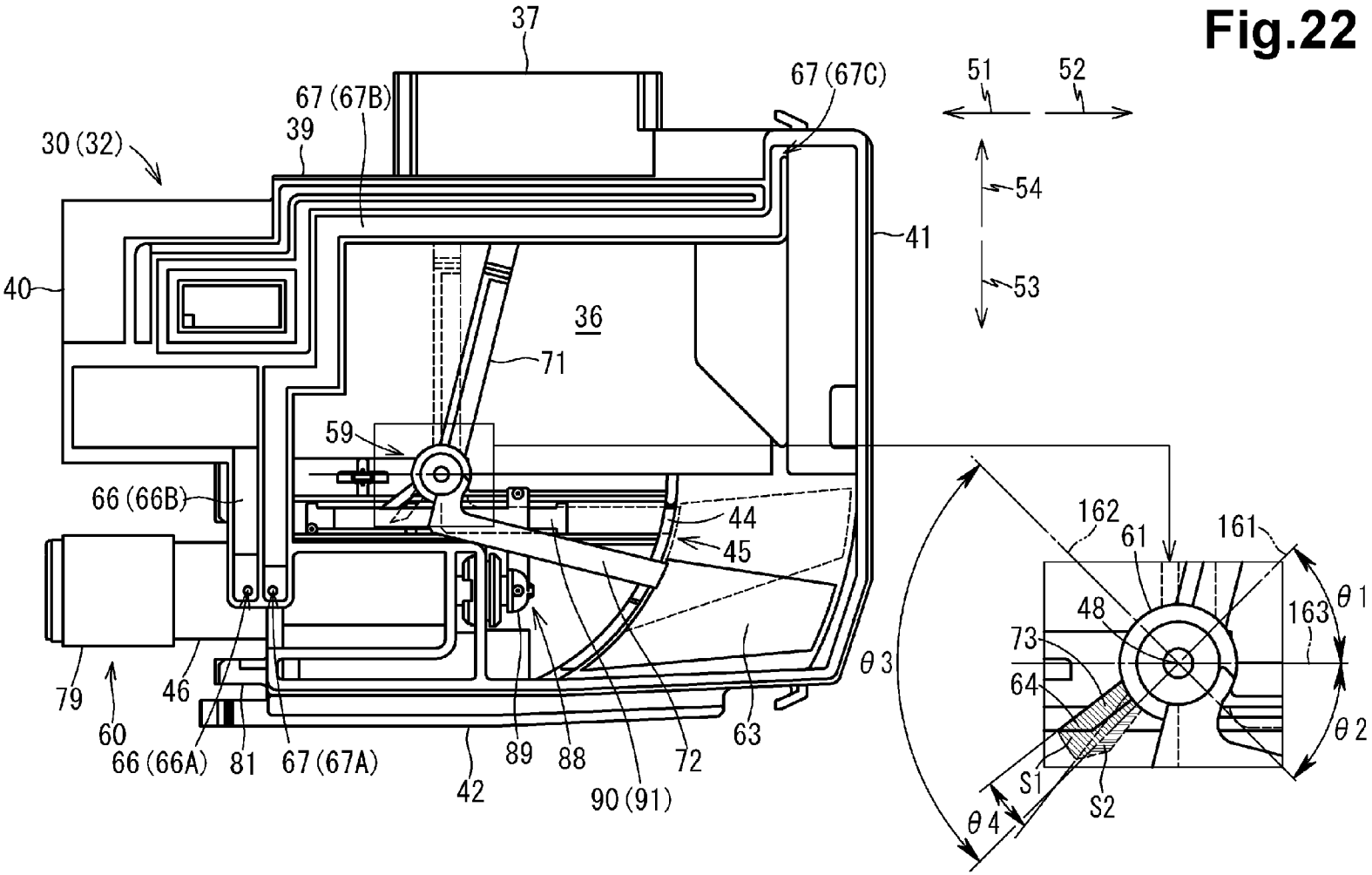
FIG. 22 is a schematic right side view depicting the ink tank in the illustrative embodiment according to one or more aspects of the disclosure.

It is assumed that four rotation angle ranges, e.g., first, second, third, and fourth rotation angle ranges, are defined by double-dotted-and-dashed lines 161 and 162 when viewed in an axial direction of the detector 59 (e.g., in the right-left direction 5556 or in a direction orthogonal to a surface of a drawing sheet of FIG. 22). When the detector 59 is located at the restricted position, the flat surface 80 of the restriction portion 64 is located within the first rotation angle range. The first rotation angle range is formed by angles $\theta 1$ and $\theta 2$. The second rotation angle is formed by an angle $\theta 3$. Each of the double-dotted-and-dashed lines 161 and 162 may be a virtual line that intersects the axis of the detector 59 and is angled at 45° relative to the insertion-removal direction 5152. The first rotation angle range has a rotation angle of the angles $\theta 1$ and $\theta 2$ relative to a dotted-and-dashed line 163 which is a virtual line extending in a moving direction of the restriction member 88 (e.g., extending in the insertion-removal direction 5152) from the axis of the detector 59. The second rotation angle range has a rotation angle of the angle $\theta 3$ relative to the dotted-and-dashed line 163 extending in the moving direction of the restriction member 88 (e.g., extending in the insertion-removal direction 5152) from the axis of the detector 59. The angles $\theta 1$, $\theta 2$, and $\theta 3$ may satisfy conditions that the angle $\theta 1$ is smaller than 45° ($\theta 1<45°$) relative to the dotted-and-dashed line 163, the angle $\theta 2$ is greater than 315° ($315°<\theta 2$) relative to the dotted-and-dashed line 163, the angle $\theta 3$ is between 135° and <225° ($135°<\theta 3<225°$) relative to the dotted-and-dashed line 163. In the illustrative embodiment, when the detector 49 is located at the restricted position, the flat surface 80 of the restriction portion 64 may be in contact with the restriction member 88 within a range of 180° to 225° in the second rotation angle range ($180°<\theta 3<225°$).

When the detector 59 is located at the restricted position, the float 63 is located near the lower wall 42. That is, the float 63 is submerged in ink stored in the first ink chamber 36.

When the detector 59 is located at the restricted position, the detection portion 62 is not located between the light emitting portion and the light receiving portion of the sensor 103. Therefore, light outputted from the light emitting portion is allowed to reach the light receiving portion. Thus, when the detector 59 is located at the restricted position, the sensor 103 outputs a high-level signal to the controller 130.

While the ink cartridge 30 is not placed at a particular position in the cartridge holder 110, a corresponding cartridge sensor 107 is free from pressure of the front end 58 of the cartridge cover 33 of the ink cartridge 30. Therefore, the cartridge sensor 107 outputs a low-level signal to the controller 130.

In this state, the cover of the cartridge holder 110 is opened and then the ink cartridge 30 is inserted into the cartridge holder 110. That is, the ink cartridge 30 is placed at the particular portion in the cartridge holder 110. In other words, the ink cartridge 30 becomes in the use position.

When the ink cartridge 30 reaches a vicinity of the inner back surface 151 of the cartridge holder 110 by its movement in the insertion direction 51, the front end 58 of the cartridge cover 33 of the ink cartridge 30 presses the corresponding cartridge sensor 107 facing thereto. In response to this, the cartridge sensor 107 outputs a high-level signal to the controller 130. Thus, counting for measuring a moving time of the detector 59 is started.

When the ink cartridge 30 reaches a vicinity of the inner back surface 151 of the cartridge holder 110 by its movement in the insertion direction 51, the plug 83 of the valve 77 comes into contact with a corresponding ink needle 102. In this state, as the ink cartridge 30 further moves in the insertion direction 51, the valve 77 is pressed by a reaction force from the ink needle 102. Thus, the valve 77 moves in the removal direction 52 from the closed position to the open position against the urging force of the coil spring 87.

As depicted in FIGS. 6A and 6B, As depicted in FIGS. 6A and 6B, when the valve 77 is located at the open position, the valve 77 is located separate from the second sealer 76 and thus the through hole 68 is opened. Therefore, ink is allowed to flow from the first ink chamber 36 to the outside of the ink cartridge 30.

When the valve 77 is located at the open position, both of the holes 66A and 67A are located between the first sealing portion 96 and the second sealing portion 97. Thus, the first air communication passage 66 and the second air communication passage 67 are in communication with each other. Accordingly, the first ink chamber 36 comes into communication with the outside air, whereby the inside pressure of the first ink chamber 36 changes from a negative pressure to the atmospheric pressure.

As the valve 77 moves in the removal direction 52 from the closed position to the open position, the restriction member 88 moves in the removal direction 52 together with the valve 77. For example, the restriction member 88 moves from the restrict position to the release position, whereby the projecting portion 91 of the restriction member 88 separates from the restriction portion 64 of the detector 59. Thus, the detector 59 becomes free to rotate from the restricted position.

While the restriction member 88 moves from the restrict position to the intermediate position, the surface 93 of the projecting portion 91 of the restriction member 88 slides relative to the flat surface 80 of the restriction portion 64. During the movement of the restriction member 88, the surface 93 keeps in contact with the flat surface 80 from below. Therefore, a restriction continues to be placed on the rotation of the detector 59 from the restricted position to the released position during the movement of the restriction member 88.

Figure 5A:
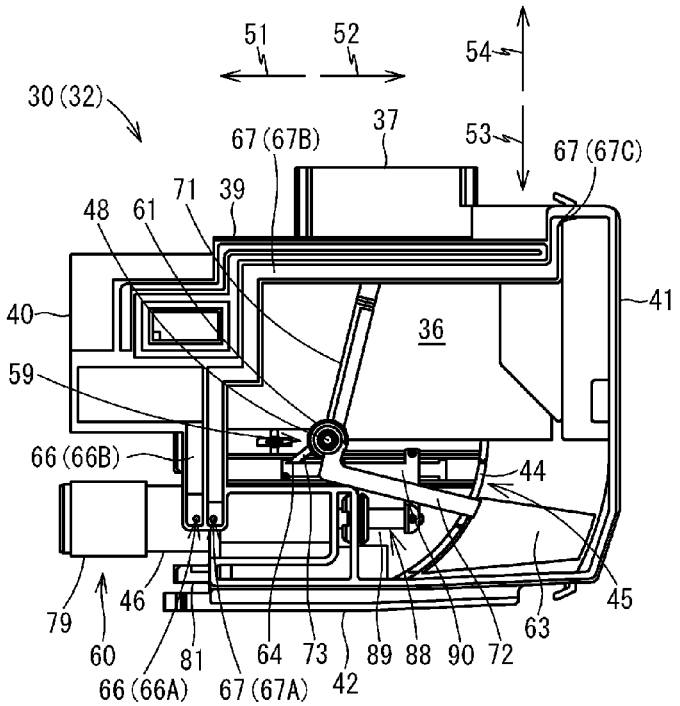
FIG. 5A is a right side view depicting the ink tank in the illustrative embodiment according to one or more aspects of the disclosure, wherein the restriction member is located at an intermediate position and the detector is located at the restricted position.
Figure 5B:
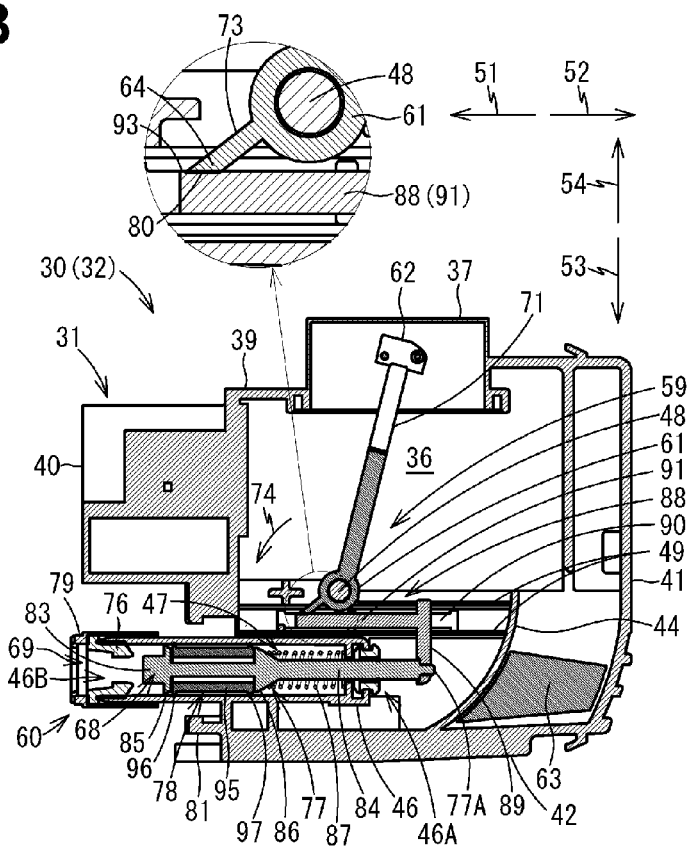
FIG. 5B is a vertical cross-sectional view depicting the ink tank in the illustrative embodiment according to one or more aspects of the disclosure, wherein the restriction member is located at the intermediate position and the detector is located at the restricted position.

As depicted in FIGS. 5A and 5B, when the restriction member 88 is located at the intermediate position, the restriction portion 64 is in contact with an end portion of the surface 93. The end portion of the surface 93 is farther from the first portion 89 than the other end portion in the insertion-removal direction 5152. Therefore, as the restriction member 88 further moves from the intermediate position toward the release position, the surface 93 of the projecting portion 91 comes separate from the flat surface 80 of the restriction portion 64. That is, the projecting portion 91 of the restriction member 88 comes separate from the restriction portion 64 of the detector 59. Thus, the detector 59 becomes free to rotate from the restricted position. For example, when the restriction member 88 is located at any position between the restrict position and the intermediate position, the restriction portion 64 is kept within the range of 180° to 225° in the second rotation angel area (180°<θ3<225°) (refer to FIG. 22). As the restriction member 88 moves from the intermediate position toward the release position, the detector 59 rotates toward a limit (e.g.,) 225° of the second rotation angle range.

As the detector 59 becomes free to rotate, the detector 59 rotates in the direction of the arrow 75 (e.g., a direction that the float 63, which has been kept submerged in ink, comes up by its buoyant force). That is, the detector 59 rotates from the restricted position to the released position by the float 63 that moves upward in response to the movement of the restriction member 88 to the release position while the ink cartridge 30 is in the use position (e.g., while the ink cartridge 30 is completely placed in the cartridge holder 110).

When the detector 59 is located at the released position, the restriction portion 64 is located within the movable range of the restriction member 88.

As depicted in FIG. 22, when the detector 59 is located at the released position, a portion of the restriction portion 64 is out of the second rotation angle range (e.g., the portion of the restriction portion 64 is within the fourth rotation angle range). In FIG. 22, the detector 59 located at the restricted position is indicated by a solid line and the detector 59 located at the released position is indicated by a dashed line. A movable range of the restriction portion 64 when the detector 59 rotates from the restricted position to the released position is indicated by hatching. The hatched movable range includes, for example, ranges S1 and S2 as depicted in FIG. 22. Of the ranges S1 and S2, a range that is within the second rotation angle range may be referred to as the range S1 and a remainder area that is out of the second rotation angle range may be referred to as the range S2. As depicted in FIG. 22, the range S1 is greater than the range S2. When viewed in the right-left direction 5556, a half or more of the movable range of the restriction portion 64 may be included within the second rotation angle range.

When the detector 59 is located at the released position, the restriction portion 64 may be located at any position within or out of the second rotation angle range as long as the range S1 is greater than the range S2.

In the illustrative embodiment, it is assumed that a rotation angle of the third arm 73 when the detector 59 moves from the restricted position to the released position is an angle θ4. The angle θ4 may be smaller than 45°. The third arm 73 extends from the axial portion 61 in the diameter direction. Therefore, the degree of the rotation angle of the third arm 73 is equal to the degree of the rotation angle of the detector 59. Accordingly, the rotation angle of the detector 59 when the detector 59 moves from the restricted position to the released position is smaller than 45°. Nevertheless, in other embodiments, for example, the rotation angle of the detector 59 when the detector 59 moves from the restricted position to the released position may be 45° or greater.

The float 63 keeps moving in the direction of the arrow 75 until the second arm 72 comes into contact with a surface 45A (refer to FIGS. 3 and 6A) that defines a portion of the recess 45 of the second inner wall 44. At the time the second arm 72 comes into contact with the surface 45A, the detector 59 is located at the released position as depicted in FIGS. 7A and 7B.

When the detector 59 is located at the released position, the detection portion 62 is located between the light emitting portion and the light receiving portion of the sensor 103, thereby blocking light outputted from the light emitting portion from reaching the light receiving portion. Thus, when the detector 59 is located at the released position, the sensor 103 outputs a low-level signal to the controller 130. For example, the sensor 103 outputs a low-level signal (as an example of a detection signal) indicating the presence of the detector 59 at the released position. Thus, the counting for measuring the moving time of the detector 59 is ended. Through this process, the ink cartridge 30 is completely placed in the cartridge holder 110.

Hereinafter, a description will be provided on how the valve 77, the restriction member 88, and the detector 59 behave in a process of removing the ink cartridge 30 from the cartridge holder 110. In the description below, it is assumed that the amount of ink remaining in the ink chamber 36 is more than the amount of ink remaining in the ink chamber 36 in the near-empty state.

Figure 7A:
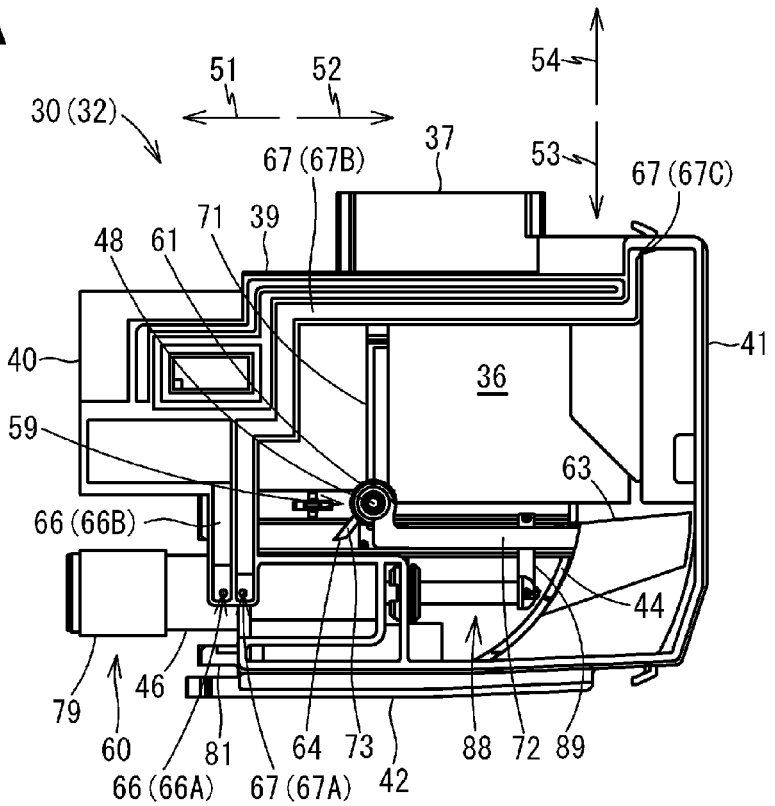
FIG. 7A is a right side view depicting the ink tank in the illustrative embodiment according to one or more aspects of the disclosure, wherein the restriction member is located at the release position and the detector is located at a released position.
Figure 7B:
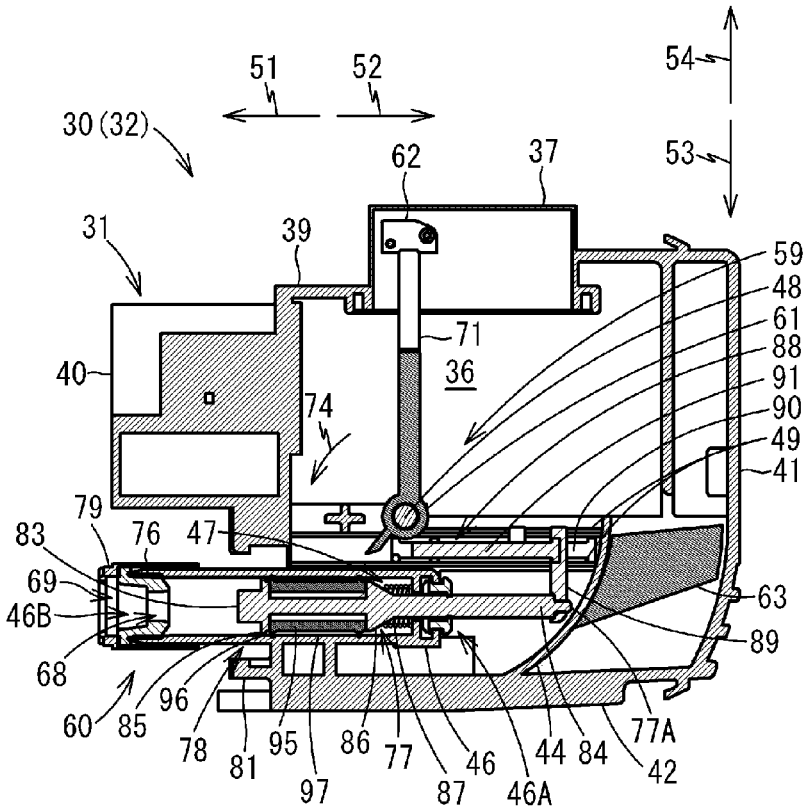
FIG. 7B is a vertical cross-sectional view depicting the ink tank in the illustrative embodiment according to one or more aspects of the disclosure, wherein the restriction member is located at the release position and the detector is located at the released position.
Figure 8A:
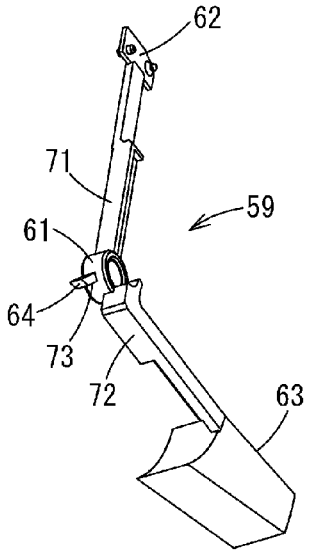
FIG. 8A is a perspective view depicting the detector in the illustrative embodiment according to one or more aspects of the disclosure.
Figure 8B:
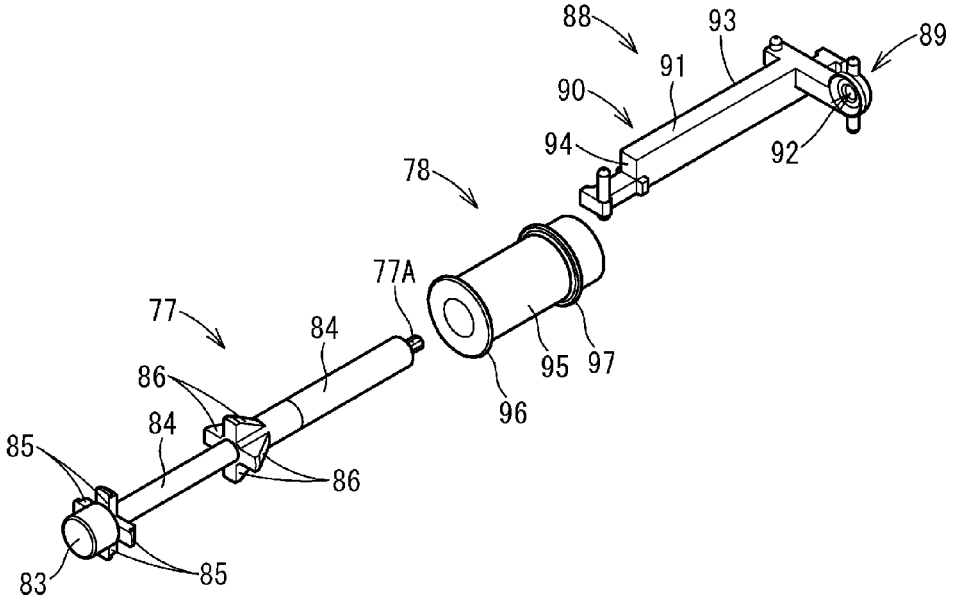
FIG. 8B is a perspective view depicting a valve, a sealing member, and the restriction member in the illustrative embodiment according to one or more aspects of the disclosure.

As depicted in FIGS. 7A and 7B, in a state where the ink cartridge 30 is completely placed in the cartridge holder 110, the valve 77 is located at the second position by the pressing force of the corresponding ink needle 102. When the valve 77 is located at the second position, the restriction member 88 is located at the release position. When the restriction member 88 is located at the release position, the detector 59 is permitted to rotate. In this state, the detector 59 is located at the released position by the buoyant force of the float 63.

Figure 23A:
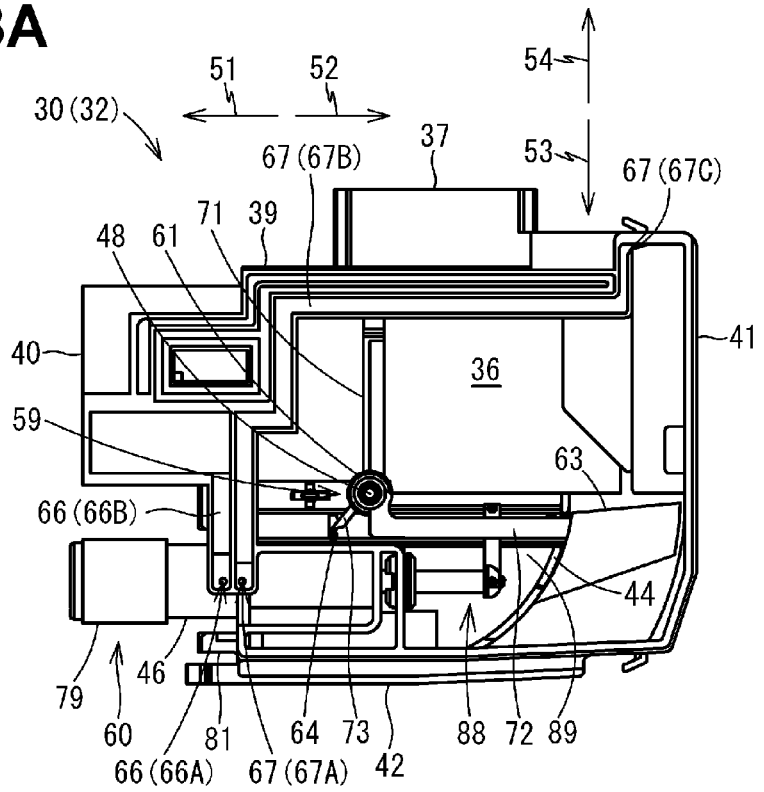
FIG. 23A is a right side view depicting the ink tank in the illustrative embodiment according to one or more aspects of the disclosure, wherein a surface of the restriction member and the restriction portion are in contact with each other.
Figure 23B:
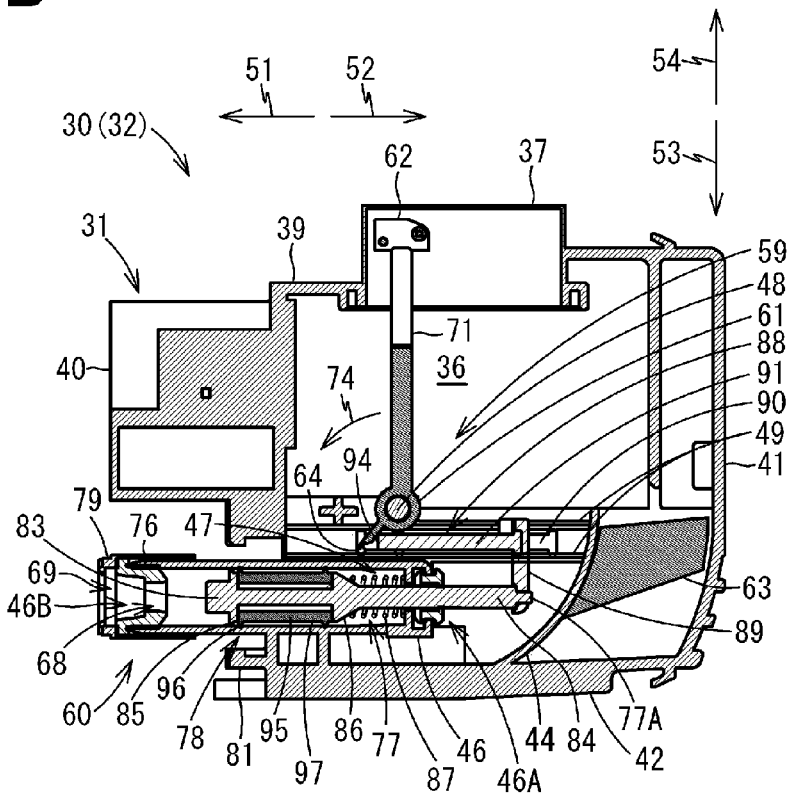
FIG. 23B is a vertical cross-sectional view depicting the ink tank in the illustrative embodiment according to one or more aspects of the disclosure, wherein the surface of the restriction member and the restriction portion are in contact with each other.

As the ink cartridge 30 moves in the removal direction 52 for removing the ink cartridge 30 from the cartridge holder 110, the valve 77 separates from the ink needle 102, whereby the valve 77 moves from the open position to the closed position by the urging force of the coil spring 87. As the valve 77 moves from the open position to the closed position, the restriction member 88 moves together with the valve 77 from the release position to the restrict position. As the restriction member 88 moves from the release position to the intermediate position, the projecting portion 91 of the restriction member 88 comes into contact with the restriction portion 64 of the detector 59 that is located at the released position in the movable range of the restriction member 88 (refer to FIGS. 23A and 23B). For example, a surface that extends intersecting the surface of the restriction portion 64 that is in contact with the projecting portion 91 of the restriction member 88 at the restrict position comes into contact with a surface 94 of the restriction member 88 facing the direction toward which the ink cartridge 30 is inserted, whereby the restriction portion 64 is pressed toward the restricted position from the released position by the projecting portion 91. Thus, the detector 59 rotates in the direction opposite to the direction of the arrow 74 (refer to FIG. 4B). For example, the detector 59 rotates from the released position to the restricted position. Thus, the restriction portion 64 is forced to move into the range of 180° to 225° in the second rotation angle range ($180° < \theta 3 < 225°$) by the restriction member 88. For example, a state of the restriction portion 64 is changed from a state where a portion of the restriction portion 64 is out of the second rotation angle range to a state where an entire portion of the restriction portion 64 is within the second rotation angle range.

As the detector 59 rotates, the restriction portion 64 moves over the projecting portion 91. For example, the restriction portion 64 separates from the surface 94 of the restriction member 88 and then comes into contact with the surface 93 from above. The restriction portion 64 is kept in contact with the surface 93 of the projecting portion 91 from below. In this state, while the restriction member 88 moves from the intermediate position to the release position, the surface 93 slides relative to the flat surface 80 of the restriction portion 64.

As described above, the restriction member 88 allows the detector 59 to rotate to the restricted position while the restriction member 88 moves from the release position to the restrict position.

Hereinafter, a description will be provided on how the valve 77, the restriction member 88, and the detector 59 behave as the amount of ink remaining in the ink chamber 36 decreases due to consumption of ink in the recording head 21 after the ink cartridge 30 is completely placed in the cartridge holder 110.

Ink stored in the ink chamber 36 decreases due to consumption of ink by ink ejection from the nozzles 29 of the recording head 21 and thus the ink level becomes lower than a portion of the float 63. In a state where the ink level is lower than the portion of the float 63, the float 63 moves downward with the ink level lowering. In accordance with the downward movement of the float 63, the detector 59 rotates in the direction reverse to the direction of the arrow 74 (refer to FIG. 4B). That is, the detector 59 rotates from the released position to the restricted position, whereby the detection portion 62 is not located between the light emitting portion and the light receiving portion of the sensor 103. Thus, light outputted from the light emitting portion is allowed to reach the light receiving portion. In response to receipt of the light, the sensor 103 outputs a high-level signal to the controller 130. Upon receipt of the high-level signal outputted from the sensor 103, the controller 130 determines that the amount of ink remaining in the ink chamber 36 becomes a predetermined amount.

[Ink Viscosity Abnormality Determination by Controller 130]

The controller 130 executes processing for determining whether an abnormality is present or absence in viscosity of ink stored in the ink chamber 36 of the ink cartridge 30. Referring to flowcharts of FIGS. 9, 10, and 11, the ink viscosity abnormality determination processing will be described.

When the controller 130 determines that the detection signal outputted from the cartridge sensor 107 has been changed from a low-level signal to a high-level signal (e.g., YES in step S11), the controller 130 starts counting to measure a moving time of the detector 59 (e.g., step S12). The controller 130 refers to the detection signal at predetermined intervals. When the controller 130 determines that the level of the detection signal referred at a particular timing is different from the level of the detection signal referred last time, the controller 130 determines that the detection signal outputted from the cartridge sensor 107 has been changed. When the controller 130 determines that the detection signal outputted from the cartridge sensor 107 has not been changed from a low-level signal to a high-level signal (e.g., NO in step S11), the controller 130 executes processing of step S20. For example, when a new ink cartridge 30 is not placed in the cartridge holder 110, the controller 130 determines that the detection signal outputted from the cartridge sensor 107 has been changed from a low-level signal to a high-level signal (e.g., NO in step S11).

Subsequent to step S12, the controller 130 determines whether the time elapsed since the measurement of the moving time was started exceeds a predetermined maximum time (e.g., step S13). When the controller 130 determines that the elapsed time already exceeds the predetermined maximum time (e.g., YES in step S13), the controller 130 executes processing of step S15. For example, when the viscosity of ink stored in the ink chamber 36 is relatively extremely high, the controller 130 determines that the elapsed time already exceeds the predetermined maximum time (e.g., YES in step S13) before the controller 130 determines that the detection signal outputted from the sensor 103 has been changed from a high-level signal to a low-level signal.

When the controller 130 determines that the elapsed time does not exceed the predetermined maximum time (e.g., NO in step S13), the controller 130 determines whether the detection signal outputted from the sensor 103 has been changed from a high-level signal to a low-level signal (e.g., step S14). When the controller 130 determines that the detection signal outputted from the sensor 103 has not been changed from a high-level signal to a low-level signal (e.g., NO in step S14), the controller 130 executes the processing of step S13 again. When the controller 130 determines that the detection signal outputted from the sensor 103 has been changed from a high-level signal to a low-level signal (e.g., YES in step S14), the controller 130 ends counting to measure the moving time of the detector 59 and determines the moving time of the detector 59 (e.g., step S15). When the controller 130 determines that the elapsed time already exceeds the predetermined maximum time (e.g., YES in step S13), the controller 130 determines the predetermined maximum time as the moving time of the detector 59.

The moving time may be a time period elapsed until the detection signal outputted from the sensor 103 becomes a low-level signal from a high-level signal from the timing at which the detection signal outputted from the cartridge sensor 107 becomes a high-level signal from a low-level signal (e.g., YES in step S11).

More strictly, the switching of the detection signal outputted from the cartridge sensor 107 from a low-level signal to a high-level signal might not occur at the same time as when the detector 59 becomes capable of rotating from the restricted position to the released position due to disengagement from the restriction member 88. Nevertheless, the switching of the detection signal outputted from the cartridge sensor 107 from a low-level signal to a high-level signal occurs close to the release of the detector 59. Therefore, the timing at which the detector 59 becomes capable of rotating from the restricted position to the released position may be considered as the timing at which the detection signal outputted from the cartridge sensor 107 is changed from a low-level signal to a high-level signal. Thus, the controller 130 counts to measure a time elapsed until the controller 130 receives a low-level signal from the sensor 103 after the controller 130 receives a high-level signal from the cartridge sensor 107, and considers the measured time as the moving time of the detector 59, i.e., the time required for the movement of the detector 59 from the restricted position to the released position.

Subsequent to step S15, the controller 130 resets an abnormal flag (e.g., the controller 130 sets the abnormal flag to "OFF") (e.g., step S16). The abnormal flag is set to "ON" when the moving time is not included within a threshold range (e.g., NO in step S18) as a result of the determination as to whether the moving time is included within the threshold range (e.g., step S18). The abnormal flag may be a value assigned on a basis of ink cartridge 30. The controller 130 stores the abnormal flag for each ink cartridge 30 in the EEPROM 134.

Subsequent to step S16, the controller 130 determines a threshold range based on the signal outputted from the temperature sensor 106 (e.g., step S17). The threshold range is used for comparison with the moving time measured in step S15 in order to estimate the viscosity of ink stored in the ink chamber 36. The controller 130 assigns a lower value to at least one of an upper limit and a lower limit of the threshold range when the temperature specified by the signal outputted from the temperature sensor 106 indicates a higher temperature. In other words, the controller 130 assigns a higher value to at least one of the upper limit and the lower limit of the threshold range when the temperature specified by the signal received from the temperature sensor 106 indicates a lower temperature.

Subsequent to step 17, the controller 130 determines whether the moving time measured in step S15 is included within the threshold range determined in step S17 (e.g., step S18). When the moving time is below the lower limit of the threshold range, it is estimated that the ink viscosity is lower than a normal ink viscosity. When the moving time is above the upper limit of the threshold range, it is estimated that the ink viscosity is higher than the normal ink viscosity. When the controller 130 determines that the moving time is out of the threshold range (e.g., NO in step S18), the controller 130 sets the abnormal flag to "ON" (e.g., step S19). When the controller 130 determines that the moving time is included within the threshold range (e.g., YES in step S18), the routine skips the processing of step S19.

The controller 130 determines whether a signal that indicates closing of the cover of the cartridge holder 11 is outputted from the cover sensor 108 (e.g., step S20). When the controller 130 determines that the cover is opened (e.g., NO in step S20), the controller 130 executes the processing of step S11 and subsequent steps again. When the controller 130 determines that the cover is closed (e.g., YES in step S20), the controller 130 determines whether a predetermined time has elapsed since the controller 130 determined, in step S20, that the cover is closed (e.g., step S21).

Figure 9:
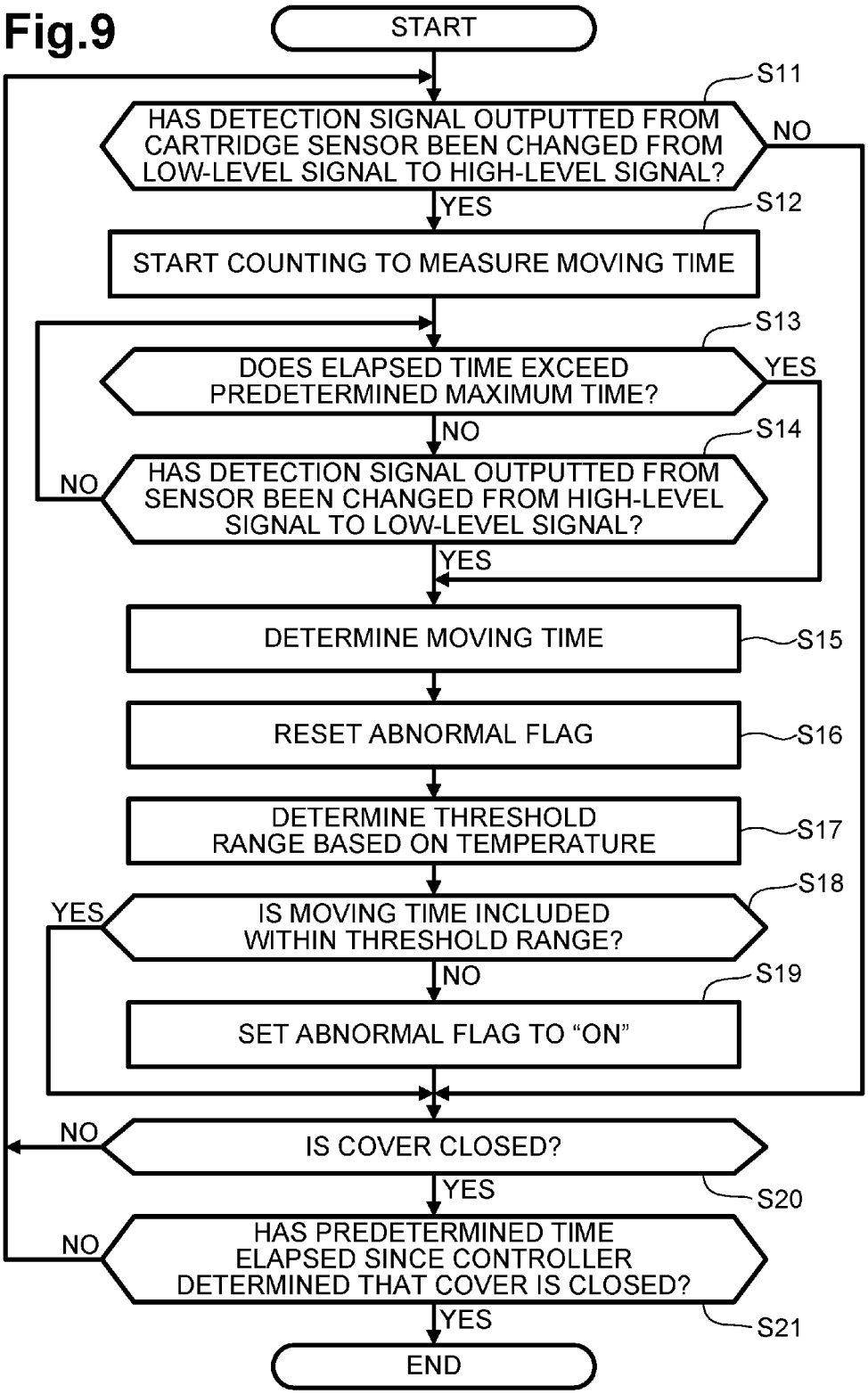
FIG. 9 is a flowchart depicting example processing executed by a controller for determining whether abnormality occurs in viscosity of ink stored in an ink chamber of the ink tank in the illustrative embodiment according to one or more aspects of the disclosure.

When the controller 130 determines that the predetermined time has already elapsed (e.g., YES in step S21), the controller 130 ends the ink viscosity abnormality determination process of FIG. 9. When the controller 130 determines that the predetermined time has not elapsed yet (e.g., NO in step S21), the controller 130 executes the processing of step S11 and subsequent steps. When the controller 130 determines that the cover is opened (e.g., NO in step S20) in the process of looping the processing of step S11 and subsequent steps, the controller 130 ends counting to measure the elapsed time at the time of determining that the cover is closed (e.g., YES in step S20).

Figure 10:
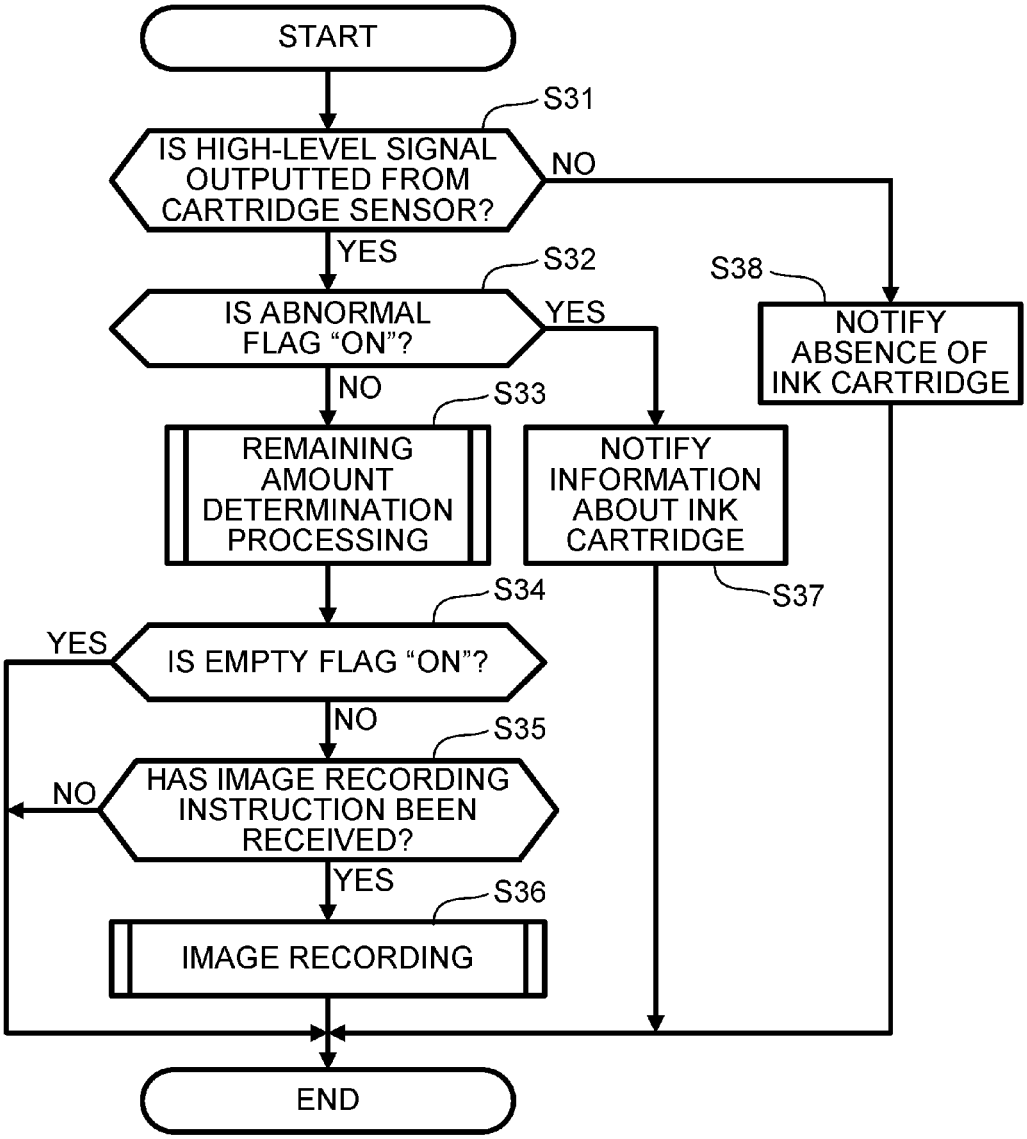
FIG. 10 is a flowchart depicting example processing executed by the controller on conditions that the determination processing in FIG. 9 has been ended and a cover of the cartridge holder is closed in the illustrative embodiment according to one or more aspects of the disclosure.

Subsequent to the ink viscosity abnormality determination processing of FIG. 9, the controller 130 repeatedly executes processing of FIG. 10 at predetermined intervals on condition that the signal that indicates closing of the cover of the cartridge holder 11 is outputted from the cover sensor 108.

The controller 130 determines whether the detection signal outputted from the cartridge sensor 107 is a high-level signal (e.g., step S31). When the controller 130 determines that the detection signal outputted from the cartridge sensor 107 is a low-level signal (e.g., NO in step S31), the controller 130 notifies the absence of an ink cartridge 30 (e.g., step S38) and ends the processing of FIG. 10. For example, the notification may be implemented by displaying a message on the display 109 of the printer 10 or outputting voice guidance from a speaker (not depicted).

When the controller 130 determines that the detection signal outputted from the cartridge sensor 107 is a high-level signal (e.g., YES in step S31), the controller 130 determines whether the abnormal flag is "ON" (e.g., step S32). When the controller 130 determines that the abnormal flag is "ON" (e.g., YES in step S32), the controller 130 notifies information about the ink cartridge 30 (e.g., step S37) and ends the processing of FIG. 10. For example, a deterioration of ink stored in the ink chamber 36 or recommendation of replacement of the ink cartridge 30 may be notified. The notification may be implemented in the same or similar manner to the notification performed in step S38.

Figure 11:
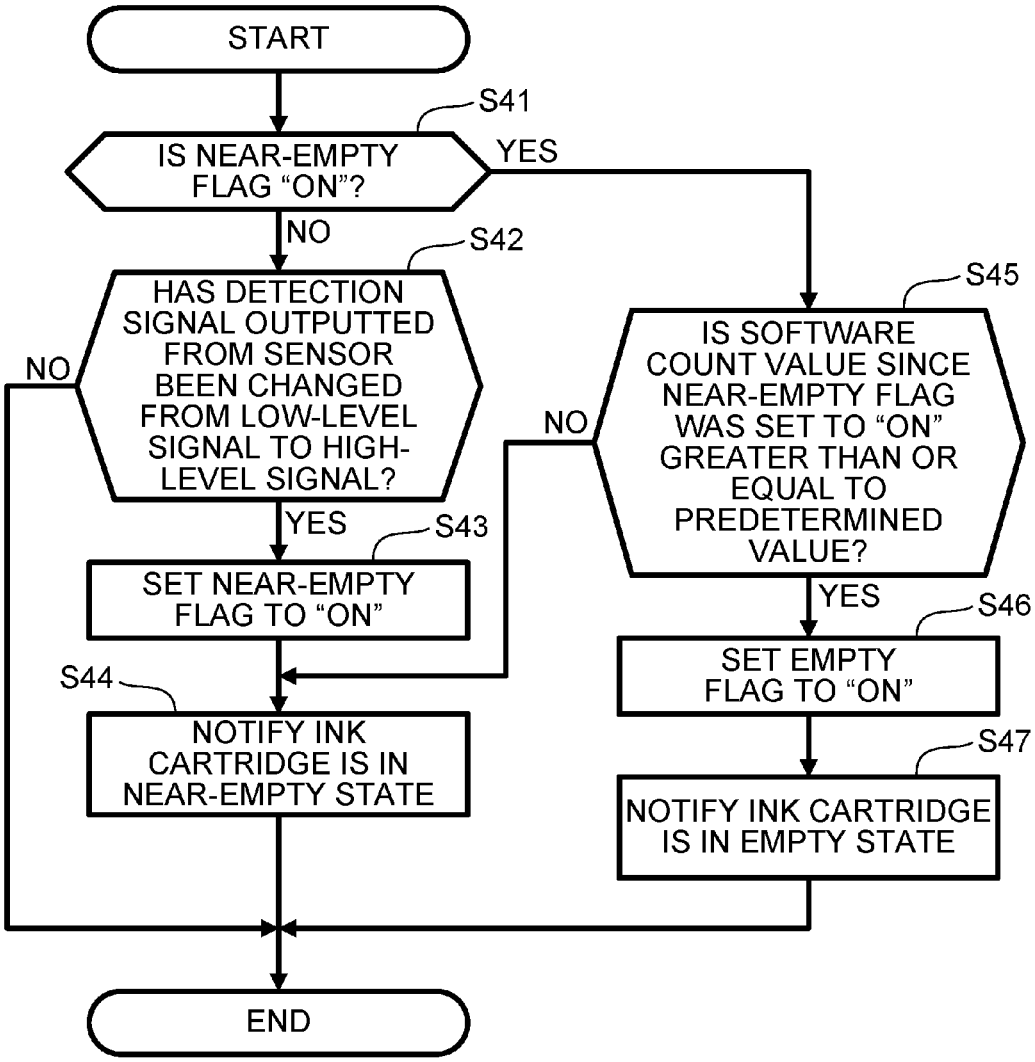
FIG. 11 is a flowchart depicting example processing executed by the controller for determining an amount of ink remaining in the ink chamber in the illustrative embodiment according to one or more aspects of the disclosure.

When the controller 130 determines that the abnormal flag is "OFF" (e.g., NO in step S32), the controller 130 executes remaining amount determination processing of FIG. 11 (e.g., step S33). Subsequent to the remaining amount determination processing, the controller 130 determines whether an empty flag is "ON" (e.g., step S34). The empty flag may be set to "ON" when the controller 130 determines that the amount of ink remaining in the ink chamber 36 is not enough to perform image recording.

When the controller 130 determines that the empty flag is "ON" (e.g., YES in step S34), the controller 130 ends the processing of FIG. 10. When the controller 130 determines that the empty flag is not "ON" (e.g., NO in step S34), the controller 130 determines whether an image recording instruction has been received (e.g., step S35). When the controller 130 determines that an image recording instruction has not been received (e.g., NO in step S35), the controller 130 ends the processing of FIG. 10. When the controller 130 determines that an image recording instruction has been received (e.g., YES in step S35), the controller 130 controls the recording head 21, the feed roller 23, the conveyor roller pair 25, the discharge roller pair 27 directly or indirectly to record an image onto a recording sheet (e.g., step S36) and then ends the processing of FIG. 10. The processing of step S36 may end upon completion of image recording for a single recording sheet or upon completion of image recording of all obtained image data.

As described above, when the controller 130 determines that the abnormal flag is "ON" (e.g., YES in step S32), the controller 130 does not execute image recording of step S36. That is, the routine skips step S36. In other words, the controller 130 does not permit the recording head 21 to eject ink therefrom.

Hereinafter, the remaining amount determination processing will be described referring to FIG. 11. The controller 130 determines whether a near-empty flag is "ON" (e.g., step S41). The near-empty flag may be set to "ON" when the controller 130 determines that the amount of ink remaining in the ink chamber 36 is relatively low although enough to perform image recording. That is, the amount of ink remaining in the ink chamber 36 when the near-empty flag is "ON" is more than the amount of ink remaining in the ink chamber 36 when the empty flag is "ON".

When the controller 130 determines that the near-empty flag is not "ON" (e.g., NO in step S41), the controller 130 determines whether the detection signal outputted from the sensor 103 has been changed from a low-level signal to a high-level signal (e.g., step S42). When the controller 130 determines that the detection signal outputted from the sensor 103 has not been changed (e.g., NO in step S42), the controller 130 ends the remaining amount determination processing and executes the processing of step S34 of FIG. 10. When the controller 130 determines that the detection signal outputted from the sensor 103 has been changed from a low-level signal to a high-level signal (e.g., YES in step S42), the controller 130 sets the near-empty flag to "ON" (e.g., step S43). Subsequently, the controller 130 notifies that the ink cartridge 30 is in a near-empty state (e.g., step S44) and ends the remaining amount determination processing of FIG. 11. Subsequent to this, the controller 130 executes the processing of step S34 of FIG. 10. The near-empty state refers to a state of the ink chamber 36 when the amount of ink remaining in the ink chamber 36 is relatively low although enough to perform image recording.

In step S41, when the controller 130 determines that the near-empty flag is "ON" (e.g., YES in step S41), the controller 130 determines whether a software count value since the near-empty flag was set to "ON" is greater than or equal to a predetermined value (e.g., step S45). The software count value may be obtained based on data provided when the controller 130 provides an ink ejection instruction to the recording head 21. More specifically, the software count value may be obtained by accumulative count of a multiplication value of the number of ink droplets that the controller 130 orders the recording head 21 ejecting therefrom and an amount of ink of each ink droplet specified by the controller 130. The predetermined value may be used for comparison with the software count value.

When the controller 130 determines that the software count value since the near-empty flag was set to "ON" is smaller than the predetermined value (e.g., NO in step S45), that is, when the controller 130 determines that the amount of ink consumed by the recording head 21 since the near-empty flag was set to "ON" is less than the predetermined value (e.g., NO in step S45), the controller 130 executes the processing of step S44.

When the controller 130 determines that the software count value since the near-empty flag was set to "ON" is greater than or equal to the predetermined value (e.g., YES in step S45), that is, when the controller 130 determines that the amount of ink consumed by the recording head 21 since the near-empty flag was set to "ON" is greater than or equal to the predetermined value (e.g., YES in step S45), the controller 130 sets the empty flag to "ON" (e.g., step S46). Subsequently, the controller 130 notifies that the ink cartridge 30 is in an empty state (e.g., step S47) and ends the remaining amount determination processing of FIG. 11. Subsequent to this, the controller 130 executes the processing of step S34 of FIG. 10. The empty state refers to a state of the ink chamber 36 when there is not enough amount of ink remaining in the ink chamber 36 for performing image recording.

In steps S44 and S47, in one example, the notification may be implemented by, for example, displaying a message on the display 109 of the printer 10 or outputting voice guidance from the speaker (not depicted).

[Effects Obtained by Illustrative Embodiment]

According to the illustrative embodiment, when the restriction member 88 is located between the restrict position and the intermediate position the projecting portion 91 of the restriction member 88 slides relative to the restriction portion 64 while maintaining the restriction on the rotation of the detector 59 toward the released position from the restricted position. Therefore, while the projecting portion 91 moves between the restrict position and the intermediate position, the detector 59 is retained at the restricted position. That is, if variations occur in positions of the restriction members 88 between the restrict position and the intermediate position when the restriction members 88 moves therebetween among ink cartridges, such variations might not influence on the released positions of the detectors 59.

According to the illustrative embodiment, the returning of the restriction member 88 from the release position to the restrict position may enable a repeating restriction on the rotation of the detector 59 at the restricted position.

According to the illustrative embodiment, the second portion 90 of the restriction member 88 extends toward the axis of the detector 59. Therefore, the projecting portion 91 of the second portion 90 may be located near the axis of the detector 59. Accordingly, the detector 59 and the restriction member 88 may contact with each other near the axis of the detector 59.

According to the illustrative embodiment, the restriction member 88 is connected with the valve 77 so as to be movable in accordance with the movement of the valve 77. With this configuration, the restriction member 88 may be moved in accordance with opening or closing of the opening 46B that is implemented in accordance with the movement of the valve 77.

According to the illustrative embodiment, when the detector 59 is located at the released position, the restriction portion 64 is located lower than the axis of the detector 59. The restriction member 88 is connected with the valve 77 that is configured to selectively open and close the opening 46B provided below the axis of the detector 59. Therefore, such a restriction member 88 is located near the restriction portion 64, thereby enabling the restriction member 88 to come into contact with the restriction portion 64 readily.

According to the illustrative embodiment, when the detector 59 is located at the released position, the restriction portion 64 is located lower than when the detector 59 is located at the restricted position. The restriction member 88 is connected with the valve 77 is configured to selectively open and close the opening 46B provided below the axis of the detector 59. Therefore, such a restriction member 88 is located near the restriction portion 64 of the detector 59 that is located at the released position, thereby enabling the restriction member 88 to come into contact with the restriction portion 64 readily.

According to the illustrative embodiment, as the restriction member 88 moves from the restrict position to the release position, the detector 59 moves from the restricted position to the released position. At that time, the detector 59 moves through ink while receiving viscous and inertial resistance from ink, whereby the moving speed of the detector 59 depends on the ink viscosity. Therefore, the viscosity of ink stored in the ink cartridge 30 may be estimated through the measurement of the time elapsed from the timing at which the restriction member 88 reaches the release position to the timing at which the detector 59 reaches the released position.

According to the illustrative embodiment, in a case where a half or more of the movable range of the restriction portion 64 is included within one of the first rotation angle range and the second rotation angle range, a rotation angle of the detector 59 relative to the movement of the restriction member 88 in the moving direction may be greater than a case where a half or more of the movable range of the restriction portion 64 is included within the one of the third rotation angle range (e.g., $45° \leq \theta \leq 135°$) and the fourth rotation angle range (e.g., $225° \leq \theta \leq 315°$). That is, in the illustrative embodiment, when a half or more of the movable range of the restriction portion 64 is included within one of the first rotation angle range and the second rotation angle range, the detector 59 may rotate greatly while the restriction member 88 moves less distance.

According to the illustrative embodiment, even when the ink level becomes lower than the opening 46A, the first sealer 177 reduces or prevents air existing in the first ink chamber 36 from entering the valve chamber 47 of the ink outlet 60 through the opening 46A. Therefore, ink may be allowed to flow to the outside of the ink cartridge 30 through the through hole 176 and the valve chamber 47.

According to the illustrative embodiment, the valve 77 and the first sealer 177 are in contact with each other at the particular portion, e.g., at the portion where the projection 183 of the first sealer 177 is disposed. Therefore, a less load may be imposed on the valve 77 when the valve 77 moves relative to the first sealer 177.

According to the illustrative embodiment, the projection 183 of the first sealer 177 and the valve 77 are in contact with each other at a different position in the insertion-removal direction 5152 from the position at which the projection 185 of the cylindrical wall 46 and the first sealer 177 are in contact with each other. Therefore, a less load may be imposed on the valve 77 when the valve 77 moves relative to the first sealer 177.

According to the illustrative embodiment, if the first sealer 177 is disposed at a position to close the through hole 176, ink may be allowed to flow into the valve chamber 47 via the grooves 186 of the first sealer 177.

According to the illustrative embodiment, the restriction member 88 and the valve 77 constitute a one-piece component, thereby having a small-sized body.

[First Variation]

In the illustrative embodiment, the surface 93 of the restriction member 88 that is configured to contact with the restriction portion 64 of the detector 59 extends in the direction parallel to the insertion-removal direction 5152 along which the restriction member 88 moves. Nevertheless, in another example, a surface that is configured to contact with the restriction portion 64 might not extend in the direction parallel to the insertion-removal direction 5152. In the illustrative embodiment, the restriction member 88 is configured to move in the direction parallel to the insertion-removal direction 5152 along which the valve 77 moves. Nevertheless, the moving direction of the restriction member 88 is not limited to the insertion-removal direction 5152. In other example, the restriction member 88 may move in a direction intersecting the direction that the valve 77 moves.

In a first variation, for example, as depicted in FIGS. 13A, 13B, 14A, and 14B, a restriction member 88 includes a surface 124 that is configured to contact with a restriction portion 64 of a detector 59. The surface 124 extends both in the up-down direction 5453 and in the right-left direction 5556. That is, the surface 124 extends in a direction orthogonal to the insertion-removal direction 5152 along which the restriction member 88 moves. In the first variation, common parts have the same reference numerals as those of the above-described illustrative embodiment, and a description of the common parts will be omitted or briefly provided.

As depicted in FIGS. 13A, 13B, 14A, and 14B, a valve 77 and the restriction member 88 may be separate components and might not be integral with each other. The valve 77 includes an inclined surface 121 at an end that faces the direction toward which an ink cartridge 30 is removed. The inclined surface 121 is angled relative to the removal direction 52 and extends upward in the removal direction 52.

The restriction member 88 includes a body 116 and a projecting portion 117. The body 116 has a cavity 115 that is recessed in the removal direction 52 relative to a surface that faces the direction toward which the ink cartridge 30 is inserted. The projecting portion 117 protrudes upward from the body 116.

The cavity 115 has an inclined surface 123, which defines a portion of the cavity 115. The inclined surface 123 is angled relative to the removal direction 52 and extends upward in the removal direction 52. The inclined surface 123 of the cavity 115 of the restriction member 88 and the inclined surface 121 of the valve 77 are in contact with each other. With this configuration, in a state of FIG. 13A, as the valve 77 moves from a closed position toward an open position in the removal direction 52, the restriction member 88 moves in the downward direction 53 (refer to FIGS. 13B, 14A, and 14B).

A coil spring 122 is disposed between the body 116 of the restriction member 88 and a lower wall 42 of an ink tank 32 in the up-down direction 5453. The coil spring 122 has one end connected with the body 116 of the restriction member 88 and the other end connected with the lower wall 42. This configuration allows the restriction member 88 to move up and down as the coil spring 122 extends and contracts. In other variations, for example, a leaf spring may be used as the urging member, instead of the coil spring 121.

A frame 31 of the ink tank 32 includes a guide member 118. The guide member 118 protrudes in the upward direction 54 from the lower wall 42 of the frame 31. The guide member 118 surrounds the restriction member 88 on four sides, for example, the right side, the left side, the side that faces the direction toward which the ink cartridge 30 is inserted, and the side that faces the direction toward which the ink cartridge 30 is removed. With this configuration, while the restriction member 88 is movable up and down along the guide member 118, the restriction member 88 is permitted to move only within backlash or play in the insertion-removal direction 5152 and in the rightward-leftward direction 5556.

Figure 13A:
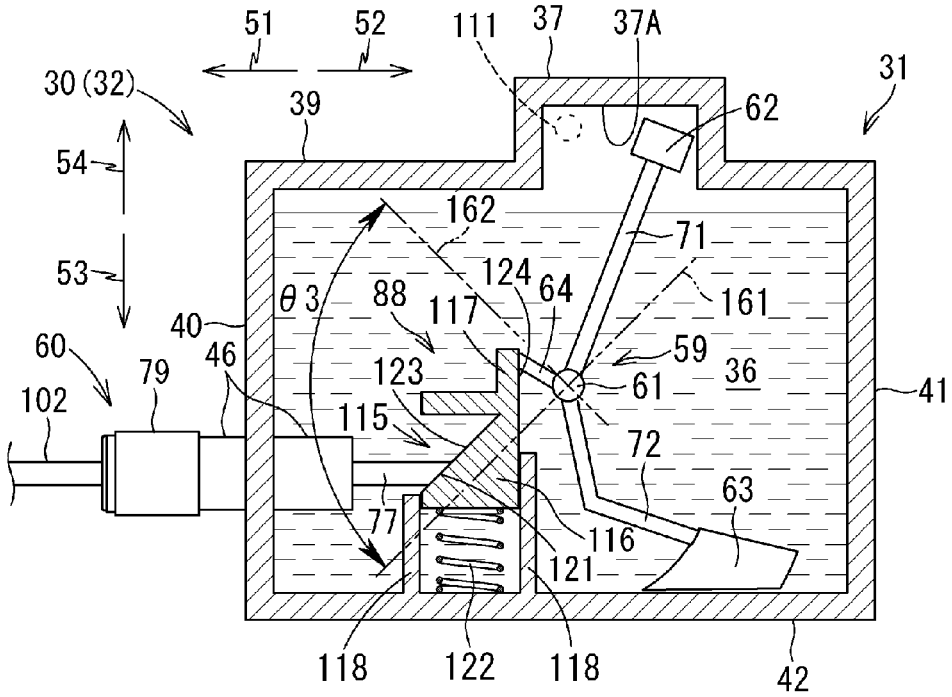
FIG. 13A is a vertical cross-sectional view depicting an ink tank in a first variation of the illustrative embodiment according to one or more aspects of the disclosure, a restriction member is located at a restrict position and a detector is located at a restricted position.
Figure 13B:
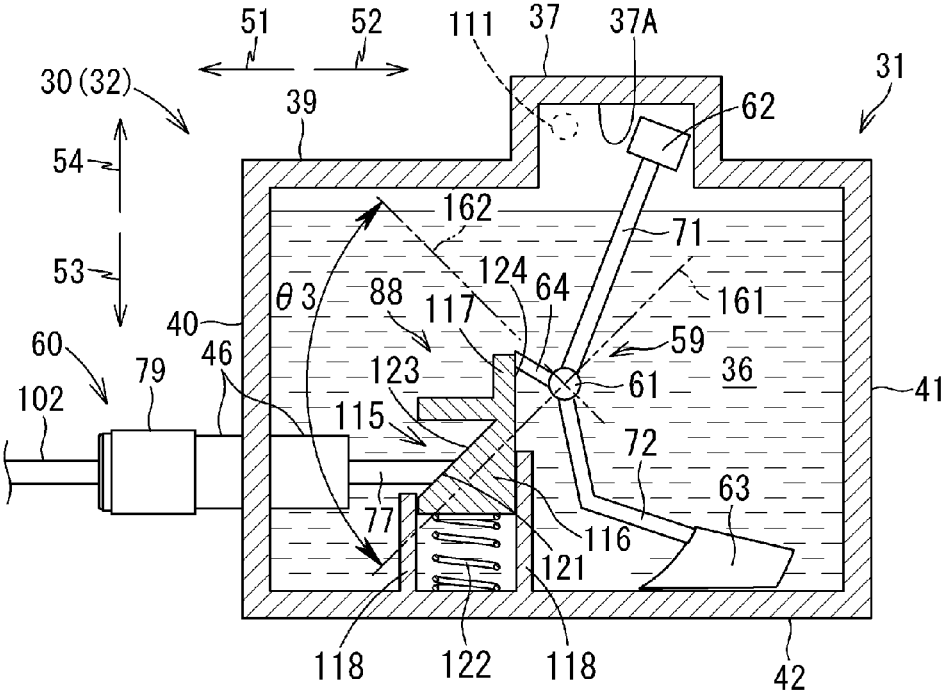
FIG. 13B is a vertical cross-sectional view depicting the ink tank in the first variation of the illustrative embodiment according to one or more aspects of the disclosure, wherein the restriction member is located at an intermediate position and the detector is located at the restricted position.

The restriction portion 64 of the detector 59 is configured to contact with the surface 124 (as an example of a restriction portion) of the projecting portion 117 of the restriction member 88 that faces the direction toward which the ink cartridge 30 is removed. As depicted in FIG. 13A, when the restriction member 88 is located at a restrict position, the restriction portion 64 is in contact with the surface 124 of the restriction member 88. In this state, the surface 124 further extends in the upward direction 54 beyond a contact position at which the restriction portion 64 is in contact with the surface 124. Therefore, when the restriction member 88 is located at a position closer to a release position than the restrict position, the surface 124 of the restriction member 88 is in contact with the restriction portion 64. For example, as depicted in FIG. 13B, the surface 124 of the restriction member 88 is still in contact with the restriction portion 64 when the restriction member 88 is located at an intermediate position. The surface 124 of the restriction member 88 keeps in contact with the restriction portion 64 when the restriction member 88 is located at any position between the restrict position and the intermediate position.

Figure 14A:
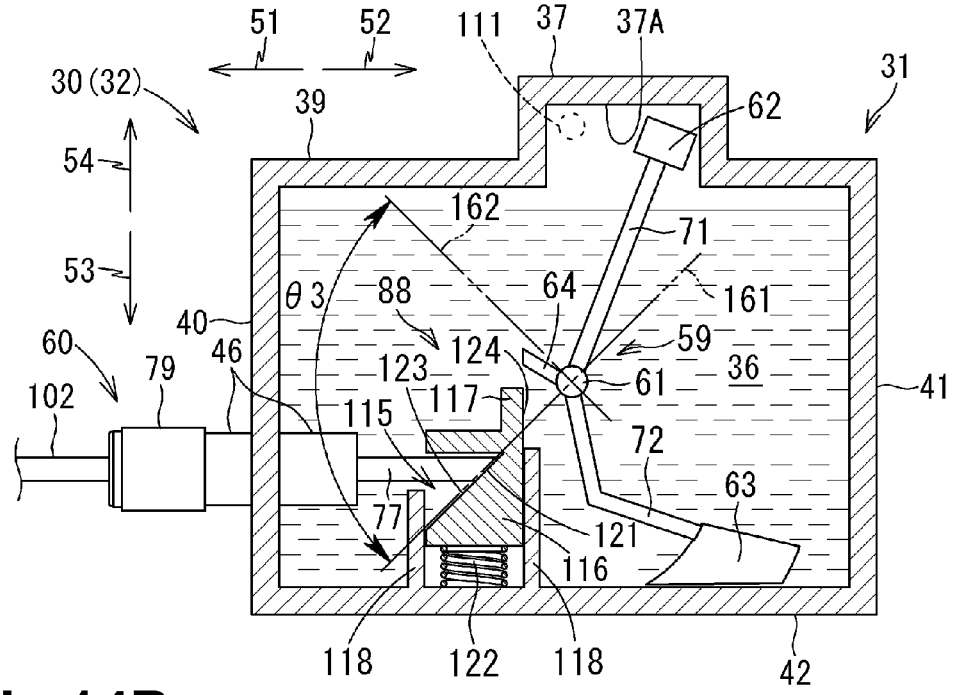
FIG. 14A is a vertical cross-sectional view depicting the ink tank in the first variation of the illustrative embodiment according to one or more aspects of the disclosure, wherein the restriction member is located at a release position and the detector is located at the restricted position.
Figure 14B:
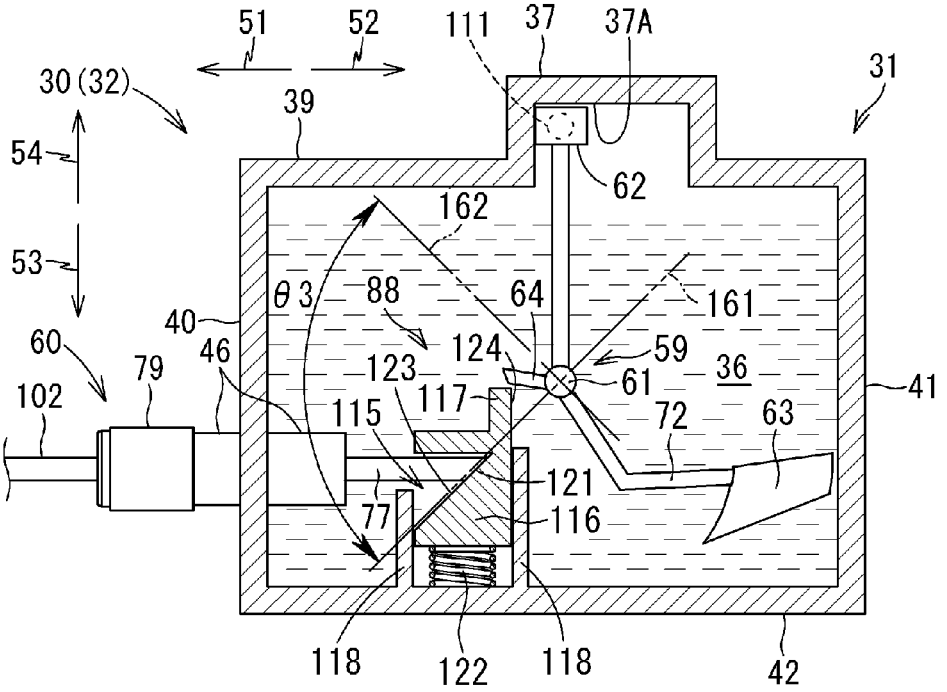
FIG. 14B is a vertical cross-sectional view depicting the ink tank in the first variation of the illustrative embodiment according to one or more aspects of the disclosure, wherein the restriction member is located at the release position and the detector is located at a released position.

When the restriction member 88 reaches a position closer to the release position than the intermediate position, as depicted in FIG. 14A, the projecting portion 117 is located lower than the restriction portion 64 and thus the surface 124 is separate from the restriction portion 64. Thus, the detector 59 is permitted to rotate from a restricted position to a released position, whereby the detector 59 rotates to the released position by a buoyant force of a float 63 of the detector 59 (refer to FIG. 14B).

Similar to the illustrative embodiment, in the first variation, a rotation angle of the detector 59 when the detector 59 rotates from the restricted position to the released position is smaller than 45°.

In the first variation, as depicted in FIGS. 13A, 13B, 14A, and 14B, when viewed in the right-left direction 5556, the entire movable range of the restriction portion 64 is included within the second rotation angle range (e.g., the range of the angle θ3).

According to the first variation, the entire movable range of the restriction portion 64 is included in the second rotation angle range. Therefore, as compared with a configuration in which a portion of the movable range of the restriction portion 64 is included in the second rotation angle range, the detector 59 may rotate more greatly while the restriction member 88 moves less distance.

According to the first variation, the rotation angle of the detector 59 from the restricted position to the released position is smaller than 45°. Therefore, the configuration in which the entire movable range of the restriction portion 64 is included in the second rotation angle range may be achieved readily.

[Second Variation]

In the illustrative embodiment, the upwardly-facing surface 93 of the restriction member 88 is configured to contact with the flat surface 80 of the restriction portion 64 from below the restriction portion 64. With this configuration, the restriction member 88 restricts the detector 59 from moving from the restricted position. Nevertheless, the configuration for restricting the rotation of the detector 59 from the restricted position using the restriction member 88 is not limited to the specific example.

Figure 15A:
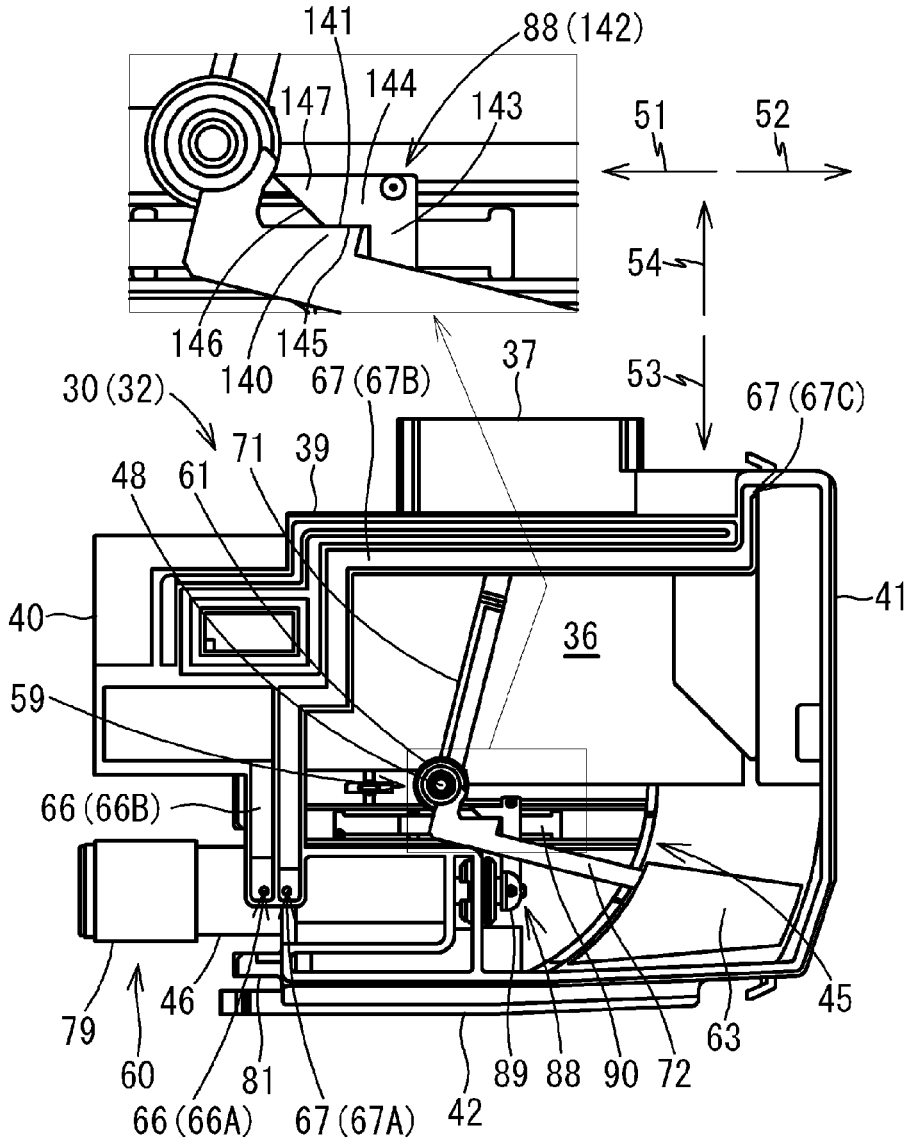
FIG. 15A is a right side view depicting an ink tank in a second variation of the illustrative embodiment according to one or more aspects of the disclosure, wherein a restriction member is located at a restrict position and a detector is located at a restricted position.

In a second variation, for example, as depicted in FIG. 15A, a downwardly-facing flat surface 145 of a restriction member 88 is configured to contact with a restriction portion 140 of a detector 59 from above. In the second variation, common parts have the same reference numerals as those of the above-described illustrative embodiment, and a description of the common parts will be omitted or briefly provided.

As depicted in FIGS. 15A, 15B, 16A, and 16B, the detector 59 includes the restriction portion 140 instead of the restriction portion 64 of the illustrative embodiment. The restriction portion 140 is disposed at a proximal end portion of a second arm 72. The restriction portion 140 and the second arm 72 constitute a one-piece component. The restriction portion 140 protrudes upward from the second arm 72. The restriction portion 140 has an upwardly-facing flat surface 141. The flat surface 141 extends both in the insertion-removal direction 5152 and in the right-left direction 5556.

The restriction member 88 includes a third portion 142 as well as the first portion 89 and the second portion 90. The third portion 142 includes a projecting portion 143, a first contact portion 144, and a second contact portion 147. The projecting portion 143 extends in the upward direction 54 from the projecting portion 91 of the second portion 90. The first contact portion 144 extends in the insertion direction 51 from the projecting portion 143 of the third portion 142. The second contact portion 147 is contiguous from an extended end of the first contact portion 144. The first contact portion 144 has a downwardly-facing flat surface 145 (as an example of first surface). The second contact portion 147 has an inclined surface 146 (as an example of a second surface). The inclined surface 146 is closer to a front wall 40 than the flat surface 145 in the insertion direction 51 and is contiguous from the flat surface 145. The flat surface 145 extends both in the insertion-removal direction 5152 and in the right-left direction 5556. The inclined surface 146 is angled relative to the insertion direction 51 and extends upward in the insertion direction 51. That is, the inclined surface 146 has a component pointing the direction toward which the ink cartridge 30 is inserted (e.g., a moving direction of the restriction member 88 from the release position to the restrict position).

Figure 15B:
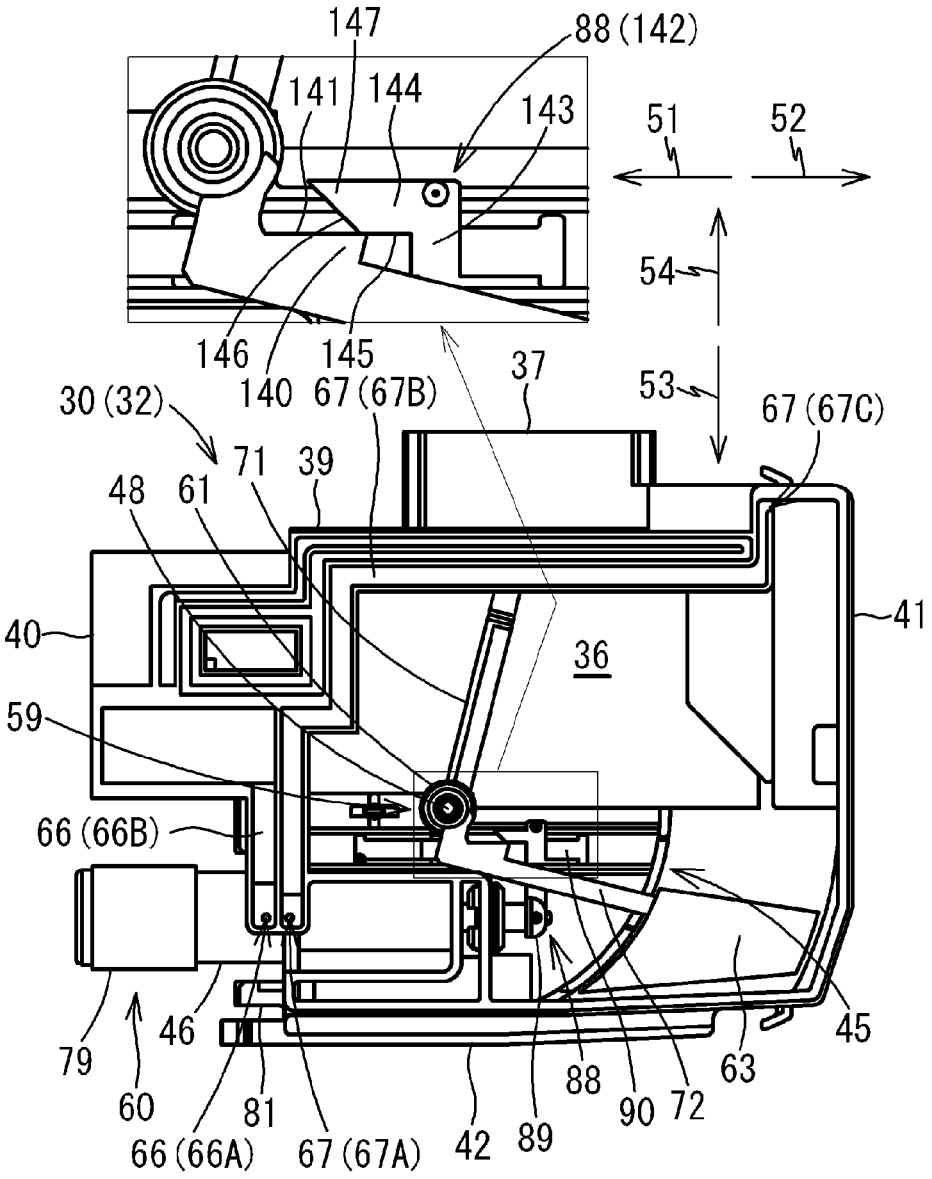
FIG. 15B is a right side view depicting the ink tank in the second variation of the illustrative embodiment according to one or more aspects of the disclosure, wherein the restriction member is located at an intermediate position and a detector is located at the restricted position.

As depicted in FIG. 15A, when the restriction member 88 is located at the restrict position, the flat surface 141 of the third portion 142 of the restriction member 88 and the flat surface 145 of the restriction portion 140 are in contact with each other. In this state, the restriction portion 140 is located within a range of 315° to 360° in the first rotation angle range (315°<θ2<360°). As the restriction member 88 moves from the restrict position to the release position in the removal direction 52, the flat surface 145 of the first contact portion 144 slides relative to the flat surface 141 of the restriction portion 140. Thus, when the restriction member 88 is located at a position between the restrict position and an intermediate position as depicted in FIG. 15B, the flat surface 141 of the restriction portion 140 and the flat surface 145 of the first contact portion 144 are in contact with each other. In a state where the flat surface 141 of the restriction portion 140 and the flat surface 145 of the first contact portion 144 are in contact with each other, the detector 59 is restricted from moving from a restricted position toward a released position.

Figure 16A:
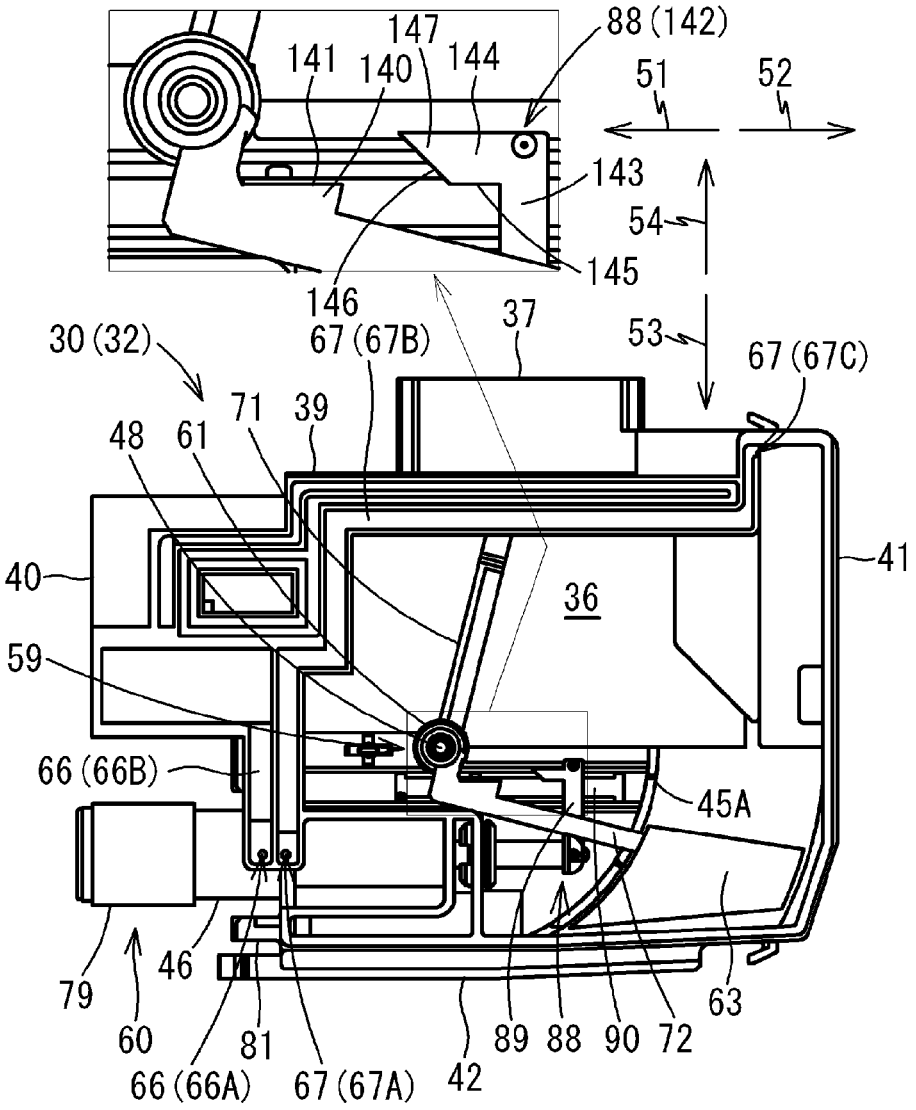
FIG. 16A is a right side view depicting the ink tank in the second variation of the illustrative embodiment according to one or more aspects of the disclosure, wherein the restriction member is located at a release position and the detector is located at the restricted position.
Figure 16B:
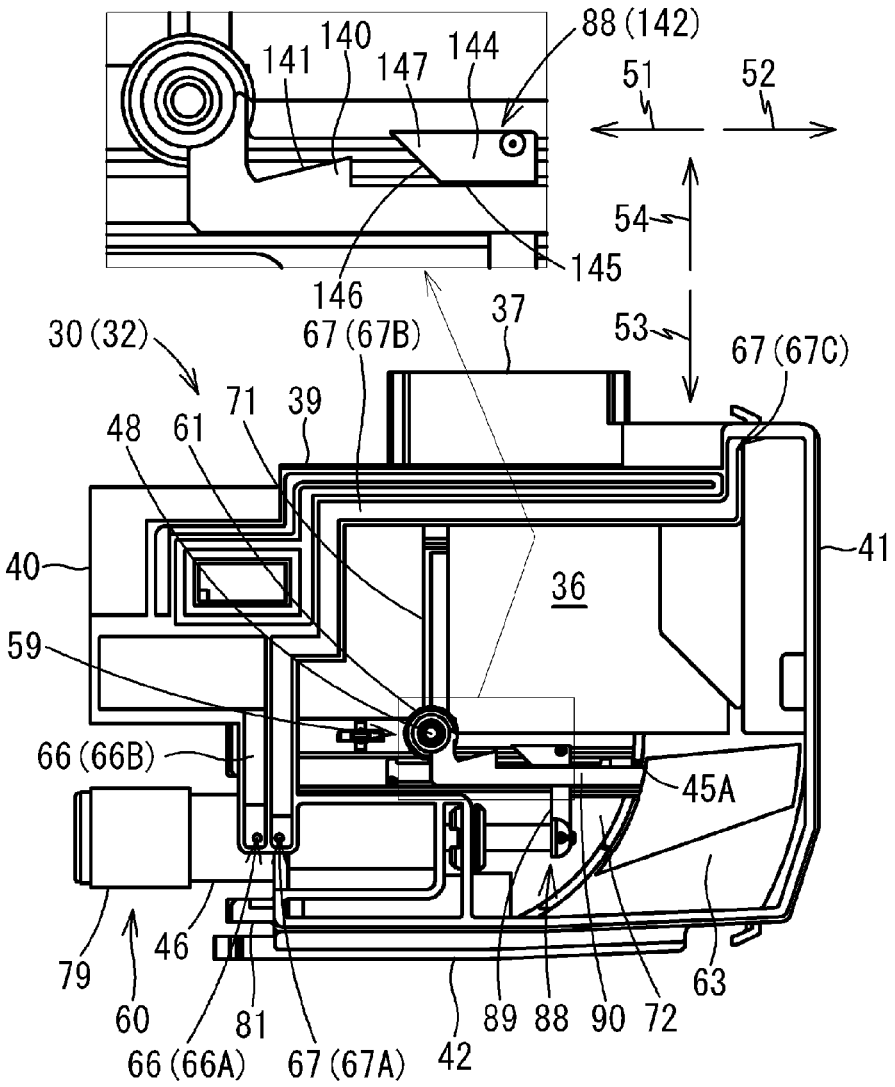
FIG. 16B is a right side view depicting the ink tank in the second variation of the illustrative embodiment according to one or more aspects of the disclosure, wherein the restriction member is located at the release position and the detector is located at a released position.

As depicted in FIG. 16A, when the restriction member 88 reaches a position between the intermediate position and the release position by its movement in the removal direction 52 toward the release position from the intermediate position, the flat surface 141 of the restriction portion 140 and the flat surface 145 of the first contact portion 144 become separate from each other. With this disengagement, the detector 59 is permitted to rotate from the restricted position to the released position, whereby the detector 59 rotates to the released position (refer to FIG. 16B). In this state, also, the restriction portion 140 is located within the range of 315° to 360° in the first rotation angle range (315°<θ2<360°).

As the restriction member 88 moves in the insertion direction 51 from the release position to the restrict position, the restriction portion 140 comes into contact with the inclined surface 146 of the first contact portion 144 and then is guided toward the flat surface 145 of the first contact portion 144 by the inclined surface 146 of the first contact portion 144. Thus, the flat surface 141 of the restriction portion 140 and the flat surface 145 of the first contact portion 144 come into contact with each other. As the restriction member 88 further moves in the insertion direction 51, the flat surface 145 of the first contact portion 144 slides relative to the flat surface 141 of the restriction portion 140. In the state where the flat surface 141 of the restriction portion 140 and the flat surface 145 of the first contact portion 144 are in contact with each other, the detector 59 is restricted from moving from the restricted position to the released position.

Similar to the illustrative embodiment, in the second variation, when viewed in the right-left direction 5556, a half or more of the movable range of the restriction portion 140 when the detector 59 moves from the restricted position to the released position is included within the second rotation angle range.

According to the second variation, the first contact portion 144 and the second contact portion 147 including the inclined surface 146 for returning the detector 59 to the restricted position are contiguous to each other. Therefore, a series of processes in which the restriction portion 140 is moved toward a blocked position through contact and sliding of the restriction portion 140 relative to the second contact portion 147 and is then retained at the blocked position by the first contact portion 144 may be performed smoothly.

[Third Variation]

Figure 17:
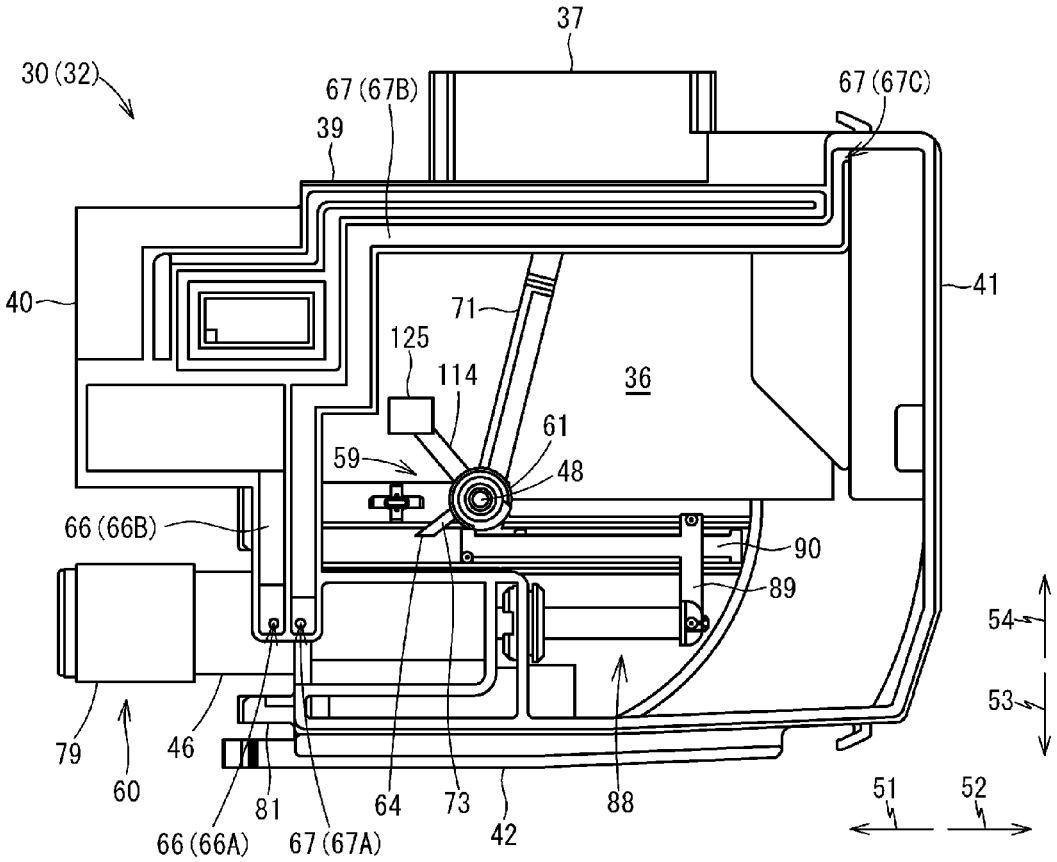
FIG. 17 is a right side view depicting an ink tank in a third variation of the illustrative embodiment according to one or more aspects of the disclosure.

In the illustrative embodiment, the detector 59 is configured to move from the restricted position to the released position using a buoyant force of the float 63. Nevertheless, in other embodiments, the detector 59 may be configured to move from the restricted position to the released position using a downward movement of a weight. In a third variation, for example, as depicted in FIG. 17, a detector 59 includes a weight 125 instead of a float 63. The detector 59 further includes a fourth arm 114 that obliquely extends upward in the insertion direction 51 from an axial portion 61. The weight 125 is disposed at a distal end of the fourth arm 114. In the third variation, the weight 125 is another example of the urging member that is configured to urge the detector 59 toward the released position.

[Fourth Variation]

Figure 18:
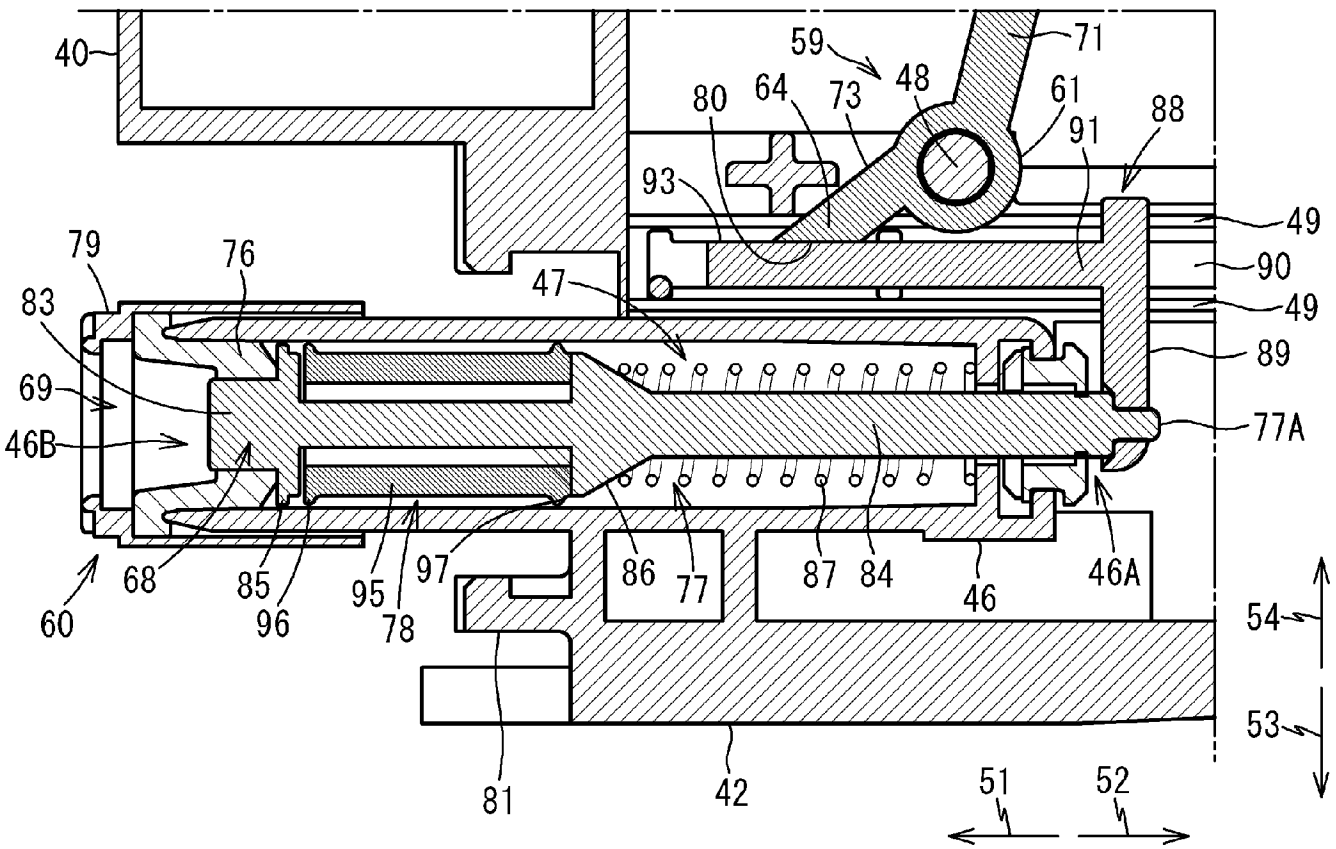
FIG. 18 is a sectional view depicting a restriction member and its surrounding components in an ink tank in a fourth variation of the illustrative embodiment according to one or more aspects of the disclosure.

In a fourth variation, for example, as depicted in FIG. 18, a restriction portion 64 has a flat surface 80 at its distal end and the flat surface 80 has a greater dimension in the insertion-removal direction 5152 than the flat surface 80 of the illustrative embodiment.

The restriction portion 64 and the projecting portion 91 are configured to contact with each other at their surfaces (e.g., the flat surface 80 and the surface 93). Therefore, according to the fourth variation, the contact area where the restriction portion 64 and the projecting portion 91 contact with each other is larger than the contact area of the illustrative embodiment. Accordingly, while the restriction member 88 moves from a restrict position toward a release position, the detector 59 may be retained at the restricted position longer than the configuration of the illustrative embodiment.

[Fifth Variation]

In the illustrative embodiment, the restriction portion 64 and the restriction member 88 both have the flat surfaces 80 and 93, respectively, and the restriction portion 64 and the restriction member 88 are configured to contact with each other at their surfaces (e.g., the flat surface 80 and the surface 93). Nevertheless, in other embodiments, for example, at least one of the restriction portion 64 and the restriction member 88 may have a flat surface. In a fifth variation, for example, a restriction member 88 has a flat surface 93 and a restriction portion 64 has a pointed tip at its distal end. In this case, the flat surface 93 of the restriction member 88 and the pointed tip of the restriction portion 64 are configured to contact with each other.

[Sixth Variation]

Figure 19:
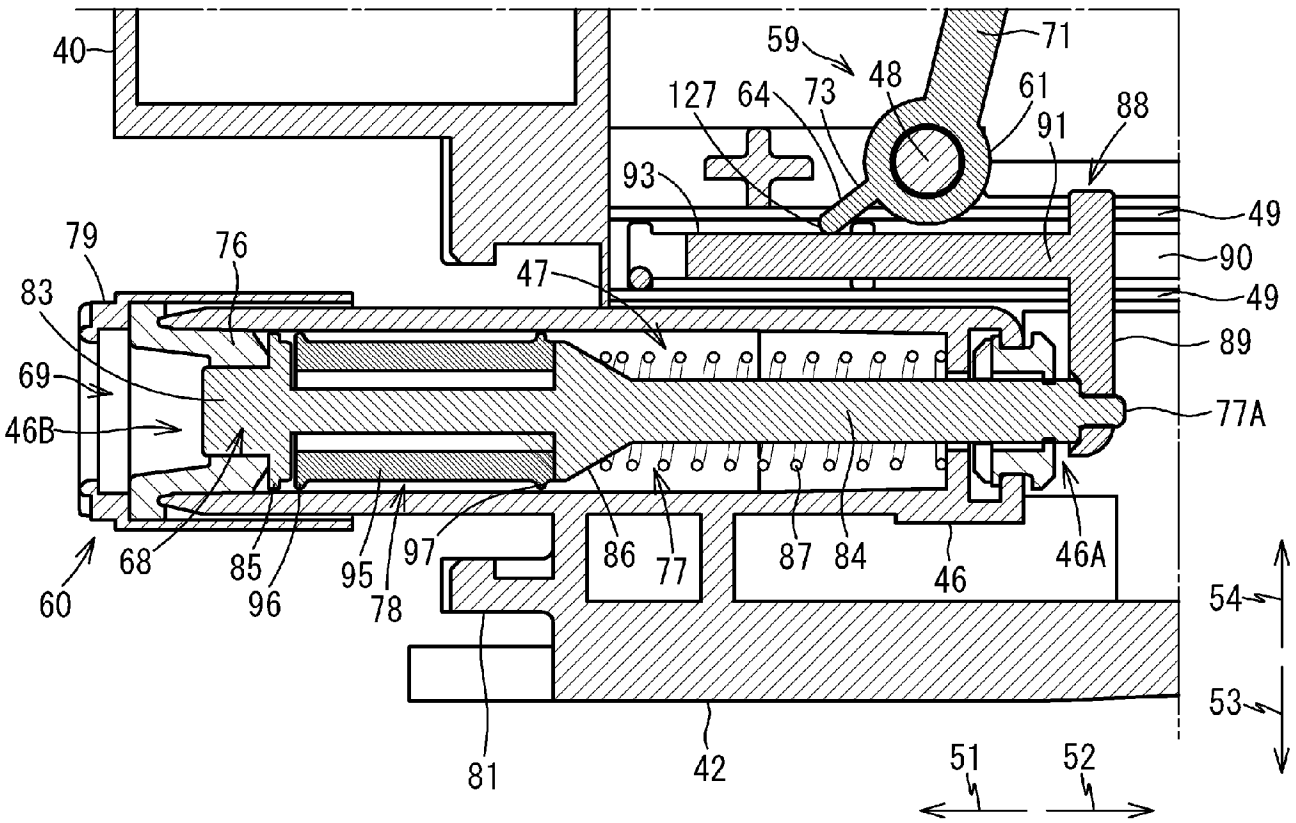
FIG. 19 is a vertical cross-sectional view depicting a restriction member and its surrounding components in an ink tank in a sixth variation of the illustrative embodiment according to one or more aspects of the disclosure.

In the illustrative embodiment, the restriction portion 64 has the flat surface 80 at its distal end. Nevertheless, for example, in a sixth variation, as depicted in FIG. 19, a restriction portion 64 has a curved surface 127 at its distal end. The curved surface 127 of the restriction portion 64 is configured to contact with a flat surface 93 of a restriction member 88. In another example, a restriction portion 64 may have a flat surface at its distal end and the flat surface extends in the insertion-removal direction 5152 while a restriction member 88 has a curved surface at a portion that may contact the restriction portion 64. That is, at least one of the restriction portion 64 and the restriction member 88 may be required to have a curved surface that is configured to contact the other of the restriction portion 64 and the restriction member 88.

According to the sixth variation, the contact area at which the restriction portion 64 and the projecting portion 91 contact with each other is smaller than the contact area of the illustrative embodiment. Therefore, a load on the restriction member 88 when the restriction member 88 moves (e.g., slides relative to the restriction portion 64) between a restrict position and a release position may be reduced.

[Seventh Variation]

Figure 25:
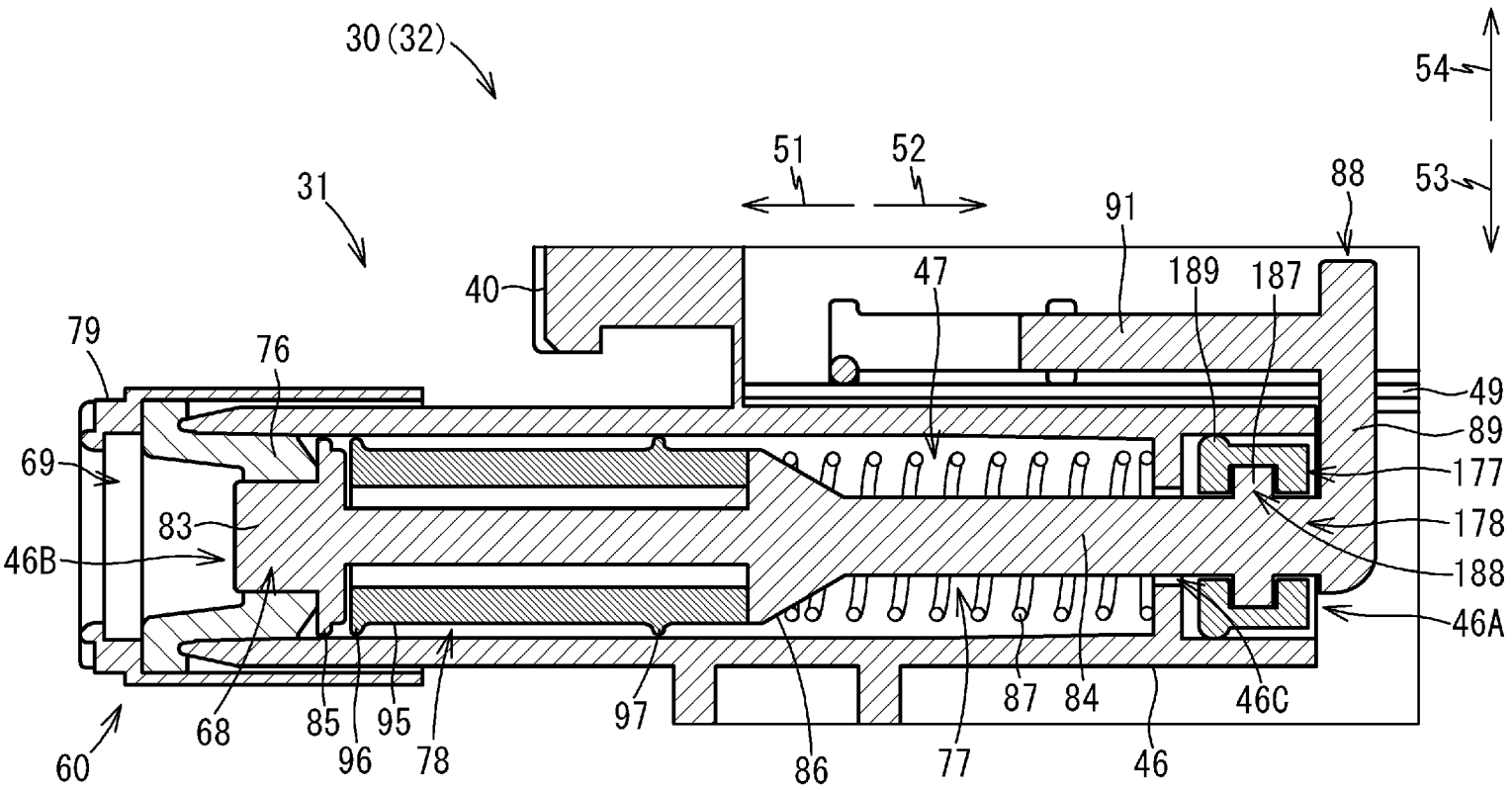
FIG. 25 is a vertical cross-sectional view depicting an ink outlet and its surrounding components in an ink tank in a seventh variation of the illustrative embodiment according to one or more aspects of the disclosure.

In the illustrative embodiment, the first sealer 177 is fixed to the ink tank 32 and the valve 77 is configured to slide relative to the first sealer 177. That is, the first sealer 177 is not movable in the illustrative embodiment. Nevertheless, in other embodiments, for example, the first sealer 177 may be movable. In a seventh variation, for example, as depicted in FIG. 25, a first sealer 177 is attached to a valve 77. In accordance with movement of the valve 77, the first sealer 177 slides relative to an ink tank 32.

In the seventh variation, common parts have the same reference numerals as those of the above-described illustrative embodiment, and a description of the common parts will be omitted or briefly provided. More specifically, components of the seventh variation other than the valve 77 and the first sealer 177 have the same or similar configuration to those of the illustrative embodiment.

The valve 77 further includes a third protrusion 187. The third protrusion 187 protrudes from a rod 84 in a diameter direction of the valve 77. The third protrusion 187 extends along a circumferential direction of the valve 77. The third protrusion 187 is spaced apart from a plurality of second protrusions 86 in the removal direction 52.

The first sealer 177 is disposed at an opening 46A. The first sealer 177 has a substantially circular cylindrical shape. The first sealer 177 has a through hole 178. The first sealer 177 has a groove 188 defined in an inner circumferential surface thereof. The groove 188 is recessed in a diameter direction of the first sealer 177 relative to the inner circumferential surface of the first sealer 177 and extends along a circumferential direction of the first sealer 177.

The third protrusion 187 is engaged with the groove 188 while the valve 77 passes through the through hole 178. As described above, the first sealer 177 is attached to the valve 77, thereby being movable with the valve 77.

The third protrusion 187 of the valve 77 has a slightly greater outside diameter than a diameter of the circular groove 188 of the first sealer 177. Therefore, the valve 77 is in pressure contact with the first sealer 177 via the third protrusion 187. Accordingly, a gap between the valve 77 and the first sealer 177 is liquid tightly closed.

The first sealer 177 further includes a third sealing portion 189. The third sealing portion 189 protrudes from an outer circumferential surface of the first sealer 177 in the diameter direction of the first sealer 177 and extends along the circumferential direction of the first sealer 177.

The third sealing portion 189 of the first sealer 177 has a slightly greater outside diameter than an inside diameter of a portion of the valve chamber 47 where the first sealer 177 is disposed. Therefore, the first sealer 177 is in pressure contact with the cylindrical wall 46 of the valve chamber 47 via the third sealing portion 189. Accordingly, a gap between the first sealer 177 and the cylindrical wall 46 (the ink tank 32) is liquid tightly closed.

A force that is greater than the force that the third sealing portion 189 of the first sealer 177 presses the inner surface of the cylindrical wall 46 may be applied to the valve 77 in one of the insertion direction 51 and the removal direction 52. The valve 77 is configured to move between a rearward position and a forward position with the first sealer 177 by application of such a force to the valve 77. That is, the first sealer 177 is fitted in the opening 46A while being allowed to move relative to the opening 46A. The first sealer 177 seals the opening 46A liquid tightly at all times when the valve 77 is located at any position, e.g., the rearward position, the forward position, or a position between the rearward position and the forward position.

According to the seventh variation, the valve 77 is configured not to move relative to the first sealer 177. Therefore, even if the valve 77 has a parting line on its outer surface, the first sealer 177 may seal the gap between the first sealer 177 and the valve 77.

[Eighth Variation]

Figure 26:
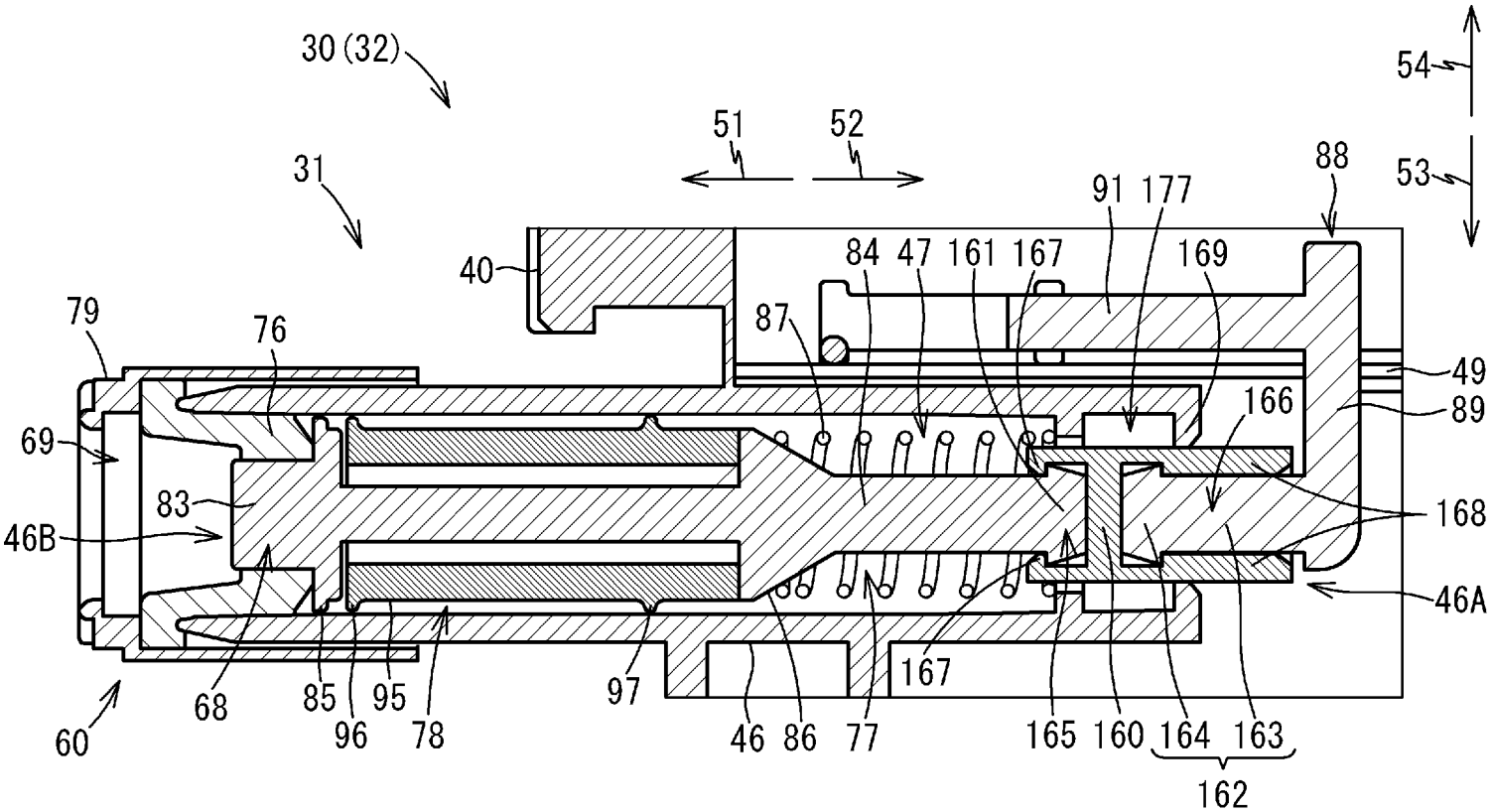
FIG. 26 is a vertical cross-sectional view depicting an ink outlet and its surrounding components in an ink tank in one example of an eighth variation of the illustrative embodiment according to one or more aspects of the disclosure.

In the illustrative embodiment and the seventh variation, the valve 77 penetrates the first sealer 177 via the through hole 178. Nevertheless, in other embodiments, for example, the valve 77 might not necessarily penetrate the first sealer 177. In an eighth variation, for example, as depicted in FIG. 26, a valve 77 does not penetrate a first sealer 177. In the eighth variation, common parts have the same reference numerals as those of the above-described illustrative embodiment, and a description of the common parts will be omitted or briefly provided. More specifically, components of the eight variation other than the valve 77, a restriction member 88, and the first sealer 177 have the same or similar configuration to those of the illustrative embodiment.

In the illustrative embodiment, the valve 77 and the restriction member 88 are directly connected with each other. Nevertheless, in one example of the eighth variation, the valve 77 and the restriction member 88 are indirectly connected with each other.

The valve 77 includes an engagement portion 161 at one end that faces the direction toward which an ink cartridge is removed. The engagement portion 161 is contiguous to a rod 84 of the valve 77. The engagement portion 161 has an outside diameter greater than the outside diameter of the rod 84.

The restriction member 88 further includes a third portion 162 as well as a first portion 89 and a second portion 90. The third portion 162 includes a projecting portion 163 and an engagement portion 164. The projecting portion 163 protrudes from a lower end portion of the first portion 89 and extends in the insertion direction 51. The projecting portion 163 includes the engagement portion 164 at its distal end. The engagement portion 164 is contiguous from the projecting portion 163. The engagement portion 164 has an outside diameter larger than the projecting portion 163.

A first sealer 177 is disposed at an opening 46A of the valve 77. The first sealer 177 has a substantially circular cylindrical shape. The first sealer 177 has a plurality of, for example, two, hollows 165 and 166. The first sealer 177 further includes a sealing portion 160 between the hollows 165 and 166 and defines a bottom of each of the hollows 165 and 166. The sealing portion 160 is configured to prevent ink from flowing forward and backward between the hollows 165 and 166.

The hollow 165 (an example of a first recess) is recessed in the removal direction 52 relative to a surface of the first sealer 177 that faces the direction toward which an ink cartridge 30 is inserted. For example, the hollow 165 is defined in the surface that faces the valve 77. The first sealer 177 includes a projection 167 that protrudes from an inner circumferential surface defining the hollow 165. The projection 167 protrudes inward in a diameter direction of the first sealer 177 and extends along a circumferential direction of the first sealer 177. The projection 167 is provided at a portion other than a deep portion of the hollow 165. The hollow 165 has a first inside diameter defined by a tip of the projection 167. The first inside diameter as an outside diameter of a rod 84 of the valve 77. The hollow 165 has a second inside diameter defined by a surface of the deep portion of the hollow 165 (e.g., the portion other than the portion where the projection 167 is provided). The second inside diameter has substantially the same size as a diameter of a large-diameter portion of the engagement portion 161.

The rod 84 and the engagement portion 161 of the valve 77 are fitted in the hollow 165. In this state, the engagement portion 161 is in engagement with the projection 167, thereby reducing or preventing disengagement of the valve 77 from the hollow 165. In the state where the valve 77 is fitted in the hollow 165, the engagement portion 161 is in contact with a back surface that defines the bottom of the hollow 165. This configuration may reduce or prevent the valve 77 from rattling in the insertion-removal direction 5152 relative to the first sealer 177.

The hollow 166 is recessed in the insertion direction 51 relative to a surface of the first sealer 177 that faces the direction toward which the ink cartridge 30 is removed. For example, the hollow 166 is defined in the surface that faces the restriction member 88. The first sealer 177 includes a projecting portion 168 that protrudes from an inner circumferential surface defining the hollow 166. The projecting portion 168 protrudes inward in the diameter direction of the first sealer 177 and extends along the circumferential direction of the first sealer 177. The projecting portion 168 is provided at a portion other than a deep portion of the hollow 166. The hollow 166 has a first inside diameter defined by a surface of the projecting portion 168. The first inside diameter has substantially the same size as a diameter of the projecting portion 163 of the third portion 162 of the restriction member 88. The hollow 166 has a second inside diameter defined by a surface of the deep portion of the hollow 165 (e.g., the portion other than the portion where the projecting portion 168 is provided). The second inside diameter has substantially the same size as a diameter of a large-diameter portion of the engagement portion 164 of the third portion 162 of the restriction member 88.

The third portion 162 of the restriction member 88 is fitted in the hollow 166. In this state, the engagement portion 164 is in engagement with an end of the projecting portion 168, thereby reducing or preventing disengagement of the third portion 162 of the restriction member 88 from the hollow 166. In the state where the third portion 162 of the restriction member 88 is fitted in the hollow 166, the engagement portion 164 is in contact with a back surface that defines the bottom of the hollow 166. This configuration may reduce or prevent the restriction member 88 from rattling in the insertion-removal direction 5152 relative to the first sealer 177. In other variations, for example, the projecting portion 168 of the first sealer 177 and the projecting portion 163 of the third portion 162 of the restriction member 88 might not necessarily be in tight contact with each other as with the example of the eighth variation. For example, a gap may be allowed to be left between the projecting portion 168 of the first sealer 177 and the projecting portion 163 of the third portion 162. In this case, ink may flow into the inside (e.g., the hollow 166) of the first sealer 177 through the gap. Nevertheless, the sealing portion 160 disposed inside the first sealer 177 may prevent ink from flowing toward a plug 83.

As described above, both the valve 77 and the restriction member 88 are connected with the first sealer 177. With this configuration, the valve 77, the restriction member 88, and the first sealer 177 are movable together in the insertion-removal direction 5152.

A cylindrical wall 46 includes a projection 169 at a concealed end thereof. The projection 169 is in contact with an outer circumferential surface of the first sealer 177. The projection 169 extends along an inner circumferential surface of the cylindrical wall 46. A projecting end (e.g., a distal end) of the projection 169 defines the opening 46A. The opening 46A has a diameter that is slightly smaller than the outside diameter of the first sealer 177. With this configuration, in a state where the first sealer 177 is fitted in the opening 46A, a gap between the first sealer 177 and the opening 46A is liquid tightly closed.

A force that is greater than the force that the projection 169 presses the first sealer 177 may be applied to the valve 77 in one of the insertion direction 51 and the removal direction 52. The valve 77 is configured to move between a rearward position and a forward position with the first sealer 177 and the restriction member 88 by application of such a force to the valve 77. That is, the first sealer 177 is fitted in the opening 46A while being allowed to move relative to the opening 46A. The first sealer 177 seals a gap between the valve 77 and the cylindrical wall 46 when the valve 77 is located at any position, e.g., the rearward position, the forward position, or a position between the rearward position and the forward position.

Figure 27:
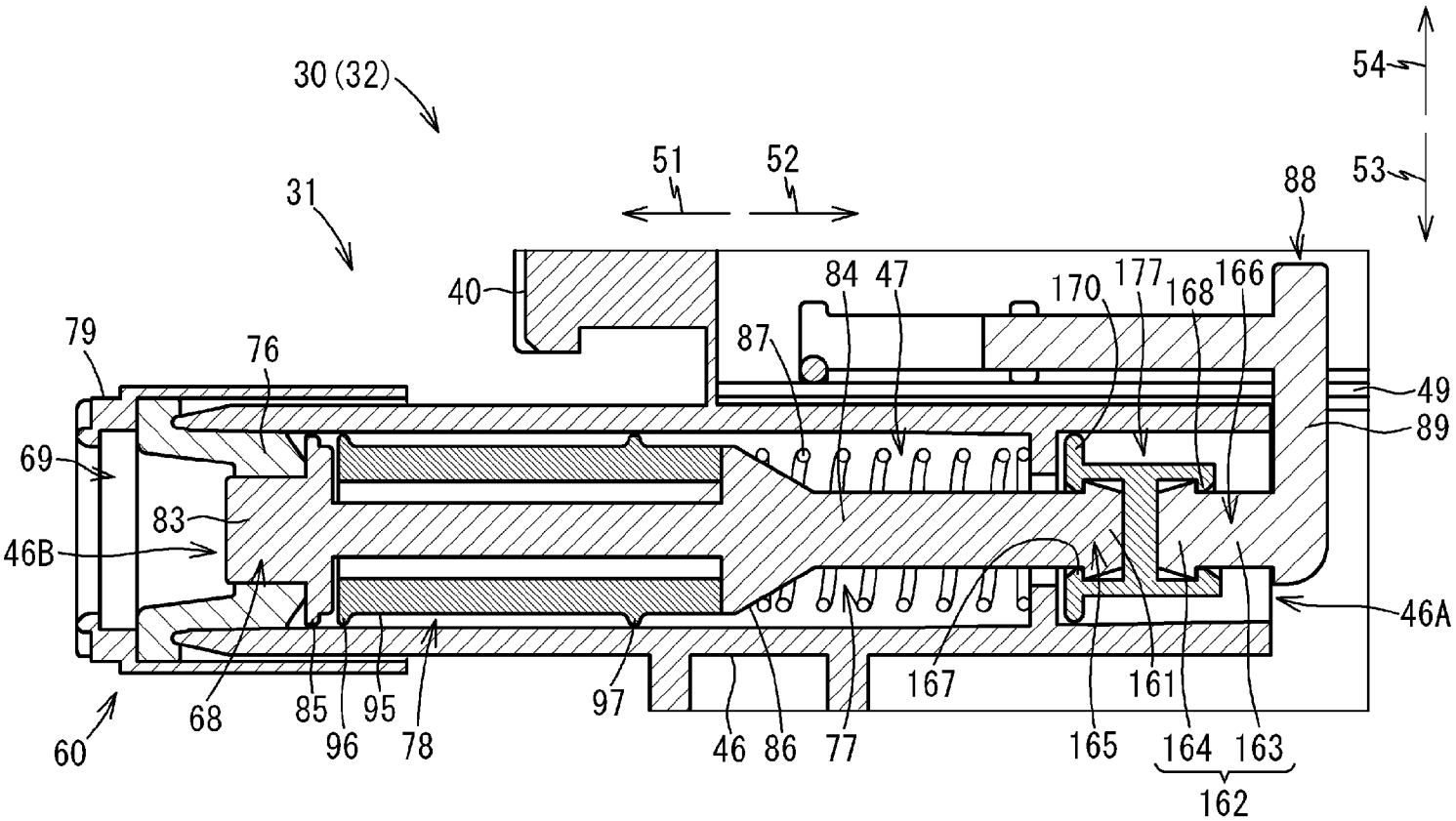
FIG. 27 is a vertical cross-sectional view depicting an ink outlet and its surrounding components in an ink tank in another example of the eighth variation of the illustrative embodiment according to one or more aspects of the disclosure.

In the example depicted in FIG. 26, the projection 169 of the cylindrical wall 46 is in pressure contact with the outer circumferential surface of the first sealer 177, thereby liquid tightly sealing the gap between the first sealer 177 and the opening 46A. Nevertheless, in another example of the eighth variation, as depicted in FIG. 27, a first sealer 177 includes another sealing portion 170 at an outer circumference surface thereof. The sealing portion 170 is in pressure contact with the inner surface of the cylindrical wall 46, thereby liquid tightly sealing a gap between the first sealer 177 and the opening 46A.

According to the eighth variation, the restriction member 88 and the valve 77 are connected with each other indirectly (e.g., via the first sealer 177). Therefore, this configuration may reduce or prevent leakage of ink to the outside of the ink cartridge 30 along the valve 77 from the restriction member 88.

[Ninth Variation]

In the illustrative embodiment, the restriction member 88 is configured to be movable in the insertion-removal direction 5152. Nevertheless, the moving direction of the restriction member 88 is not limited to the insertion-removal direction 5152.

Figure 28:
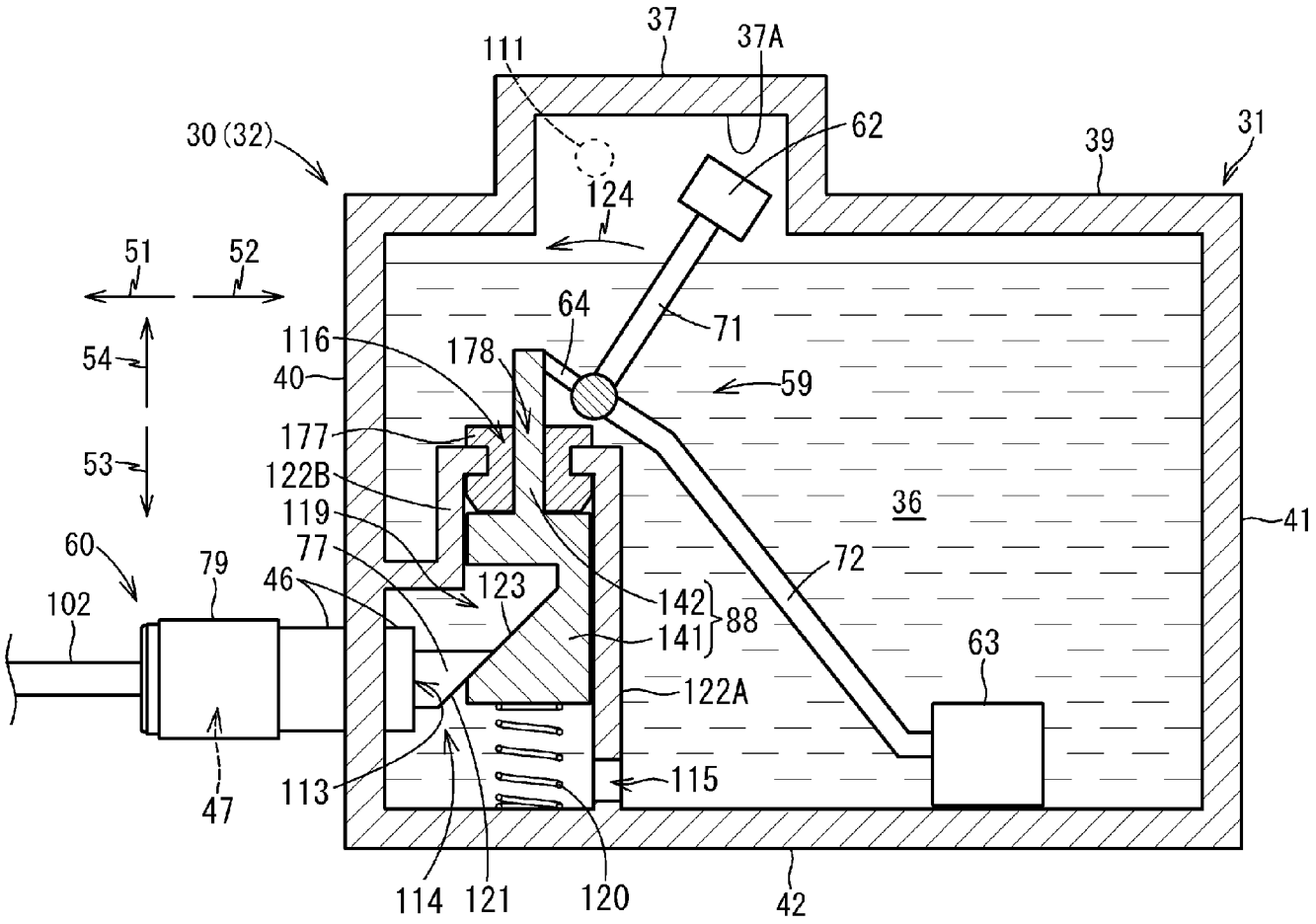
FIG. 28 is a vertical cross-sectional view depicting an ink tank in a ninth variation of the illustrative embodiment according to one or more aspects of the disclosure, wherein a valve is located at a forward position, a restriction member is located at a restrict position, and a detector is located at a restricted position.
Figure 29:
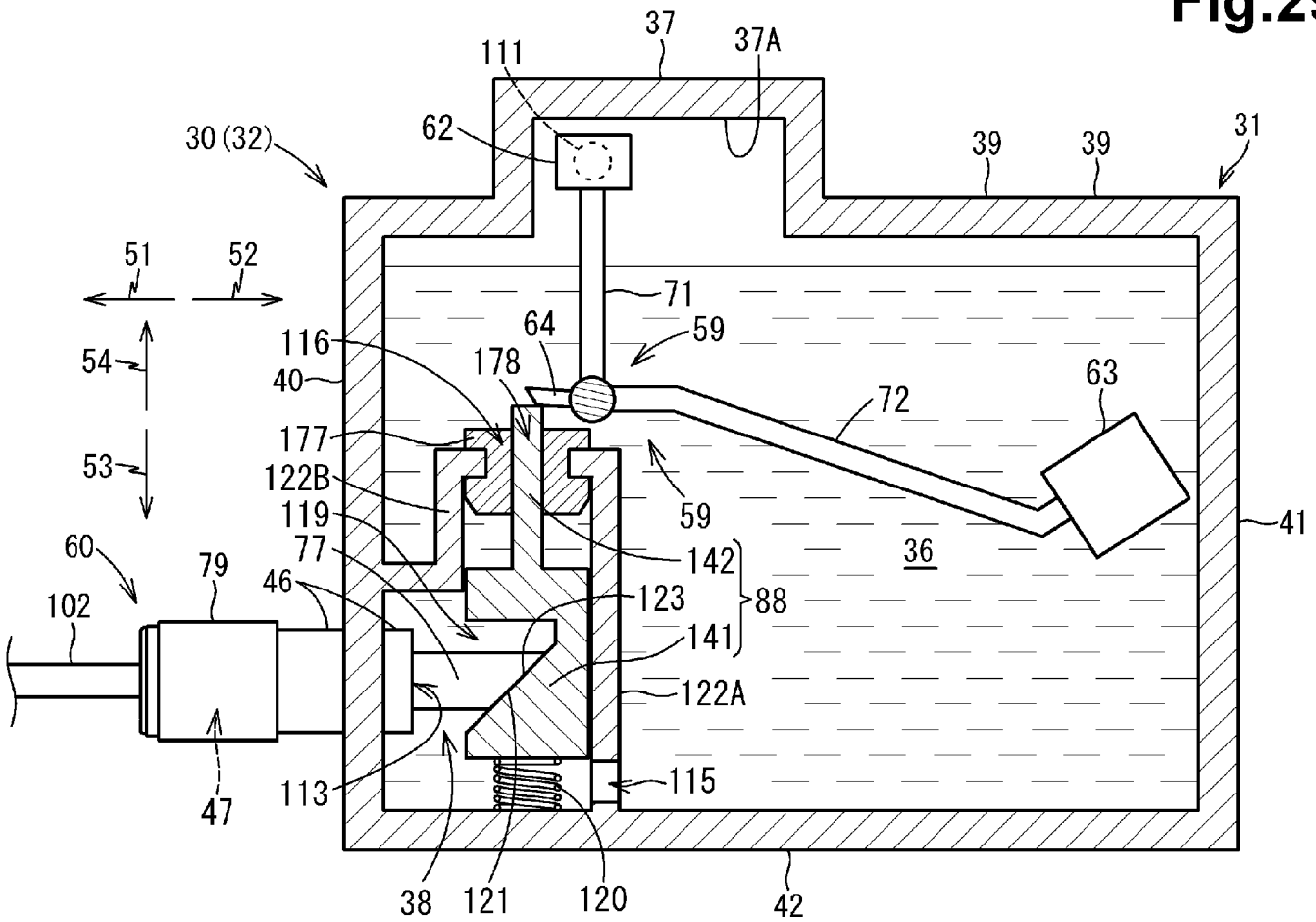
FIG. 29 is a vertical cross-sectional view depicting the ink tank in the ninth variation of the illustrative embodiment according to one or more aspects of the disclosure, wherein the valve is located at a rearward position, the restriction member is located at a release position, and the detector is located at a released position.

For example, as depicted in FIGS. 28 and 29, a restriction member 88 may be movable in the up-down 5453. In a ninth variation, common parts have the same reference numerals as those of the above-described illustrative embodiment, and a description of the common parts will be omitted or briefly provided.

An ink tank 32 includes a second ink chamber 38 at a lower front end portion therein. In the ninth variation, the second ink chamber 38 is another example of an inner space as well as the valve chamber 47. The second ink chamber 38 is defined by a front wall 40, a lower wall 42, a first inner wall 43, a guide member 122A, a guide member 122B, and a film thermally adhered to a frame 31 of an ink cartridge 30. The guide member 122A protrudes upward from the lower wall 42. The guide member 122B protrudes from the front wall 40 in the removal direction 52 and extends upward. In FIGS. 28 and 29, the first inner wall 43 is omitted.

The guide member 122A has a through hole 115 at its lower end portion. The through hole 115 provides communication between a first ink chamber 36 and the second ink chamber 38.

The guide member 122A and the guide member 122B define a through hole 116. The through hole 116 is located higher than the through hole 115. The through hole 116 provides communication between the first ink chamber 36 and the second ink chamber 38. The through hole 116 is attached with a first sealer 177. The first sealer 177 is attached to the through hole 116 in a similar manner to the first sealer 177 that is attached to the opening 46A in the illustrative embodiment. Therefore, in a state where the first sealer 177 is attached to the through hole 116, a gap between the first sealer 177 and the through hole 116 is liquid tightly closed.

The cylindrical wall 46 of the ink outlet 60 is fixed to the front wall 40 defining the second ink chamber 38. The cylindrical wall 46 has a through hole 113 at its concealed end. The through hole 113 provides communication with the valve chamber 47 (e.g., the internal space of the cylindrical wall 46) and the second ink chamber 38.

As depicted in FIGS. 28 and 29, the valve 77 and the restriction member 88 are separate components.

The valve 77 passes through the through hole 113. Thus, an end 117 of the valve 77 protrudes to the second ink chamber 38 beyond the valve chamber 47. The valve 77 has an outside diameter smaller than a diameter of the through hole 113. Therefore, ink is allowed to flow between the second ink chamber 38 and the valve chamber 47.

In the illustrative embodiment, the second ink chamber 38, which is in communication with the first ink chamber 36, has the through hole 176, and the through hole 176 provides communication between the first chamber 36 and the valve chamber 47 (e.g., the internal space of the cylindrical wall 46). Nevertheless, as described in the ninth variation, the wall (e.g., the guide member 122A) that partitions space of the ink tank 32 into the first ink chamber 36 and the second ink chamber 38 (e.g., the internal space) and supports the first sealer 177 may have the through hole 115 that penetrates therethrough.

The valve 77 includes an inclined surface 121 at the end 117. The inclined surface 121 is angled relative to the removal direction 52 and extends upward in the removal direction 52.

The valve 77 is movable between a forward position and a rearward position in the insertion-removal direction 5152 similar to the illustrative embodiment.

The restriction member 88 is supported by the lower wall 42 via a coil spring 120. The coil spring 120 is disposed between the restriction member 88 and the lower wall 42 in the up-down direction 5453. The coil spring 120 has one end (e.g., an upper end) that is connected with a lower end of the restriction member 88. The coil spring 120 has the other end (e.g., a lower end) that is connected with the lower wall 42. The restriction member 88 includes a body 141 and a projecting portion 142. The body 141 is connected with the coil spring 120. The projecting portion 142 protrudes from the body 141 in the upward direction 54. The projecting portion 142 of the restriction member 88 is located higher than the valve 77.

The body 141 is surrounded by the guide member 122A, the guide member 122B, the first inner wall 43, and the film. The guide member 122A is disposed next to the body 141 in the insertion direction 51. The guide member 122B is disposed next to the body 141 in the removal direction 52. The first inner wall 43 is disposed to the left of the body 141. The film is disposed to the right of the body 141. With this configuration, while the restriction member 88 is movable up and down along the guide members 122A and 122B, the first inner wall 43, and the film, the restriction member 88 is permitted to move only within backlash or play in the insertion-removal direction 5152 and in the rightward-leftward direction 5556.

The body 141 has a cavity 119 that is recessed in the removal direction 52 relative to a surface that faces the front wall 40. The cavity 119 is defined by at least an inclined surface 123. The inclined surface 123 is angled relative to the removal direction 52 and extends upward in the removal direction 52. The inclined surface 123 of the cavity 119 of the restriction member 88 and inclined surface 121 of the valve 77 are in contact with each other.

Through the contact of the inclined surface 123 and the inclined surface 121 with each other, the horizontal movement of the valve 77 (e.g., the movement in the insertion-removal direction 5152) is changed to an up-down movement (e.g., movement in the up-down direction 5453 and is transmitted to the restriction member 88.

The projecting portion 142 penetrates the first sealer 177 via the through hole 178 in a similar manner to the valve 77 that penetrates the first sealer 177 via the through hole 178 in the illustrative embodiment. The projecting portion 142 has an outside diameter slightly greater than a diameter of the through hole 178, thereby liquid tightly closing the through hole 178.

As described above, while the through hole 178 is sealed, the gap between the first sealer 177 and the through hole 116 is also sealed. Accordingly, the first sealer 177 seals a gap between the guide member 122B, which may be a portion of the ink tank 32, and the restriction member 88.

A restriction portion 64 of a detector 59 is capable of contacting a surface (e.g., a rear surface) of the projecting portion 142 that faces the direction toward which the ink cartridge 30 is removed.

The restriction member 88 is movable between a restrict position (e.g., a position of the restriction member 88 depicted in FIG. 28) and a release position (e.g., a position of the restriction member 88 depicted in FIG. 29). The release position is lower than the restrict position. When the valve 77 is located at the forward position, the restriction member 88 is located at the restrict position. When the valve 77 is located at the rearward position, the restriction member 88 is located at the release position. As the valve 77 moves from the forward position to the rearward position, the restriction member 88 moves from the restrict position to the release position. As the valve 77 moves from the rearward position to the forward position, the restriction member 88 moves from the release position to the restrict position.

When the restriction member 88 is located at the restrict position, the rear surface of the projecting portion 142 is in contact with the restriction portion 64. Thus, the detector 59 is restricted from rotating in a direction of an arrow 124 (refer to FIG. 28) from the restricted position. Nevertheless, the restriction member 88 might not necessarily restrict rotation of the detector 59 in a direction opposite to the direction of the arrow 124 (e.g., a clockwise direction in FIG. 28) from the restricted position.

As the restriction member 88 moves toward the release position from the restrict position, the projecting portion 142 separates from the restriction portion 64 and moves below the restriction portion 64. This disengagement of the projecting portion 142 and the restriction portion 64 allows the detector 59 to rotate in the direction of the arrow 124. That is, the detector 59 is allowed to rotate from the restricted position to the released position.

In a state depicted in FIG. 28, the valve 77 is located at the forward position. In a state where the valve 77 is located in the forward position, the inclined surface 121 of the valve 77 is in contact with the inclined surface 123 of the restriction member 88 to retain the restriction member 88 at the restrict position. In a state where the restriction member 88 is located at the restrict position, the projecting portion 142 is in contact with the restriction portion 64 of the detector 59 to restrict rotation of the detector 59 from the restricted position to the released position.

In the state depicted in FIG. 28, as the valve 77 moves in the removal direction 52 toward the rearward position from the forward position, the inclined surface 121 of the valve 77 presses the inclined surface 123 of the restriction member 88. Therefore, the restriction member 88 moves in the downward direction 53 toward the release position from the restrict position against an urging force of the coil spring 120. The movement of the restriction member 88 in the downward direction 53 causes disengagement of the projecting portion 142 from the restriction portion 64. Thus, the detector 59 becomes free to rotate from the restricted position toward the released position (e.g., in the direction of the arrow 124). Thus, the detector 59 rotates in the direction of the arrow 124 by a buoyant force of a float 63 to move from the restricted position to the released position (refer to FIG. 29).

In a state depicted in FIG. 29, as the valve 77 moves in the insertion direction 51 from the rearward position to the forward position, the restriction member 88 moves in the upward direction 54 by the urging force of the coil spring 120. Therefore, pressing of the restriction portion 64 by the projecting portion 142 causes rotation of the detector 59 in the direction opposite to the direction of the arrow 124. Accordingly, the detector 59 rotates from the released position to the restricted position (refer to FIG. 28).

According to the ninth variation, the horizontal movement of the valve 77 is changed to the up-down movement of the restriction member 88 through the contact of the body 141 of the restriction member 88 and the end 117 of the valve 77 with each other. Therefore, a less space may be required for moving the valve 77 in the horizontal direction.

[Other Variations]

In the illustrative embodiment, the detection portion 62 is always located within the first ink chamber 36 irrespective of the position of the detector 59. Nevertheless, in other variations, for example, a detection portion 62 may have another configuration as long as the detector 59 is configured to block light outputted from the light emitting portion of the sensor 103 to the light receiving portion of the sensor 103 when the detector 59 is located at the released position. In one example, a detection portion 62 may be configured to be located outside the first ink chamber 36 when the detector 59 is located at the restricted position. The detection portion 62 may be further configured to enter the inside of the first ink chamber 36 while a detector 59 moves from the restricted position to the released position. In still other variations, a detection portion 62 may be located outside of the first ink chamber 36 at all times irrespective of the position of a detector 59.

In the illustrative embodiment, the measurement of the moving time of the detector 59 is started when the ink cartridge 30 is completely placed at a particular portion in the cartridge holder 110 (e.g., when the cartridge sensor 107 outputs a high-level signal). Through use of the existing sensor (e.g., the cartridge sensor 107), the processing for estimating the ink viscosity may be implemented without changing the configuration of the ink supply unit 100 significantly. Nevertheless, in other variations, for example, the measurement of the moving time of the detector 59 may be started at any arbitrary timing that the controller 130 may detect.

Figure 20A:
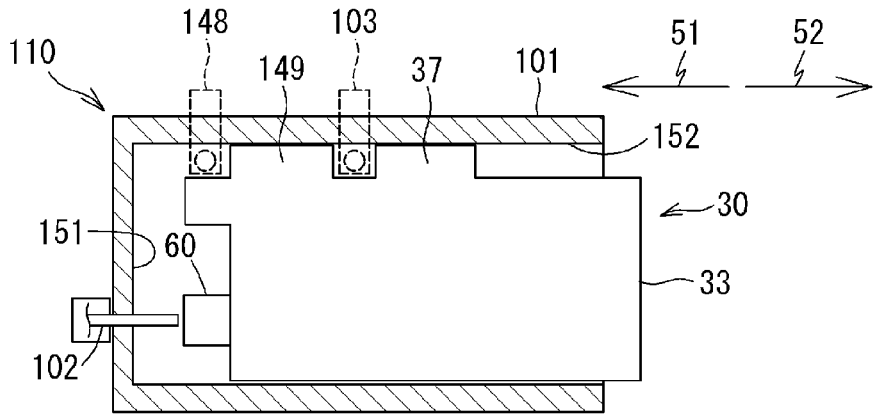
FIGS. 20A and 20B are vertical cross-sectional views each depicting a cartridge holder including a plurality of sensors, and an ink cartridge including a plurality of raised portions in another variation of the illustrative embodiment according to one or more aspects of the disclosure.
Figure 20B:
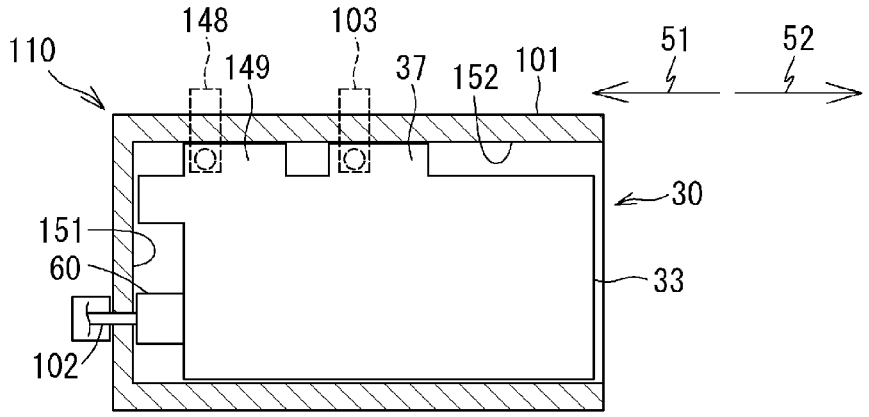

In one example, as depicted in FIGS. 20A and 20B, a cartridge holder 110 may further include another sensor 148 in addition to a sensor 103. The sensor 148 may be disposed at an inner top surface 152 of a casing 101 of the cartridge holder 110. The sensor 148 may be disposed closer to the inner back surface 151 than the sensor 103. An ink cartridge 30 may further include another raised portion 149 at an cartridge cover 30 in addition to a light-transparent raised portion 37. The raised portion 149 may be made of material capable of blocking light. The raised portion 149 may be configured to block light outputted from a light emitting portion in the same or similar manner to the detection portion 62 of the illustrative embodiment. The raised portion 149 may be spaced from the raised portion 37 in the insertion direction 51. The controller 130 may start counting for measuring a moving time of a detector 59 when the sensor 148 is covered by the light-blocking raised portion 149 (e.g., when an ink cartridge 30 reaches a position of FIG. 20B from a position of FIG. 20A). The controller 130 may end the counting for measuring the moving time of the detector 59 when the sensor 103 is covered by a detection portion 62. In this case, four sensors 148 may be provided for four ink cartridges 30 similar to the illustrative embodiment.

Figure 21A:
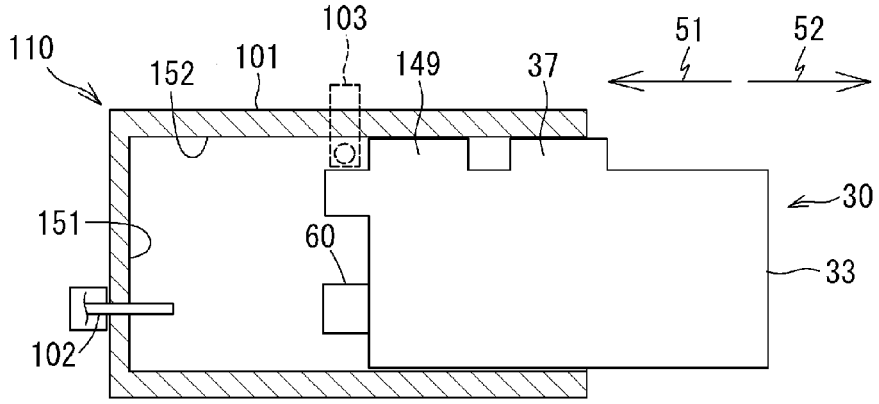
FIGS. 21A, 21B, and 21C are vertical cross-sectional views each depicting a cartridge holder including a sensor and an ink cartridge including a plurality of raised portions in still another variation of the illustrative embodiment according to one or more aspects of the disclosure.
Figure 21B:
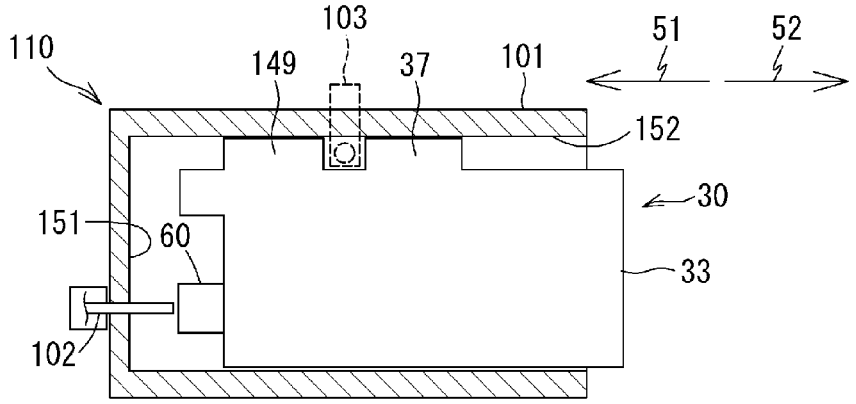
Figure 21C:
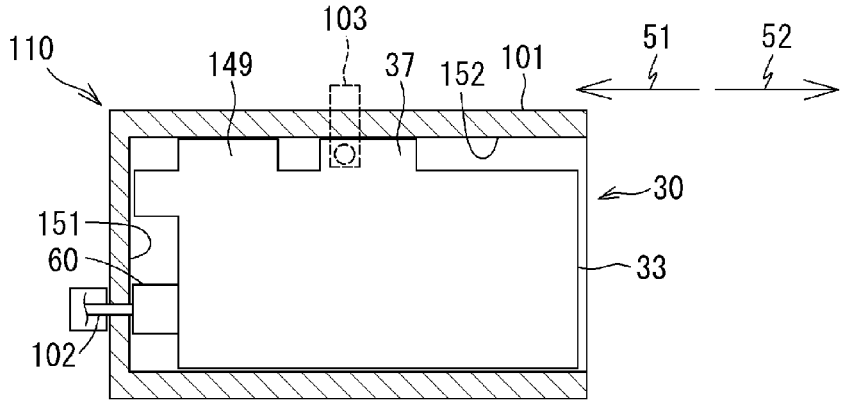

In another example, as depicted in FIGS. 21A, 21B, and 21C, an ink cartridge 30 may further include another raised portion 149 at a cartridge cover 33 in addition to a light-transparent raised portion 37. The raised portion 149 may be made of material capable of blocking light. The raised portion 149 may be configured to block light outputted from a light emitting portion in the same or similar manner to the detection portion 62 of the illustrative embodiment. The raised portion 149 may be spaced from the raised portion 37 in the insertion direction 51. The controller 130 may start counting for measuring a moving time of a detector 59 when the sensor 103 is revealed after the sensor 103 is covered by the light-blocking raised portion 149 (e.g., when an ink cartridge 30 reaches a position of FIG. 21B from a position of FIG. 21A). The controller 31 may end the counting for measuring the moving time of the detector 59 when the sensor 103 is covered by a detection portion 62. At the time of ending the counting for measuring the moving time of the detector 59, the ink cartridge 30 is located at a position of FIG. 21C. In this case, four sensors 148 may be provided for four ink cartridges 30 similar to the illustrative embodiment.

In the illustrative embodiment, when the controller 130 determines that the moving time is out of the threshold range (e.g., NO in step S18), the operation of the recording head 21 is restricted, e.g., the routine skips step S36. Therefore, this control may reduce or prevent an occurrence of a problem in the recording head 21 due to ejection of ink whose viscosity has been greatly changed. Nevertheless, the processing of step S36 might not necessarily be skipped. In one example, the controller 130 may execute the processing of notifying an abnormality of the ink viscosity (e.g., step S37) and it may be left up to a user to determine whether to proceed to operate the recording head 21. In this case, the control routine of the controller 130 may be different from the control routine of FIGS. 9, 10, and 11 of the illustrative embodiment. However, a detailed description for this example will be omitted.

In another example, when the controller 130 determines that the abnormal flag is "ON" (e.g., YES in step S32), the controller 130 may control the head control board 21A to control the level of a drive voltage to be applied to the piezoelectric elements 29A for the nozzles 29 in the image recording of step S36 without skipping the processing of steps S35 and S36.

More specifically, the controller 130 may change a control signal to be outputted to the head control board 21A to control the level of a drive voltage to be applied to the piezoelectric elements 29A such that the amount of ink to be ejected from each nozzle 29 is substantially the same in both of a case in which the moving time is included within the threshold range and a case in which the moving time is out of the threshold range. For example, when the moving time is below the lower limit of the threshold range (e.g., when the ink viscosity is too low), the controller 130 may control the level of the drive voltage to be applied to the piezoelectric elements 29A to be lower than the level of the drive voltage to be applied when the moving time is included within the threshold range. When the moving time exceeds the upper limit of the threshold range (e.g., when the ink viscosity is too high), the controller 130 may control the level of the drive voltage to be applied to the piezoelectric elements 29A to be higher than the level of the drive voltage to be applied when the moving time is included within the threshold range.

According to the above configuration, in a case where various types of ink cartridges 30 each storing ink having viscosity different from one another are placed simultaneously in the cartridge holder 110, a drive voltage having an appropriate level may be applied to each of the piezoelectric elements 29A in accordance of the ink type. In the illustrative embodiment, the plurality of piezoelectric elements 29A is used as an example of an actuator. Nevertheless, in other variations, for example, a thermal actuator may be used. In this case, the thermal actuator may be configured to generate air bubbles in ink by heat and cause the nozzles 29 to eject ink therefrom.

The viscosity of ink stored in an ink cartridge 30 may change under the influence of the temperature surrounding the ink cartridge 30. More specifically, the ink viscosity tends to become lower with higher temperature and become higher with lower temperature. In the illustrative embodiment, the controller 130 controls the head control board 21A to control the level of drive voltage to be applied to the piezoelectric elements 29A in accordance with the temperature. More specifically, when the ambient temperature is relatively high, the controller 130 outputs a particular control signal to the head control board 21A such that a relatively low drive voltage is applied to the piezoelectric elements 29A. When the ambient temperature is relatively low, the controller 130 outputs another control signal to the head control board 21A such that a relatively high drive voltage is applied to the piezoelectric elements 29A. There is an optimal threshold of ink viscosity corresponding to drive voltage to be applied to the piezoelectric elements 29A. Therefore, it may be preferable that the threshold range of ink viscosity may be determined in accordance with the temperature. In the illustrative embodiment, an appropriate threshold range is determined in accordance with the temperature. The manner of determining an appropriate threshold range is not limited to the specific example. In one example, a threshold range appropriate for the temperature may be selected from a plurality of threshold ranges prestored in the ROM 132. In another example, an upper limit or a lower limit of the threshold range may be calculated using a function using the temperature as an input parameter. In other variations, a drive voltage to be applied to the piezoelectric element 29A might not be controlled in accordance with the temperature. In this case, the processing of step S17 in which the threshold range is determined based on a signal outputted from the temperature sensor 106 may be omitted, and a fixed threshold range may be used.

In the illustrative embodiment, the controller 130 measures the moving time of the detector 59 by counting. More specifically, the controller 130 starts counting in response to output of a high-level signal from the cartridge sensor 107 and ends the count of the measurement in response to output of a low-level signal from the sensor 103. Then, the controller 130 determines the time elapsed from the start of the count to the end of the count as the moving time of the detector 59. Nevertheless, in other variations, for example, a controller 130 may determine by taking a difference between the time at which the cartridge sensor 107 outputs a high-level signal and the time at which the sensor 103 outputs a low-level signal as the moving time of the detector 59.

In the illustrative embodiment, the controller 130 stores the abnormal flag in the EEPROM 134. Nevertheless, in other variations, for example, a controller 130 may store the abnormal flag in a memory of an integrated circuit mounted on an ink cartridge 30. In the illustrative embodiment, the controller 130 includes both the CPU 131 and the ASIC 135. Nevertheless, in other variations, a controller 130 may include an ASIC 135 only. All processing of FIGS. 9, 10, and 11 may be executed by a CPU 131 that reads appropriate programs from the ROM 132. In still other variations, a controller 130 may include hardware only, for example, an ASIC 135 or a field-programmable gate array ("FPGA") but not include a CPU 131. In yet other variations, a controller 130 may include a plurality of CPUs 131 and/or a plurality of ASICs 135.

In the illustrative embodiment, ink is used as an example of liquid. Nevertheless, in other variations, a pretreatment liquid to be ejected onto a recording sheet prior to ink ejection at the time of printing may be used as an example of the liquid, instead of ink.

What is claimed is:

1. A liquid cartridge comprising:

a chamber configured to store liquid therein;

a liquid outlet configured to supply the liquid from an interior of the chamber to an exterior of the chamber;

a detector positioned in the chamber, the detector being rotatable between a released position and a restricted position, the detector comprising a detection portion and a restriction portion having a first contact surface defining a first linear length; and a restriction member comprising a second contact surface which is parallel to the first contact surface, the second contact surface defining a second linear length greater than the first linear length, the restriction member being movable straightly between a first position in which the first and second contact surfaces contact one another, a second position in which the first and second contact surfaces do not contact one another, and a third position between the first and second positions in which the first and second contact surfaces contact one another;

wherein the restriction member is configured to restrict a movement of the detector as the restriction member moves from the first position toward the second position.

2. The liquid cartridge according to claim 1, wherein the first contact surface is configured to slide relative to the second contact surface when the restriction member moves between the first position and the second position.

3. The liquid cartridge according to claim 1, wherein at least one of the first and second contact surfaces extends parallel to a movement direction of the restriction member.

4. The liquid cartridge according to claim 1, wherein the first contact surface has a curved surface.

5. The liquid cartridge according to claim 1, wherein the first contact surface has a first flat surface and the second contact surface has a second flat surface configured to contact the first flat surface.

6. The liquid cartridge according to claim 1, wherein the first contact surface is configured to contact the second contact surface to move the detector toward the restricted position as the restriction member moves from the second position to the first position.

7. The liquid cartridge according to claim 1, wherein the restriction member includes:

a body that is configured to have a force exerted thereupon from an exterior of the liquid cartridge, and an extending portion extending toward an axis of the detector from the body of the restriction member, and wherein the extending portion has the second contact surface.

8. The liquid cartridge according to claim 1, further comprising a valve configured to move between a closed position in which the valve closes the outlet and open position in which the valve opens the outlet, wherein the outlet is positioned below an axis of the detector, and wherein the restriction member is connected to the valve such that the restriction member is configured to move from the first position to the second position in response to movement of the valve from the closed position to the open position.

9. The liquid cartridge according to claim 6, wherein the rotation member is positioned between the front wall and the rear wall, and comprises a float having a smaller specific gravity than ink stored in the ink chamber, wherein the float is positioned between the axis of the rotation member and the rear wall in a particular direction toward the rear wall from the front wall, and wherein the contact portion of the rotation member is positioned below the axis of the rotation member when the rotation member is positioned in the released position.

10. The liquid cartridge according to claim 7, wherein the detector includes a float that is positioned adjacent a lower wall of the chamber when the detector is positioned in the restricted position.

11. The liquid cartridge according to claim 10, wherein the contact portion of the rotation member is positioned below the restricted position of the rotation member when the rotation member is positioned in the released position.

12. The liquid cartridge according to claim 9, wherein the rotation member comprises an arm, and the detection portion is disposed on the arm.

13. The liquid cartridge according to claim 9, wherein the contact portion of the rotation member extends from the axis of the rotation member.

14. The liquid cartridge according to claim 1, further comprising a valve configured to move between a closed position in which the valve closes the outlet and open position in which the valve opens the outlet, wherein the outlet is positioned below an axis of the rotation member, and wherein the restriction member is connected to the valve such that the restriction member is configured to move in a direction intersecting to a movement direction of the valve with a movement of the valve.

15. The liquid cartridge according to claim 1 comprising:

a chamber configured to store liquid therein;

a liquid outlet configured to supply the liquid from an interior of the chamber to an exterior of the chamber, the outlet including an outlet body defining an inner space, and a first opening providing fluid communication between the inner space of the outlet body and the liquid chamber, and a second opening above the first opening;

an actuator extending through the second opening into the liquid chamber;

a seal disposed in the second hole around the actuator to prevent fluid flow from the liquid chamber to the inner space;

a detector positioned in the chamber, the detector being rotatable between a released position and a restricted position in response to movement of the actuator, the detector comprising a detection portion and a contact portion having a first contact surface defining a first length; and a restriction member comprising a second contact surface defining a second length greater than the first length, the restriction member being movable straightly between a first position in which the first and second contact surfaces contact one another, a second position in which the first and second contact surfaces do not contact one another, and a third position between the first and second positions in which the first and second contact surfaces contact one another;

wherein a half or more of a movable range of the contact portion of the detector is within a rotation angle $\theta$ of $135° < \theta < 225°$.

16. The liquid cartridge according to claim 1, wherein the second contact surface extends along a direction in which the restriction member moves.

* * * * *